US012350552B2

(12) United States Patent
Poure et al.

(10) Patent No.: US 12,350,552 B2
(45) Date of Patent: Jul. 8, 2025

(54) EXERCISE SYSTEM AND METHOD

(71) Applicant: Peloton Interactive, Inc., New York, NY (US)

(72) Inventors: Jason Poure, Hastings on Hudson, NY (US); Mark Kruse, Brooklyn, NY (US); Maureen C. Coiro, Brooklyn, NY (US); John Consiglio, Jersey City, NJ (US); Nigel Alcorn, Bridgeport, CT (US); Betina Evancha, Brooklyn, NY (US); Ashley Willhite, Brooklyn, NY (US)

(73) Assignee: Peloton Interactive, Inc., New York, NY (US)

( * ) Notice: Subject to any disclaimer, the term of this patent is extended or adjusted under 35 U.S.C. 154(b) by 0 days.

(21) Appl. No.: 17/572,576

(22) Filed: Jan. 10, 2022

(65) Prior Publication Data

US 2022/0203171 A1 Jun. 30, 2022

Related U.S. Application Data

(63) Continuation of application No. 15/863,596, filed on Jan. 5, 2018, now Pat. No. 11,219,799, which is a (Continued)

(51) Int. Cl.
*A63B 24/00* (2006.01)
*A63B 22/00* (2006.01)
(Continued)

(52) U.S. Cl.
CPC ..... *A63B 24/0087* (2013.01); *A63B 22/0023* (2013.01); *A63B 22/025* (2015.10);
(Continued)

(58) Field of Classification Search
CPC ..... A63B 24/0075; A63B 22/0023; A63B 22/025; A63B 22/0285; A63B 23/0405;
(Continued)

(56) References Cited

U.S. PATENT DOCUMENTS 3,976,192 A 8/1976 Muller
4,591,147 A 5/1986 Smith et al.
(Continued)

FOREIGN PATENT DOCUMENTS

CA 2522037 C * 11/2011 ..... A61H 33/005
CN 2877780 3/2007
(Continued)

OTHER PUBLICATIONS

"CompuTrainer", Racermate, 2017, retrieved Nov. 30, 2018 from «http://www/racermateinc.com/computrainer/», 1 page.
(Continued)

*Primary Examiner* — Shila Jalalzadeh Abyaneh
(74) *Attorney, Agent, or Firm* — Haynes and Boone, LLP

(57) ABSTRACT

A treadmill includes a deck having a continuous track, and a plurality of slats fixedly connected to the track. The treadmill also includes a first post extending from the deck, a second post extending from the deck opposite the first post, and a first arm supported by the first post and including a first rotary control. The treadmill further includes a second arm opposite the first arm and supported by the second post. The second arm includes a second rotary control separate from the first rotary control. The first rotary control is configured to control a first function of the treadmill and the second rotary control is configured to control a second function of the treadmill different from the first function.

20 Claims, 42 Drawing Sheets

Related U.S. Application Data continuation-in-part of application No. 15/686,875, filed on Aug. 25, 2017, now Pat. No. 10,864,406.

(60) Provisional application No. 62/380,412, filed on Aug. 27, 2016.

(51) Int. Cl.

| | |
|---|---|
| ***A63B 22/02*** | (2006.01) |
| ***A63B 23/04*** | (2006.01) |
| ***A63B 23/12*** | (2006.01) |
| ***A63B 71/00*** | (2006.01) |
| ***A63B 71/06*** | (2006.01) |

(52) U.S. Cl.

CPC ..... *A63B 22/0285* (2013.01); *A63B 23/0405* (2013.01); *A63B 23/1227* (2013.01); *A63B 24/0062* (2013.01); *A63B 24/0075* (2013.01); *A63B 71/0054* (2013.01); *A63B 71/0616* (2013.01); *A63B 71/0622* (2013.01); *A63B 2024/0081* (2013.01); *A63B 2071/0081* (2013.01); *A63B 2071/0625* (2013.01); *A63B 2071/065* (2013.01); *A63B 2071/0655* (2013.01); *A63B 2071/0675* (2013.01); *A63B 2071/0694* (2013.01); *A63B 2220/17* (2013.01); *A63B 2220/20* (2013.01); *A63B 2220/806* (2013.01); *A63B 2220/808* (2013.01); *A63B 2220/833* (2013.01); *A63B 2225/20* (2013.01); *A63B 2225/50* (2013.01); *A63B 2225/74* (2020.08); *A63B 2230/01* (2013.01); *A63B 2230/06* (2013.01); *A63B 2230/42* (2013.01); *A63B 2230/75* (2013.01)

(58) Field of Classification Search

CPC ..... A63B 23/1227; A63B 24/0062; A63B 24/0087; A63B 71/0054; A63B 71/0616; A63B 71/0622; A63B 2024/0081; A63B 2071/0081; A63B 2071/0625; A63B 2071/065; A63B 2071/0655; A63B 2071/0675; A63B 2071/0694; A63B 2220/17; A63B 2220/20; A63B 2220/806; A63B 2220/808; A63B 2220/833; A63B 2225/20; A63B 2225/50; A63B 2225/74; A63B 2230/01; A63B 2230/06; A63B 2230/42; A63B 2230/75; H01H 19/585; H01H 67/06; H01H 71/56; H01H 2071/565

See application file for complete search history.

(56) References Cited

U.S. PATENT DOCUMENTS

| | | | | |
|---|---|---|---|---|
| 4,614,337 | A | 9/1986 | Schonenberger | |
| 4,771,148 | A | 9/1988 | Bersonnet | |
| D303,414 | S | 9/1989 | Armstrong et al. | |
| 5,029,801 | A | 7/1991 | Dalebout et al. | |
| 5,104,120 | A | 4/1992 | Watterson et al. | |
| D330,399 | S | 10/1992 | Furline | |
| 5,178,594 | A | 1/1993 | Wu | |
| 5,336,145 | A | 8/1994 | Keiser | |
| 5,383,826 | A * | 1/1995 | Michael | A63B 24/00 482/3 |
| 5,441,468 | A | 8/1995 | Deckers et al. | |
| 5,458,548 | A | 10/1995 | Crossing et al. | |
| 5,546,067 | A * | 8/1996 | Schmidt | H01C 10/36 200/11 DA |
| 5,547,439 | A | 8/1996 | Rawls et al. | |
| 5,656,000 | A | 8/1997 | Russell | |
| 5,862,715 | A * | 1/1999 | Lemire | H01H 19/11 74/553 |
| 5,947,868 | A | 9/1999 | Dugan | |
| 5,984,838 | A | 11/1999 | Wang et al. | |
| 5,989,161 | A | 11/1999 | Wang et al. | |
| 6,042,514 | A | 3/2000 | Abelbeck | |
| 6,050,924 | A | 4/2000 | Shea | |
| 6,171,218 | B1 | 1/2001 | Shea | |
| 6,225,980 | B1 * | 5/2001 | Weiss | G06F 3/0362 345/157 |
| 6,231,482 | B1 | 5/2001 | Thompson | |
| 6,312,363 | B1 | 11/2001 | Watterson et al. | |
| 6,409,633 | B1 | 6/2002 | Abelbeck | |
| 6,438,241 | B1 * | 8/2002 | Silfvast | H04H 60/04 84/625 |
| 6,471,622 | B1 | 10/2002 | Hammer et al. | |
| 6,601,016 | B1 | 7/2003 | Brown et al. | |
| 6,626,803 | B1 | 9/2003 | Oglesby et al. | |
| 6,648,798 | B2 | 11/2003 | Yoo | |
| 6,695,751 | B1 | 2/2004 | Hsu | |
| 6,702,719 | B1 | 3/2004 | Brown et al. | |
| 6,749,536 | B1 | 6/2004 | Cuskaden et al. | |
| 6,764,430 | B1 | 7/2004 | Fencel | |
| 6,830,541 | B2 | 12/2004 | Wu | |
| 6,899,659 | B2 | 5/2005 | Anderson et al. | |
| 6,902,513 | B1 | 6/2005 | McClure | |
| 6,923,746 | B1 | 8/2005 | Skowronski et al. | |
| 6,984,193 | B2 | 1/2006 | Chen | |
| 6,997,853 | B1 | 2/2006 | Cuskaden et al. | |
| 7,145,087 | B1 * | 12/2006 | Su | H01H 19/11 200/11 R |
| 7,153,241 | B2 | 12/2006 | Wang | |
| 7,252,624 | B2 | 8/2007 | Wu et al. | |
| 7,348,503 | B2 * | 3/2008 | Shiroyama | H01H 25/065 345/184 |
| 7,455,620 | B2 | 11/2008 | Frykman et al. | |
| 7,562,761 | B2 | 7/2009 | Tasma et al. | |
| 7,594,878 | B1 | 9/2009 | Joannou | |
| 7,618,352 | B1 | 11/2009 | Wei | |
| D606,599 | S | 12/2009 | Murray et al. | |
| 7,628,730 | B1 | 12/2009 | Walterson et al. | |
| 7,746,997 | B2 | 6/2010 | Brunson | |
| 7,927,253 | B2 | 4/2011 | Vincent et al. | |
| 8,001,472 | B2 | 8/2011 | Gilley et al. | |
| 8,012,067 | B2 | 9/2011 | Joannou | |
| 8,348,813 | B2 | 1/2013 | Huang | |
| 8,376,910 | B2 | 2/2013 | Cheung | |
| 8,545,369 | B2 | 10/2013 | Cheung | |
| 8,579,767 | B2 | 11/2013 | Ellis et al. | |
| 8,608,624 | B2 | 12/2013 | Shabodyash et al. | |
| 8,686,306 | B2 * | 4/2014 | Harris | B60K 35/10 200/336 |
| 8,829,376 | B2 | 9/2014 | Wei | |
| 8,986,169 | B2 | 3/2015 | Bayerlein et al. | |
| 9,174,085 | B2 | 11/2015 | Foley et al. | |
| 9,254,411 | B1 | 2/2016 | Chang | |
| 9,452,314 | B2 | 9/2016 | Hou | |
| 9,463,349 | B1 | 10/2016 | Chang | |
| 9,579,544 | B2 | 2/2017 | Watterson | |
| 9,616,278 | B2 | 4/2017 | Olson | |
| 9,623,285 | B1 | 4/2017 | Ruiz | |
| 9,636,567 | B2 | 5/2017 | Brammer et al. | |
| 9,646,781 | B1 * | 5/2017 | Gluchman, Jr. | H01H 13/14 |
| 9,649,528 | B2 | 5/2017 | Hou | |
| 9,675,839 | B2 | 6/2017 | Dalebout et al. | |
| 9,682,307 | B2 | 6/2017 | Dalebout | |
| 9,694,234 | B2 * | 7/2017 | Dalebout | A63B 22/02 |
| 9,694,242 | B2 | 7/2017 | Ashby et al. | |
| 9,713,742 | B2 | 7/2017 | Pasin et al. | |
| 9,767,785 | B2 | 9/2017 | Ashby et al. | |
| 9,782,625 | B1 | 10/2017 | Blum et al. | |
| 9,808,672 | B2 | 11/2017 | Dalebout | |
| 9,814,929 | B2 | 11/2017 | Moser | |
| 9,814,930 | B2 | 11/2017 | Manzke et al. | |
| 10,009,644 | B2 | 6/2018 | Aimone | |
| 10,010,748 | B1 | 7/2018 | Weinstein et al. | |
| 2002/0091627 | A9 | 7/2002 | Yang | |
| 2003/0093248 | A1 | 5/2003 | Vock et al. | |
| 2003/0199366 | A1 | 10/2003 | Anderson et al. | |
| 2003/0216225 | A1 * | 11/2003 | Pan | A63B 24/00 482/54 |

(56) References Cited

U.S. PATENT DOCUMENTS

2004/0102931 A1 5/2004 Ellis et al.
2004/0121884 A1 6/2004 Chang
2004/0166995 A1* 8/2004 Wu ..... H01H 21/10 482/54
2005/0054490 A1* 3/2005 Chou ..... A63B 22/02 482/54
2005/0137062 A1 6/2005 Kuokkanen
2005/0239601 A1 10/2005 Thomas
2006/0009332 A1* 1/2006 Jones ..... A63B 24/0062 482/54
2006/0058160 A1 3/2006 Lee et al.
2006/0136173 A1 6/2006 Case, Jr. et al.
2006/0189439 A1 8/2006 Baudhuin
2006/0207867 A1* 9/2006 Waddington ..... H03K 17/962 200/315
2007/0032345 A1 2/2007 Padmanabhan et al.
2007/0072743 A1 3/2007 Severin et al.
2007/0105693 A1 5/2007 Wang
2007/0116207 A1 5/2007 Brunson
2007/0219059 A1 9/2007 Schwartz
2007/0279401 A1* 12/2007 Ramstein ..... G06F 3/016 345/184
2007/0281831 A1 12/2007 Wang
2008/0076637 A1 3/2008 Gilley et al.
2008/0086318 A1 4/2008 Gilley
2008/0116036 A1 5/2008 Tasma et al.
2008/0242511 A1* 10/2008 Munoz ..... A63B 22/02 482/5
2009/0011907 A1 1/2009 Radow et al.
2009/0098524 A1 4/2009 Walton
2009/0233771 A1 9/2009 Quatrochi et al.
2010/0048358 A1 2/2010 Tchao et al.
2010/0062904 A1 3/2010 Crawford et al.
2010/0160115 A1* 6/2010 Morris ..... A63B 22/0235 482/4
2011/0082008 A1 4/2011 Cheung
2011/0082011 A1 4/2011 Ellis
2011/0190097 A1 8/2011 Daly et al.
2011/0306911 A1 12/2011 Tran
2012/0088633 A1 4/2012 Crafton
2012/0179772 A1 7/2012 Hinnebusch
2012/0237911 A1 9/2012 Watterson
2013/0125025 A1 5/2013 Cheung
2013/0137073 A1 5/2013 Nacey et al.
2013/0178337 A1 7/2013 Brammer
2013/0220779 A1* 8/2013 Kerner ..... H01H 25/06 200/4
2013/0237374 A1* 9/2013 Ashby ..... A63B 71/0054 482/4
2013/0267386 A1 10/2013 Her
2013/0281241 A1 10/2013 Watterson et al.
2013/0346168 A1 12/2013 Zhou et al.
2014/0038781 A1 2/2014 Foley et al.
2014/0082526 A1 3/2014 Park et al.
2014/0172135 A1 6/2014 Eisner
2014/0223462 A1 8/2014 Aimone
2015/0182800 A1* 7/2015 Watterson ..... A63B 22/02 482/4
2015/0182845 A1 7/2015 Kolman et al.
2015/0190671 A1 7/2015 Golen, Jr
2015/0224364 A1 8/2015 Hsieh
2015/0238817 A1 8/2015 Walterson et al.
2015/0238819 A1 8/2015 Volkerink et al.
2015/0273272 A1 10/2015 Wang
2016/0023044 A1 1/2016 Dalebout
2016/0023045 A1 1/2016 Dalebout
2016/0023049 A1 1/2016 Dalebout
2016/0086749 A1* 3/2016 Pfau ..... B60K 35/60 200/11 R
2016/0103970 A1 4/2016 Lie et al.
2016/0129311 A1 5/2016 Yang
2016/0166877 A1 6/2016 Cei et al.
2016/0170436 A1* 6/2016 Farrar ..... G05G 1/08 345/184
2016/0181028 A1 6/2016 Ebrom et al.
2016/0199695 A1 7/2016 Armstrong
2016/0287930 A1 10/2016 Moser
2017/0103440 A1 4/2017 Xing et al.
2017/0186444 A1 6/2017 Lu
2017/0281079 A1 10/2017 Nachman
2017/0326411 A1 11/2017 Watterson
2017/0333751 A1 11/2017 Seol
2017/0340917 A1 11/2017 Chang
2018/0036593 A1 2/2018 Ridgel et al.
2018/0056132 A1 3/2018 Foley et al.
2018/0126248 A1 5/2018 Dion et al.
2018/0126249 A1 5/2018 Consiglio
2018/0140903 A1 5/2018 Poure et al.
2018/0308389 A1 10/2018 Moser et al.
2018/0308649 A1* 10/2018 Kubes ..... G05G 1/08
2019/0111318 A1 4/2019 Evancha et al.
2019/0143194 A1 5/2019 Evancha et al.
2020/0015736 A1 1/2020 Alhathal
2021/0093921 A1 4/2021 Foley et al.

FOREIGN PATENT DOCUMENTS

CN 101108273 * 1/2008
CN 101108273 A * 1/2008
CN 101454050 A 6/2009
CN 101766891 A 7/2010
CN 102357284 2/2012
CN 104056442 A 9/2014
CN 105409145 A 3/2016
CN 205595259 U 9/2016
CN 106470739 A 3/2017
CN 206544889 U 10/2017
CN 108853946 A 11/2018
EP 0919259 6/1999
EP 2964349 1/2016
JP 2004-331004 11/2004
JP 2004331004 A 11/2004
JP 2011076980 * 4/2011
JP 2011076980 A * 4/2011
JP 2012-050584 3/2012
JP 2012050584 A 3/2012
JP 2016510234 A 4/2016
JP 2016163684 A 9/2016
JP 2017199318 A 11/2017
JP 2018-175670 11/2018
JP 2018175670 A 11/2018
TW 201703500 A 1/2017
TW I606856 B 12/2017
TW 201802767 A 1/2018
TW 1644706 12/2018
WO WO-9620757 A1 * 7/1996 ..... A63B 22/02
WO WO 1997/041925 11/1997
WO WO 2005/087323 9/2005
WO WO-2008102389 A1 * 8/2008 ..... A63B 24/00
WO WO 2017/209500 12/2017
WO WO 2019/143488 7/2019

OTHER PUBLICATIONS

"Netathlon", WebRacing, 2014, retrieved Nov. 30, 2018 from «http://webracinginc.com/products_netathlon.htm», 3 pages.

* cited by examiner

EXERCISE SYSTEM AND METHOD

CROSS-REFERENCE TO RELATED APPLICATIONS

This application is a continuation of U.S. application Ser. No. 15/863,596, filed Jan. 5, 2018, which is a continuation-in-part of U.S. application Ser. No. 15/686,875, filed Aug. 25, 2017, which claims the benefit of U.S. Provisional Application No. 62/380,412, filed Aug. 27, 2016. The entire disclosures of each of the above applications are incorporated herein by reference.

FIELD OF THE INVENTION

This application relates generally to the field of exercise equipment and methods associated therewith. In particular, this application relates to an exercise system and method configured to provide streaming and on-demand exercise classes to one or more users.

BACKGROUND

Humans are competitive by nature, striving to improve their performance both as compared to their own prior efforts and as compared to others. Humans are also drawn to games and other diversions, such that even tasks that a person may find difficult or annoying can become appealing if different gaming elements are introduced. Existing home and gym-based exercise systems and methods frequently lack key features that allow participants to compete with each other, converse with each other, and that gamify exercise activities.

While some existing exercise equipment incorporates diversions such as video displays that present content or performance data to the user while they exercise, these systems lack the ability to truly engage the user in a competitive or gaming scenario that improves both the user's experience and performance. Such systems also lack the ability to facilitate real-time sharing of information, conversation, data, and/or other content between users, as well as between an instructor and one or more users.

To improve the experience and provide a more engaging environment, gyms offer exercise classes such as aerobics classes, yoga classes, or other classes in which an instructor leads participants in a variety of exercises. Such class-based experiences, however, are accessible only at specific times and locations. As a result, they are unavailable to many potential users, generally are very expensive, and often sell-out so that even users in a location convenient to the gym cannot reserve a class. Example embodiments of the present disclosure address these problems, providing an exercise machine, embodied by an example treadmill, that incorporates multimedia inputs and outputs for live streaming or archived instructional content, socially networked audio and video chat, networked performance metrics and competition capabilities, along with a range of gamification features.

SUMMARY OF THE INVENTION

In an example embodiment of the present disclosure, a treadmill includes a deck having a continuous track, and a plurality of slats fixedly connected to the track. The treadmill also includes a first post extending from the deck, a second post extending from the deck opposite the first post, and a first arm supported by the first post and including a first rotary control. The treadmill further includes a second arm opposite the first arm and supported by the second post. The second arm includes a second rotary control separate from the first rotary control. The first rotary control is configured to control a first function of the treadmill and the second rotary control is configured to control a second function of the treadmill different from the first function.

In another example embodiment of the present disclosure, a treadmill includes a controller, a first motor operably connected to the controller, a second motor separate from the first motor and operably connected to the controller, a first rotary control operably connected to the controller, and a second rotary control separate from the first rotary control and operably connected to the controller. In such an embodiment, the first rotary control is configured to control a first function of the treadmill associated with the first motor. Additionally, the second rotary control is configured to control a second function of the treadmill associated with the second motor different from the first function.

In a further example embodiment of the present disclosure, a method of manufacturing a treadmill includes providing an upper assembly including a first arm, a second arm opposite the first arm, a first crossbar extending from the first arm to the second arm, and a second crossbar opposite the first crossbar and extending from the first arm to the second arm. Such a method also includes connecting a first rotary control to the first arm, the first rotary control including an outer portion rotatable relative to the first arm, and an inner portion including an input device. Such a method further includes connecting a second rotary control to the second arm, the second rotary control including an outer portion rotatable relative to the second arm. Such a method also includes operably connecting the first and second rotary controls to a controller of the treadmill. The first rotary control is configured to control a first function of the treadmill via the controller, and the second rotary control is configured to control a second function of the treadmill via the controller different from the first function.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

DETAILED DESCRIPTION

Figure 1:
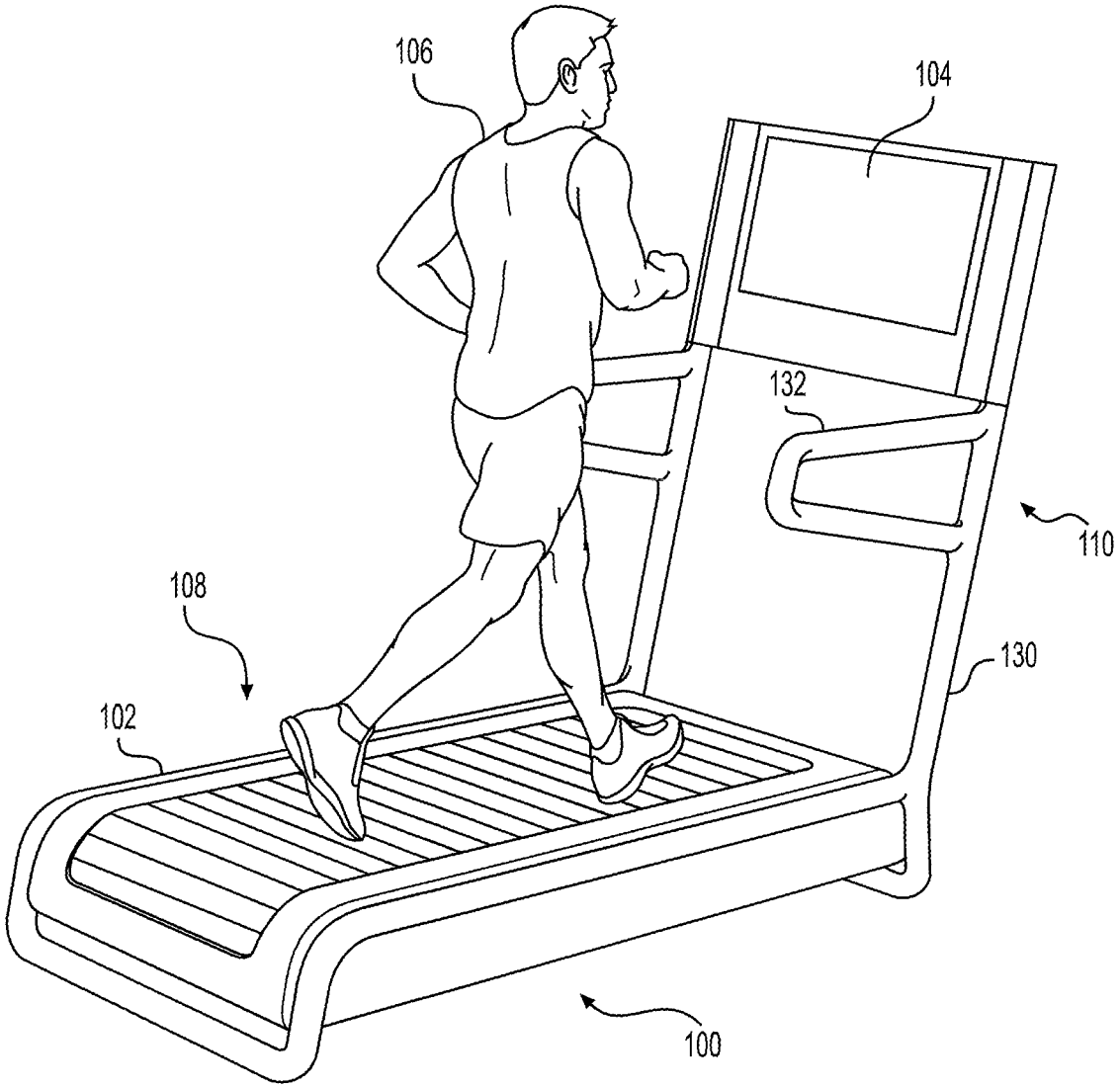
FIG. 1 is a rear perspective view of an exemplary exercise machine as disclosed herein with a user shown.
Figure 2:
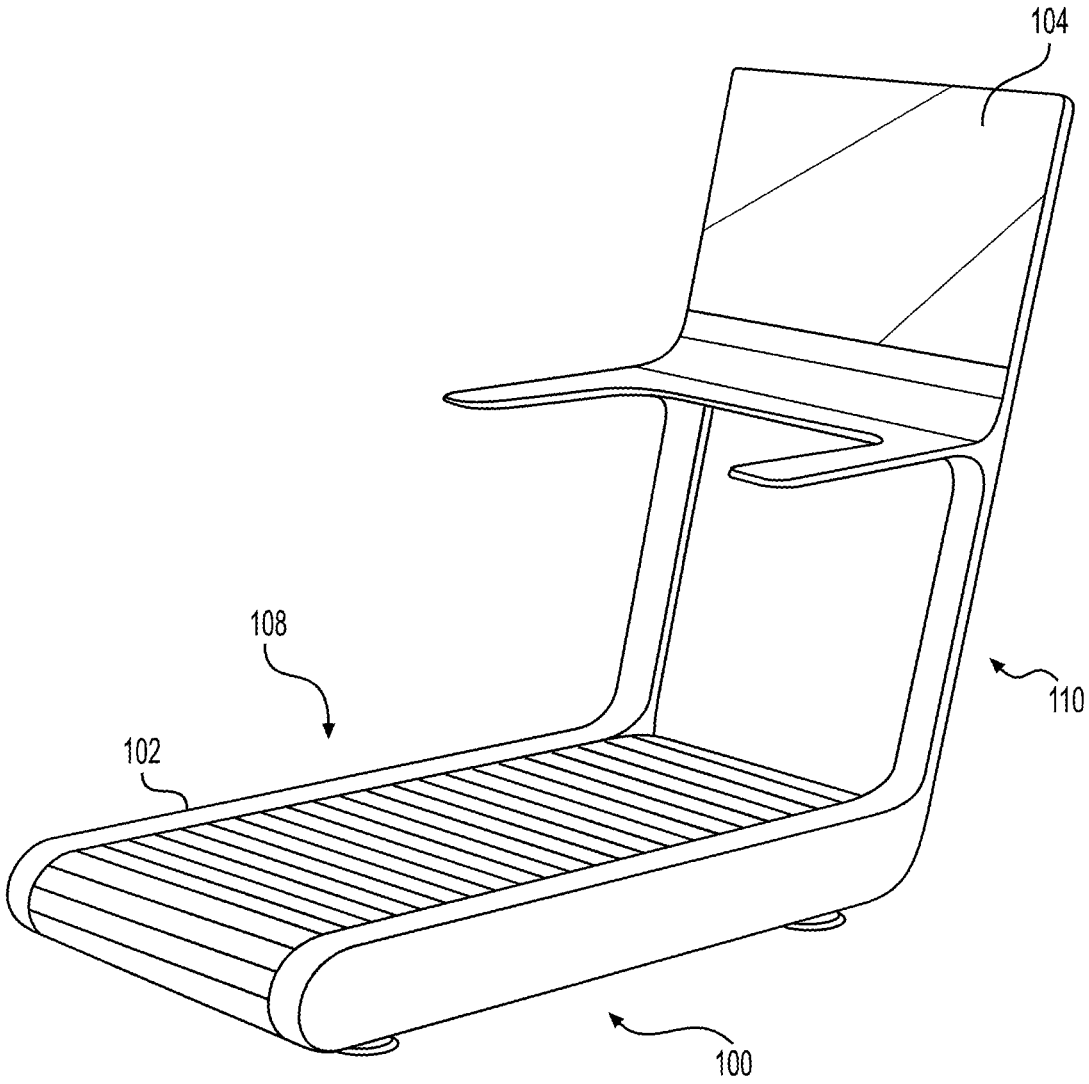
FIG. 2 is a rear perspective view of another exemplary exercise machine as disclosed herein.
Figure 3:
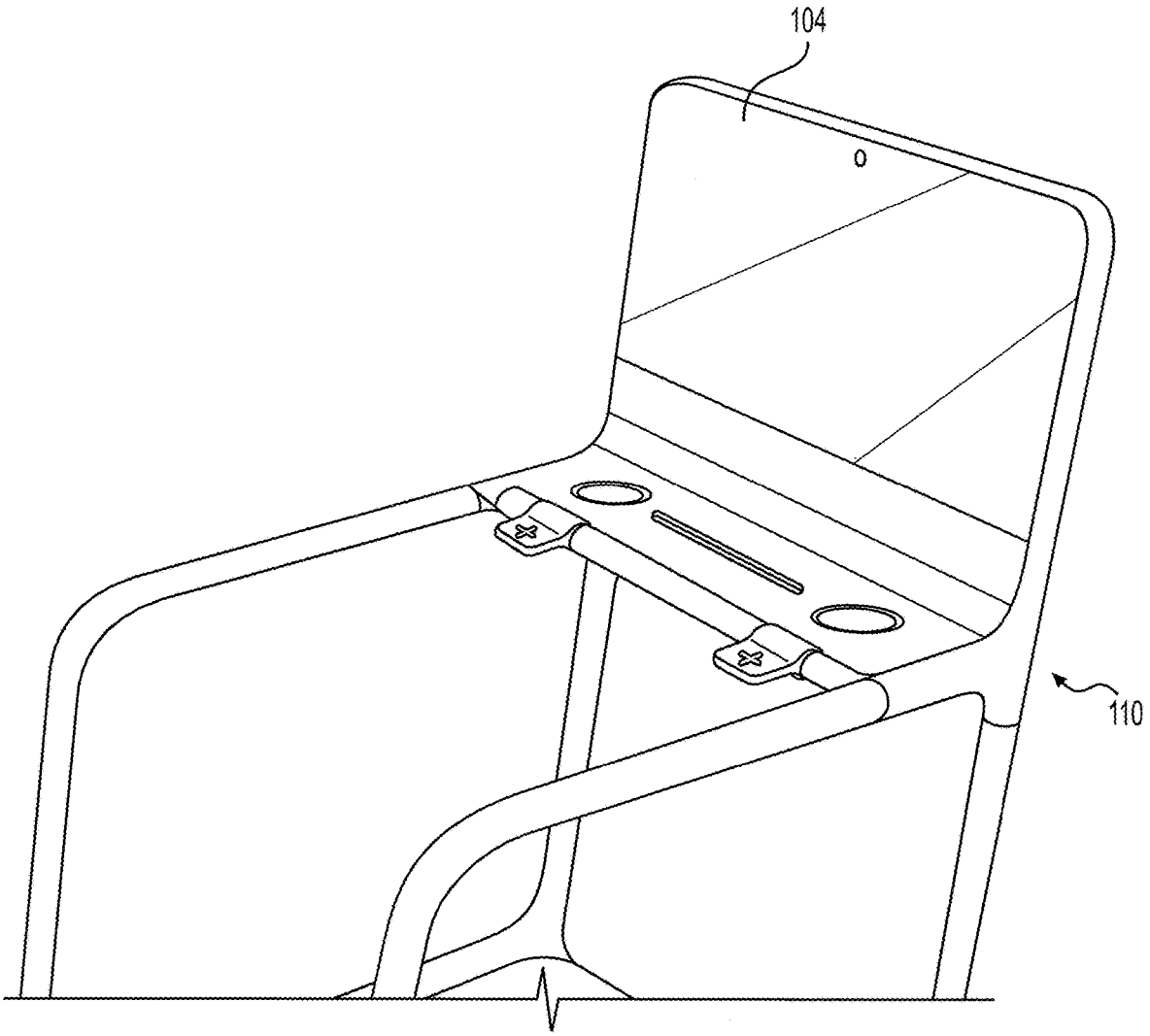
FIG. 3 is a rear perspective view of a portion of a further exemplary exercise machine as disclosed herein.
Figure 4:
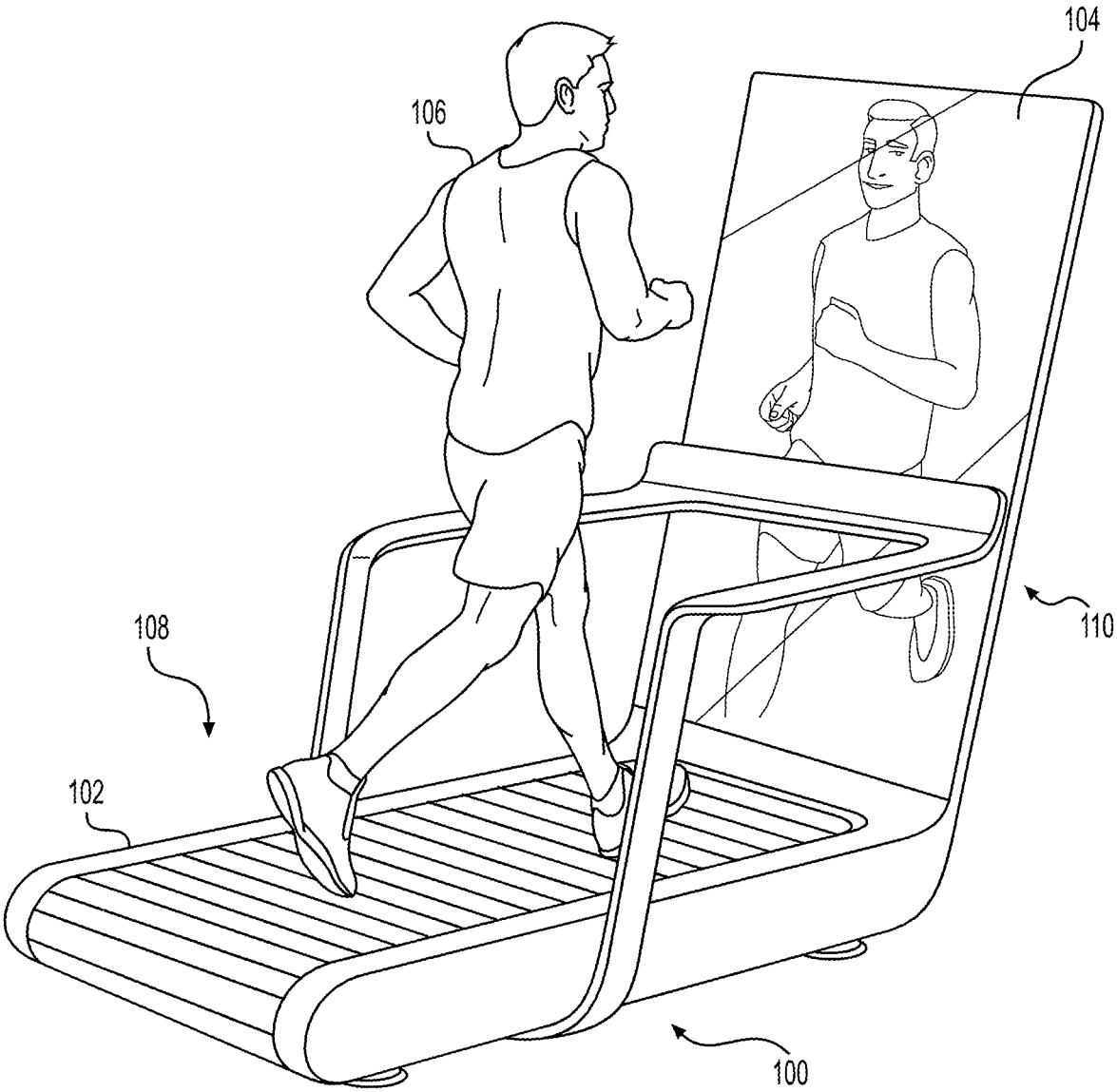
FIG. 4 is a rear perspective view of still another exemplary exercise machine as disclosed herein with a user shown.

The following description is presented to enable any person skilled in the art to make and use aspects of the example embodiments described herein. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the present disclosure. Thus, the present disclosure is not intended to be limited to the embodiments shown, but is to be accorded the widest possible scope consistent with the principles and features disclosed herein.

Example embodiments of the present disclosure include networked exercise systems and methods whereby one or more exercise devices, such as treadmills, rowing machines, stationary bicycles, elliptical trainers, or any other suitable equipment, may be equipped with an associated local system that allows a user to fully participate in live instructor-led or recorded exercise classes from any location that can access a suitable communications network. The networked exercise systems and methods may include backend systems with equipment including without limitation servers, digital storage systems, and other hardware as well as software to manage all processing, communications, database, and other functions. The networked exercise systems and methods may also include one or more studio or other recording locations with cameras, microphones, and audio and/or visual outputs where one or more instructors can lead exercise classes and in some embodiments where live exercise classes can be conducted, and where such live and previously recorded classes can be distributed via the communications network. In various embodiments there may be a plurality of recording locations that can interact with each other and/or with any number of individual users.

In various embodiments, the example exercise systems and machines describe herein provide for full interactivity in all directions. Whether remote or in the same location, instructors may be able to interact with users, users may be able to interact with instructors, and users may be able to interact with other users. Through the disclosed networked exercise systems and machines, instructors may be able to solicit feedback from users, and users may be able to provide feedback to the instructor, vote or express opinions on different choices or options, and communicate regarding their experience. Such example exercise systems and machines allow for interaction through all media, including one or more video channels, audio including voice and/or music, and data including a complete range of performance data, vital statistics, chat, voice, and text-based and other communications.

In various embodiments, the exercise systems and machines described herein also allow an unlimited number of remote users to view and participate in the same live or recorded content simultaneously, and in various embodiments they may be able to interact with some or all of the other users viewing same content. Remote users can participate in live exercise classes offered from any available remote recording location, or they can access previously recorded classes archived in the system database. In various embodiments, a plurality of remote users can simultaneously access the same recorded class and interact with each other in real time, or they can access the same recorded class at different times and share data and communications about their performance or other topics.

Thus, the networked exercise systems and machines, and the corresponding methods described herein, provide for content creation, content management and distribution, and content consumption. Various aspects of such exercise systems and machines, and the potential interactions between such machines, will now be described in more detail.

Exercise Machine

Referring generally to FIGS. 1 through 7 and FIGS. 25-41, in various example embodiments of the present disclosure, a local system 100 may include an exercise machine 102, such as a treadmill, with integrated or connected digital hardware including one or more displays 104 for use in connection with an instructor lead exercise class and/or for displaying other digital content. While the exercise machine 102 may be described and/or otherwise referred to herein as a "treadmill 102," as noted above, example exercise machines of the present disclosure may be any suitable type of exercise machine, including a rowing machine, stationary bicycle, elliptical trainer, stair climber, etc.

In various example embodiments, the one or more displays 104 may be mounted directly to the exercise machine 102 or otherwise placed within view of a user 106. In various exemplary embodiments, the one or more displays 104 allow the user 106 to view content relating to a selected exercise class both while working out on the exercise machine 102 and while working out in one or more locations near or adjacent to the exercise machine 102. The exercise machine 102 may also include a hinge, joint, pivot, bracket or other suitable mechanism to allow for adjustment of the position or orientation of the display 104 relative to the user 106 whether they are using the exercise machine 102 or working out near or adjacent to the exercise machine 102.

In example embodiments, the exercise machine 102 may generally include a lower assembly 108, and an upper assembly 110 connected to the lower assembly 108. The lower assembly 108 may generally include a deck 112 of the exercise machine 102 that provides support for the user 106 (e.g., a running surface) while the user 106 is working out on the exercise machine 102, as well as other components of both the lower assembly 108 and the upper assembly 110. For example, as shown in at least the exploded view of FIG. 26, the deck 112 may support a first motor 114 of the exercise machine 102 configured to increase, decrease, and/or otherwise change an incline of the deck 112, a frame of the deck 112, and/or the running surface relative to a support surface on which the exercise machine 102 is disposed. The deck 112 may also include one or more incline frames 116 coupled to the motor 114 and configured to, for example, raise and lower the deck 112, frame of the deck 112, and/or running surface of the deck 112 by acting on the support surface when the motor 114 is activated. The deck 112 may also include a second motor 118 configured to increase, decrease, and/or otherwise change a rotational speed of a belt 120 connected to the deck 112. The belt 120 may be rotatable relative to at least part of the deck 112 and, in particular, may be configured to revolve or otherwise move completely around (i.e., encircle) at least part of the deck 112 during use of the exercise machine 120. For example, in embodiments in which the exercise machine 102 comprises a treadmill, the belt 120 may support the user 106 and may repeatedly encircle at least part of a frame of the deck 112 as the user 106 runs, walks, and/or otherwise works out on the treadmill. Such an example belt 120 may include one or more continuous tracks 122 movably coupled to a gear, flywheel, pulley, and/or other member 124 of the deck 112, and such a member 124 may be coupled to an output shaft or other component of the motor 118. In such examples, rotation of the output shaft or other component of the motor 118 may drive commensurate rotation of the member 124. Likewise, rotation of the member 124 may drive commensurate revolution of the one or more continuous tracks 122 and/or the belt 120 generally.

Figure 27:
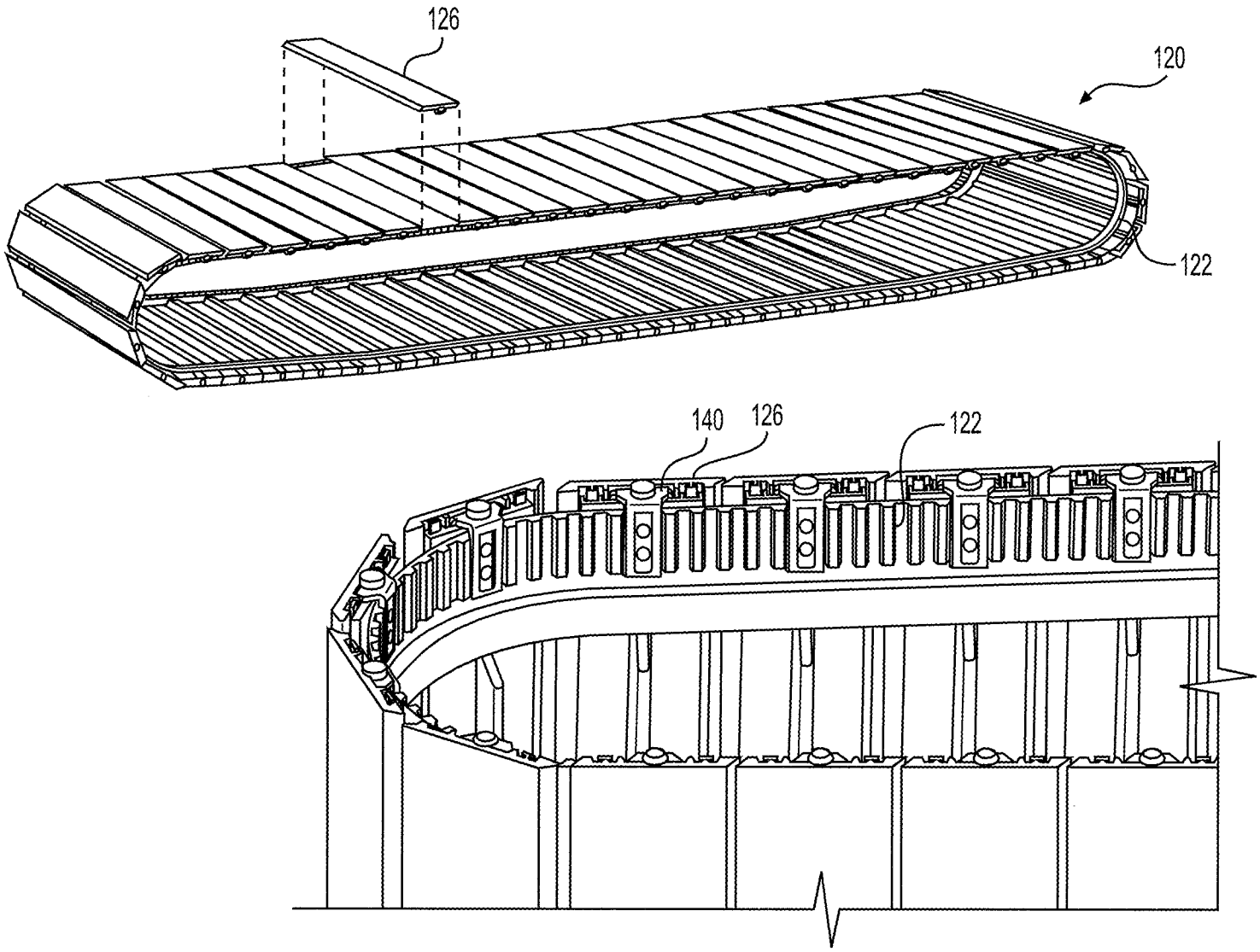
FIG. 27 illustrates a belt associated with the example exercise machine shown in FIG. 25.
Figure 28:
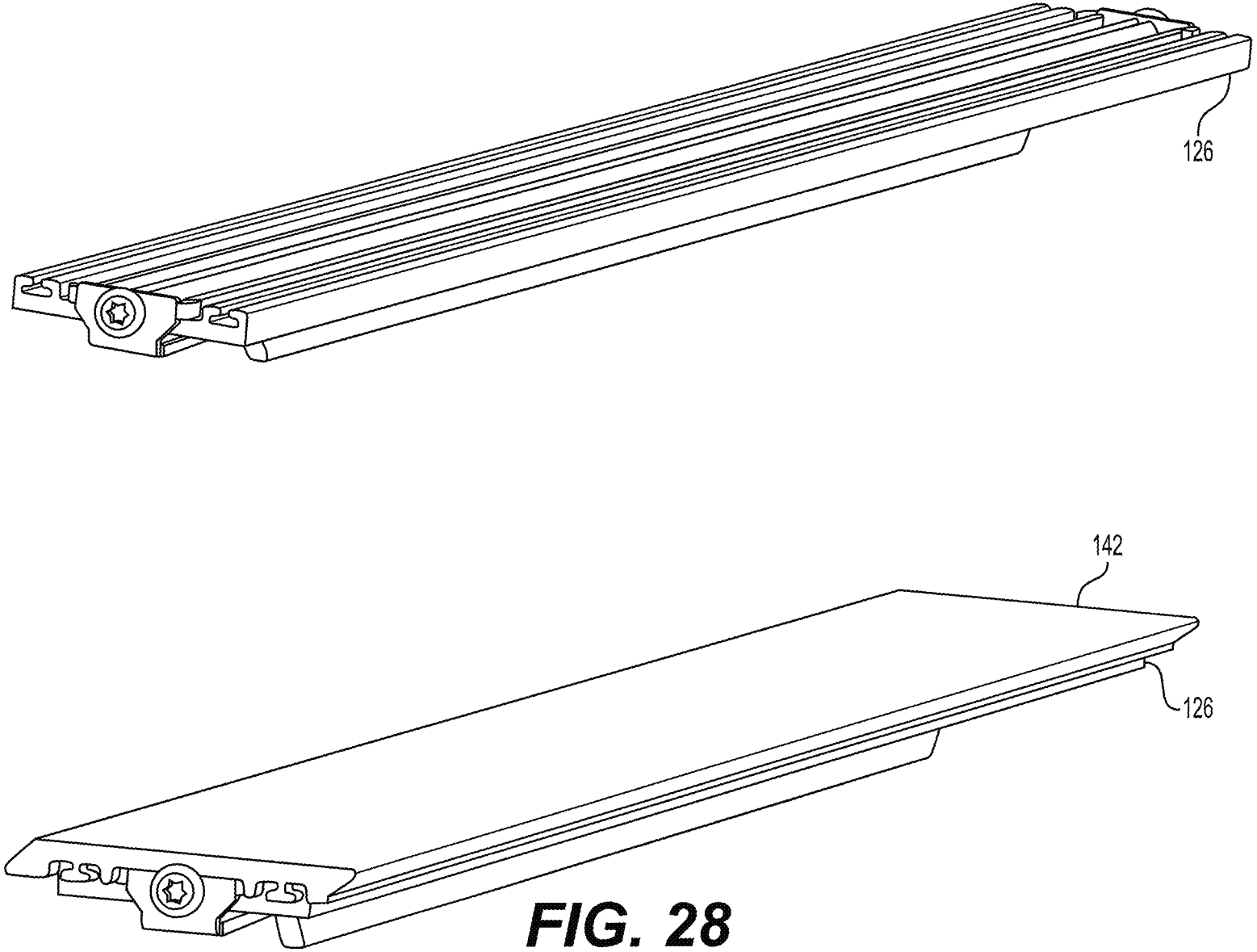
FIG. 28 illustrates a slat associated with the example exercise machine shown in FIG. 25.

The belt 120 may also include a plurality of laterally aligned slats 126 connected to the one or more continuous tracks 122. For example, as shown in FIGS. 27 and 28, each slat 126 may extend substantially parallel to at least one adjacent slat 126. Additionally, each slat 126 may be hingedly, pivotally, and/or otherwise movably coupled to the one or more continuous tracks 122 via one or more respective couplings 140. Such couplings 140 may comprise, for example, a bracket, pin, screw, clip, bolt, and/or one or more other fastening components configured to secure a respective slat 126 to the continuous track 122 while allowing the slat 126 to pivot, rotate, and/or otherwise move relative to the track 122 while the belt 120 revolves about the deck 112. As shown in at least FIG. 28, each slat 126 may also include a top pad 142 coupled thereto. The top pad 142 may comprise a plastic, rubber, polymeric, and/or other type of non-slip pad configured to reduce and/or substantially eliminate slipping of the user 106 when the user is running, walking, and/or otherwise exercising on the exercise machine 102. Such a top pad 142 may also reduce the impact associated with walking and/or running on the exercise machine 102, and may thus improve the comfort of the user 106 during various exercise classes associated with the exercise machine 102.

Figure 26:
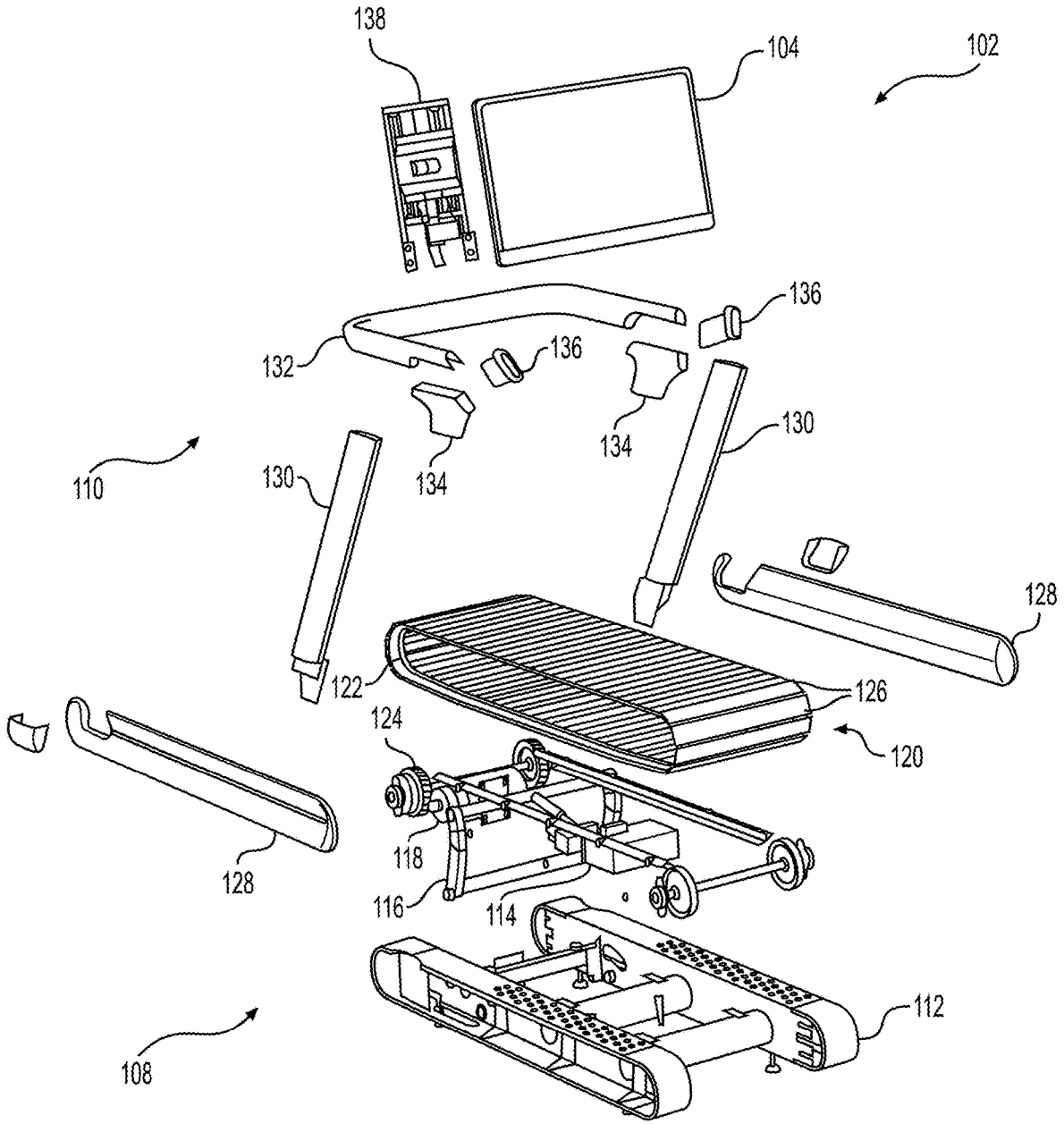
FIG. 26 illustrates an exploded view of the example exercise machine shown in FIG. 25.

With continued reference to FIG. 26, the exercise machine 102 may also include one or more sidewalls 128 connected to the deck 112. For example, the exercise machine 102 may include a first sidewall 128 on a left-hand side of the deck 112, and a second sidewall 128 on the right-hand side of the deck 112. Such sidewalls 128 may be made from cloth, foam, plastic, rubber, polymers, and/or other like material, and in some examples, the sidewalls 128 may assist in damping and/or otherwise reducing noise generated by one or more of the motors 114, 118 and/or other components of the deck 112.

The exercise machine 102 may also include one or more posts 130 extending upwardly from the deck 112. For example, the exercise machine 102 may include a first post 130 on the left-hand side of the deck 112, and a second post 130 on the right-hand side of the deck 112. Such posts 130 may be made from a metal, alloy, plastic, polymer, and/or other like material, and similar such materials may be used to manufacture the deck 112, the slats 126, and/or other components of the exercise machine 102. In such examples, the posts 130 may be configured to support the display 104, and in some examples, the display 104 may be directly coupled to a crossbar 132 of the exercise machine 102, and the crossbar 132 may be connected to and/or otherwise supported by the posts 130. For example, the crossbar 132 may comprise one or more hand rests or handles useful in supporting the user 106 during exercise. In some examples, the crossbar 132 may be substantially C-shaped, substantially U-shaped, and/or any other configuration. In any of the examples described herein, the crossbar 132 may extend from a first one of the posts 130 to a second one of the posts 130. Further, in some examples, the posts 130 and the crossbar 132 may comprise a single integral component of the upper assembly 110. Alternatively, in other examples, the posts 130 and the crossbar 132 may comprise separate components of the upper assembly 110. In such examples, the upper assembly 110 may include one or more brackets 134, endcaps 136, and/or additional components configured to assist in coupling the one or more posts 130 to the crossbar 132.

As noted above, the exercise machine 102 may also include a hinge, joint, pivot, bracket 138 and/or other suitable mechanism to allow for adjustment of the position or orientation of the display 104 relative to the user 106 whether they are using the exercise machine 102 or working out near or adjacent to the exercise machine 102. For example, such brackets 138 may include at least one component rigidly connected to the crossbar 132. Such brackets 138 may also include one or more additional components rigidly coupled to the display 104. In such examples, the components of the bracket 138 connected to the display 104 may be moveable, with the display 104 relative to the components of the bracket 138 connected to the crossbar 132. Such components may include one or more dove-tail slider mechanism, channels, and/or other components enabling the display 104 to controllably slide and/or otherwise move relative to the crossbar 132. Such components may also enable to the user 106 to fix the position of the display 104 relative to the crossbar 132 once the user 106 has positioned the display 104 as desired.

Figure 29:
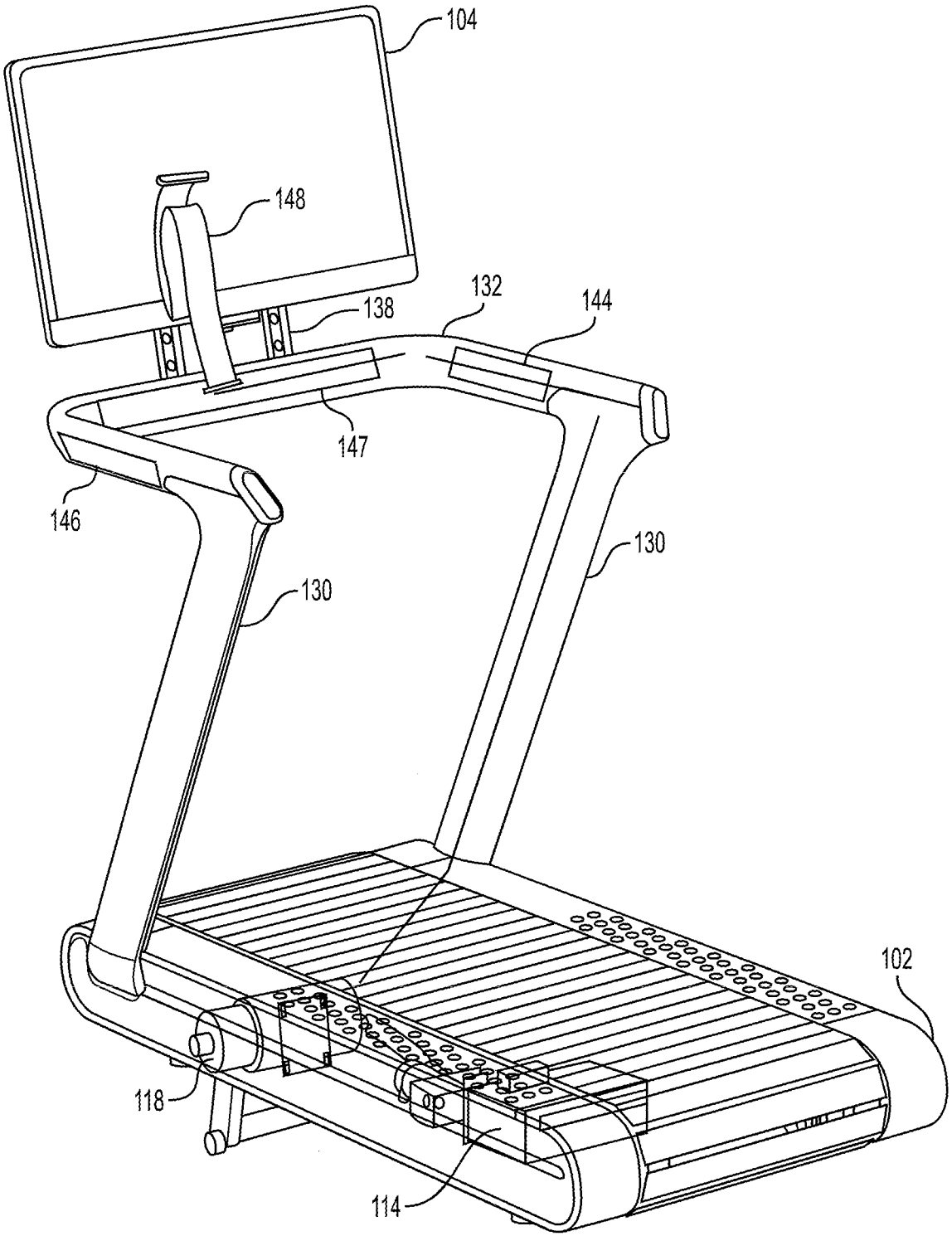
FIG. 29 illustrates another view of the example exercise machine shown in FIG. 25 including one or more sensors and one or more controls.
Figure 30:
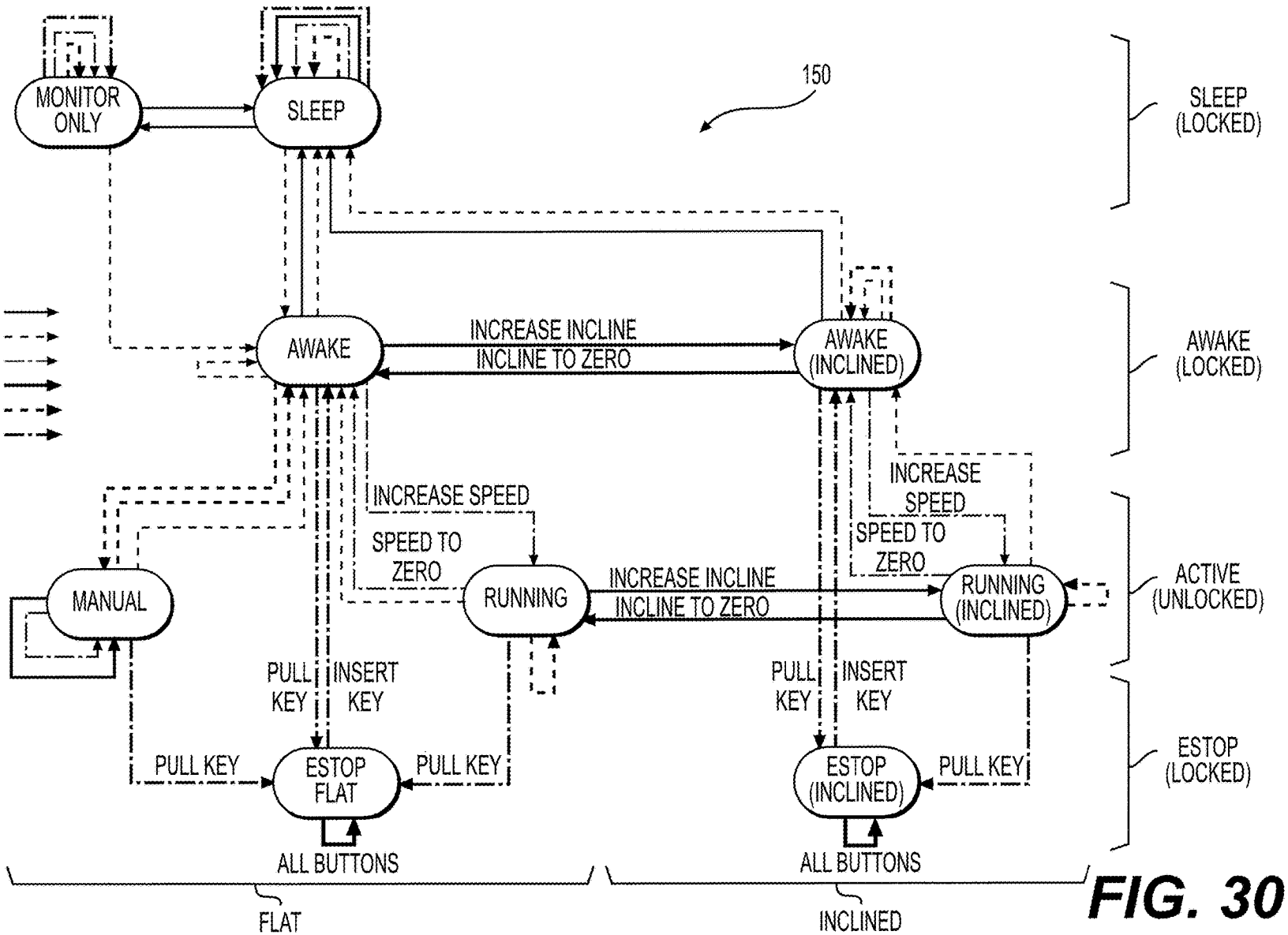
FIG. 30 illustrates a control architecture associated with the example exercise machine shown in FIG. 25.

As shown in at least FIG. 29, the exercise machine 102 may also include one or more rotary controls 144, 146 configured to receive input from the user 106. The exercise machine 102 may further include one or more sensors 147 configured to sense, detect, and/or otherwise determine one or more performance parameters of the user 106 before, during, and/or after the user 106 participates in an exercise class using the exercise machine 102. In any of the examples described herein, the rotary controls 144, 146 and the one or more sensors 147 may be operably and/or otherwise connected to one or more controllers, processors, and/or other digital hardware 148 of the exercise machine 102.

The digital hardware 148 associated with the exercise machine 102 may be connected to or integrated with the exercise machine 102, or it may be located remotely and wired or wirelessly connected to the exercise machine 102. The digital hardware 148 may include digital storage, one or more processors or other like computers or controllers, communications hardware, software, and/or one or more media input/output devices such as displays, cameras, microphones, keyboards, touchscreens, headsets, and/or audio speakers. In various exemplary embodiments these components may be connected to and/or otherwise integrated with the exercise machine 102. All communications between and among such components of the digital hardware 148 may be multichannel, multi-directional, and wireless or wired, using any appropriate protocol or technology. In various exemplary embodiments, the digital hardware 148 of the exercise machine 102 may include associated mobile and web-based application programs that provide access to account, performance, and other relevant information to users from local or remote exercise machines, processors, controllers, personal computers, laptops, mobile devices, or any other digital device or digital hardware. In any of the examples described herein, the one or more controllers, processors, and/or other digital hardware 148 associated with the exercise machine 102 may be operable to perform one or more functions associated with control logic 150 of the exercise machine 102. Such control logic 150 is illustrated schematically in at least FIG. 30, and such control logic 150 may comprise one or more rules, programs, or other instructions stored in a memory of the digital hardware 148. For example, one or more processors included in the digital hardware 148 may be programmed to perform operations in accordance with rules, programs, or other instructions of the control logic 150, and such processors may also be programmed to perform one or more additional operations in accordance with and/or at least partly in response to input received via one or more of the rotary controls 144, 146 and/or via one or more of the sensors 147.

Figure 31:
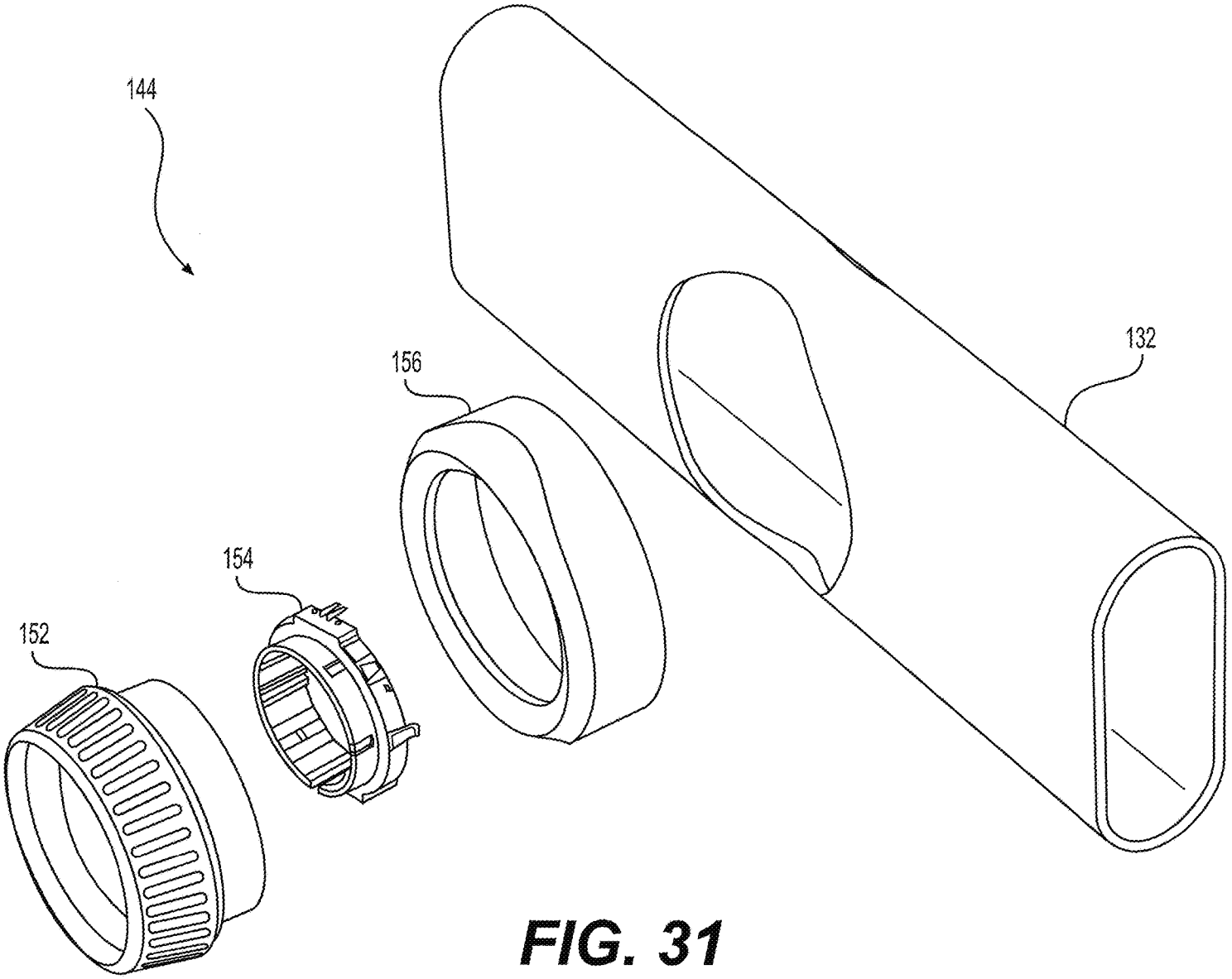
FIG. 31 illustrates an exploded view of a rotary control associated with the example exercise machine shown in FIG. 25.
Figure 32:
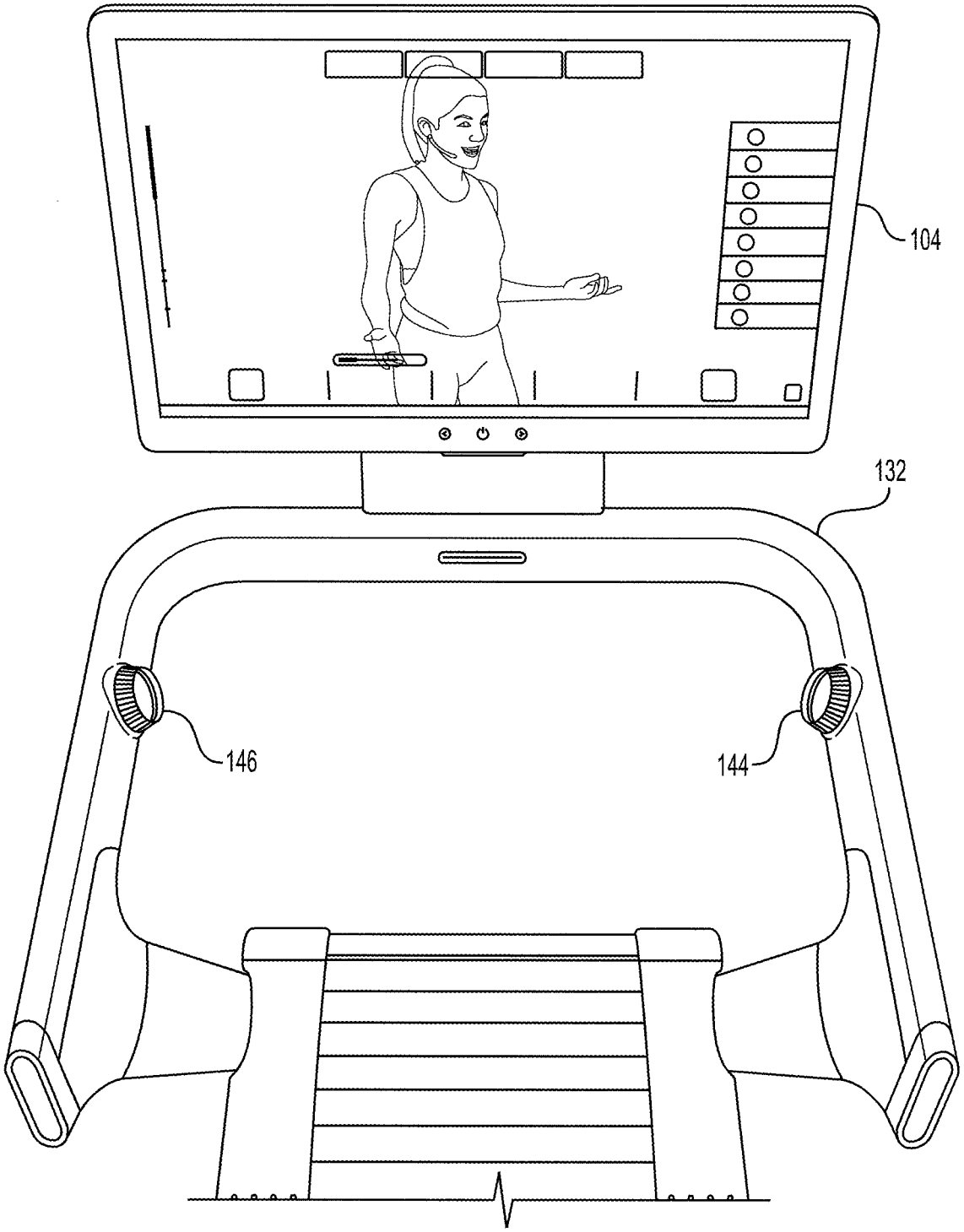
FIG. 32 illustrates another view of the example exercise machine shown in FIG. 25 including first and second rotary controls.

As shown in FIGS. 31 and 32, one or more such rotary controls 144, 146 may comprise an infinity wheel-type control 144. Such a rotary control 144 may be useful in changing and/or otherwise controlling, for example, the incline, decline, and/or other position of the deck 112 relative to the support surface on which the exercise machine 102 is disposed, the speed of the belt 120 (e.g., the rotational speed of the continuous track 122, slats 126, and/or other components of the belt 120), the substantially instantaneous starting and/or stopping of the belt 120, selection of one or more exercise classes to be played via the display 104, changing one or more operating modes of the exercise machine 102, and/or other functions of the exercise machine 102. In an example embodiment, such a rotary control 144 may include an outer portion 152 (e.g., a rotary dial, knob, button, or other component) that is rotatable relative to the post 130, crossbar 132, and/or other component of the exercise machine 102 to which the rotary control 144 is connected. The rotary control 144 may further include a frame 154 (e.g., an encoder or other stationary component) to which the outer portion 152 is connected. In such examples, the frame 154 (e.g., the encoder or other component connected to and/or associated with the frame 154) may include one or more detents or other components/structures that may be tuned for a desired incremental change in a corresponding functionality of the exercise machine 102. For example, the frame 154 may be configured such that each detent thereof may correlate to a 0.5% increase or decrease in an incline angle of the deck 112. Alternatively, the frame 154 may be configured such that each detent thereof may correlate to a 0.1 mph increase or decrease in a speed of the continuous track 122 and/or other component of the belt 120. In still further examples, percentages, speeds, and/or other increments greater than or less than those noted above may be chosen. Additionally, one or more such rotary controls 144, 146 may include one or more additional buttons, wheels, touch pads, levers, knobs, capacitance sensors, switches, or other input devices configured to receive additional inputs from the user 106, and such additional input devices may provide the user 106 with finer control over the corresponding functionality of the exercise machine 102. One or more such rotary controls 144, 146 may also include a respective mount 156 configured to assist in connecting the rotary control 144, 146 to the post 130, crossbar 132, and/or other components of the exercise machine 102.

Figure 33:
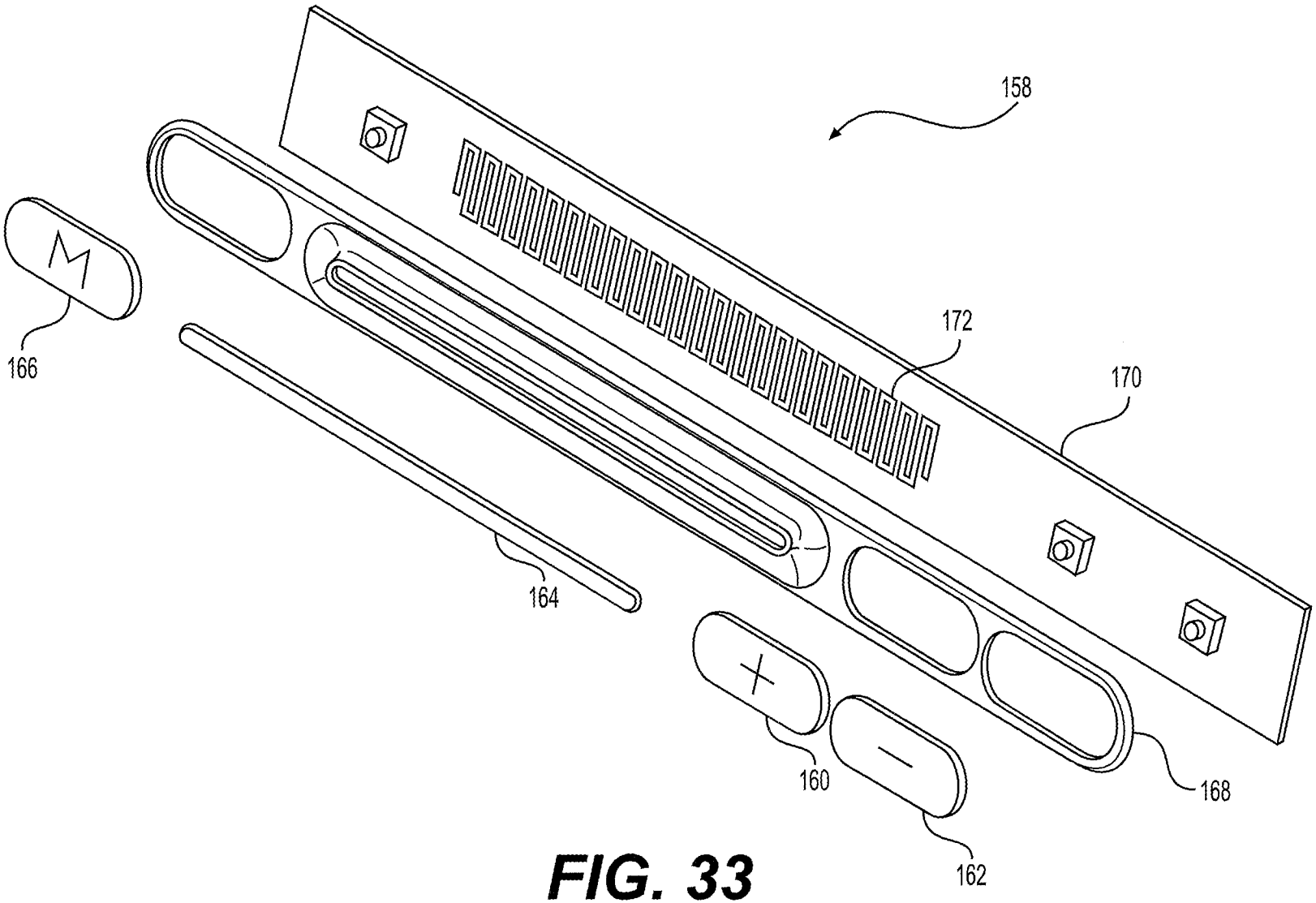
FIG. 33 illustrates an exploded view of a substantially linear control associated with the example exercise machine shown in FIG. 25.
Figure 34:
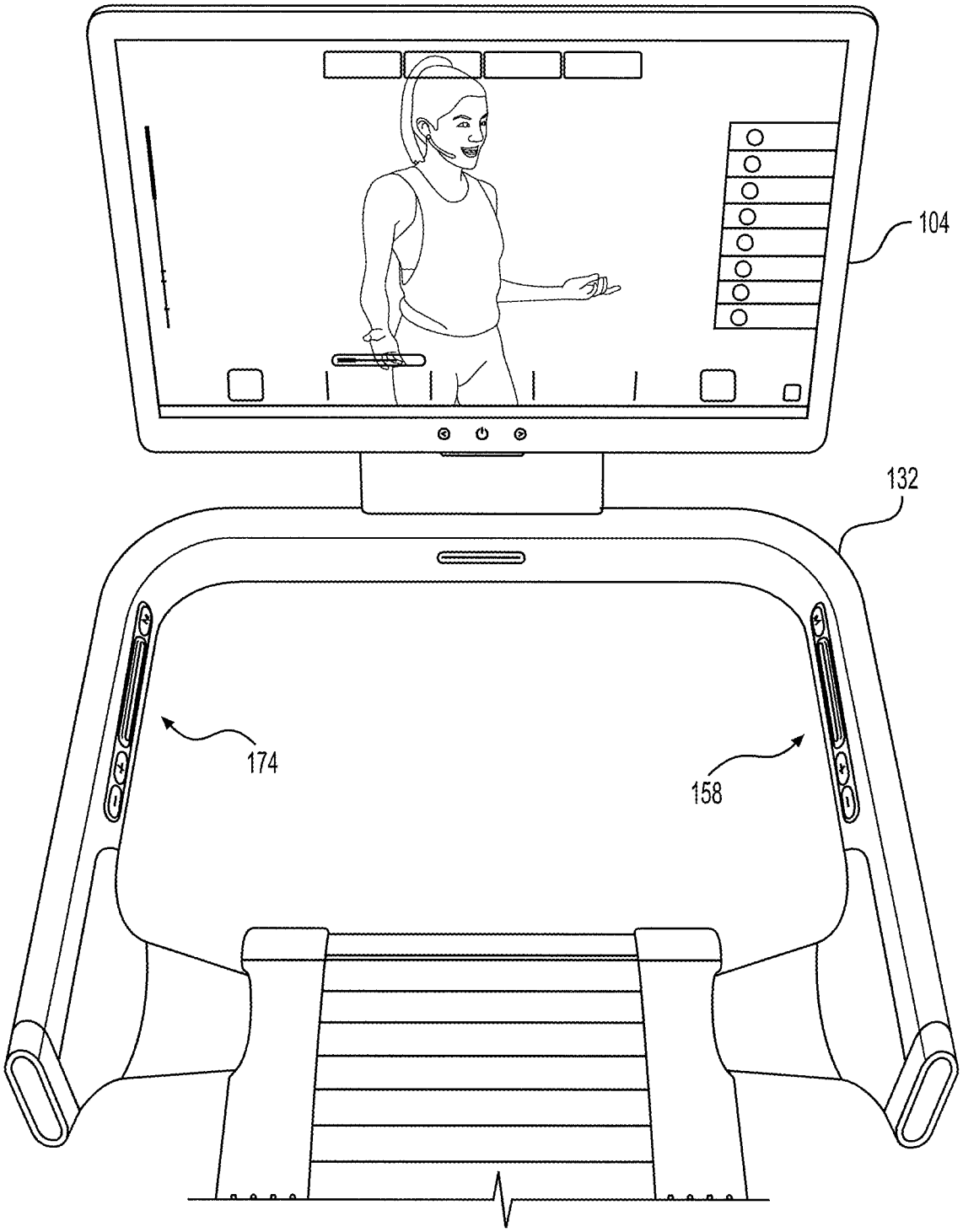
FIG. 34 illustrates another view of the example exercise machine shown in FIG. 25 including first and second substantially linear controls.
Figure 35:
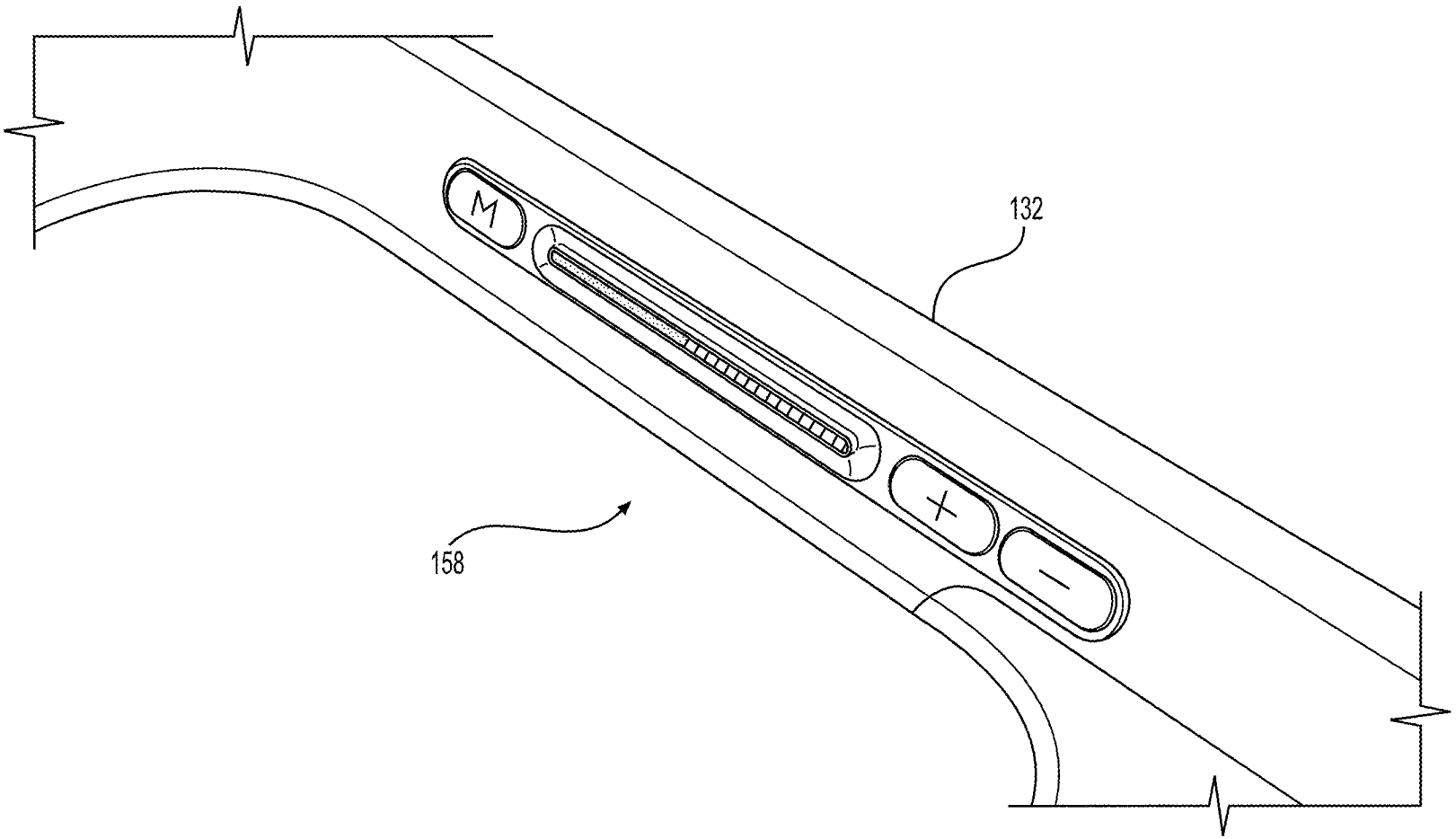
FIG. 35 illustrates a portion of the example exercise machine shown in FIG. 25 including a substantially linear control.

As shown in FIGS. 33-35, in still further embodiments one or more of the infinity wheel-type rotary controls 144, 146, 526, 528 described herein may be replaced with a capacitive slider-type control and/or other substantially linear control 158. Such controls 158 may include one or more touch pads, buttons, levers, and/or other components 160, 162, 166 configured to receive a touch, tap, push, and/or other input from the user 106. Such components 160, 162, 166 may be operably connected to respective touch and/or tactile switches of the control 158 mounted to a printed circuit board 170 thereof. Such tactile switches may be configured to generate signals indicative of the input received via such components 160, 162, 166, and to direct such signals to the processor and/or other digital hardware 148 associated with the exercise machine 102. The controls 158 may also include one or more additional touch pads 164 having a substantially linear configuration. Such touch pads 164 may also be configured to receive a touch, tap, push, and/or other input from the user 106. Additionally, the touch pads 164 may be operably connected to a respective capacitive trace 172 of the control 158 mounted to the printed circuit board 170. In such examples, the capacitive trace 172 may be configured to generate signals indicative of the input received via the touch pad 164 and to direct such signals to the processor and/or other digital hardware 148 associated with the exercise machine 102. FIG. 34 illustrates a first substantially linear control 158 disposed on the right-hand side of the crossbar 132, and a second substantially linear control 174 disposed on the left-hand side of the crossbar 132 opposite the control 158. In any of the examples described herein, one or more of the components 160, 162, 166 may be operable to control and/or change operating modes of the exercise machine 102. Additionally, in any of the examples described herein, one or more of the infinity wheel-type rotary controls 144, 146, 526, 528 and/or one or more of the substantially linear controls 158, 174 may include light emitting diodes and/or other lighting indicating a change in operation that is affected by the respective control.

With continued reference to at least FIG. 29, in various exemplary embodiments, the sensors 147 of the exercise machine 102 may be configured to sense, detect, measure, and/or otherwise determine a range of performance metrics from both the exercise machine 102 and the user 106, instantaneously and/or over time. For example, the exercise machine 102 may include one or more sensors 147 that measure the incline of the deck 112, the speed of the belt 120, a load applied to the deck 112, the belt 120, one or more of the motors 114, 118, and/or other components of the exercise machine 102, an amount of energy expended by the user 106, a power output of the exercise machine 102, user weight, steps, distance, total work, repetitions, an amount of resistance applied to the belt 120 by one or more of the motors 114, 118 and/or other components of the exercise machine 102, as well as any other suitable performance metric associated with, for example, a treadmill. The exercise machine 102 may also include sensors 147 to measure user heart-rate, respiration, hydration, calorie burn, or any other physical performance metrics, or to receive such data from sensors provided by the user 106. Where appropriate, such performance metrics can be calculated as current/instantaneous values, maximum, minimum, average, or total over time, or using any other statistical analysis. Trends can also be determined, stored, and displayed to the user, the instructor, and/or other users. Such sensors 147 may communicate with memory and/or processors of the digital hardware 148 associated with the exercise machine 102, nearby, or at a remote location, using wired or wireless connections.

Figure 6:
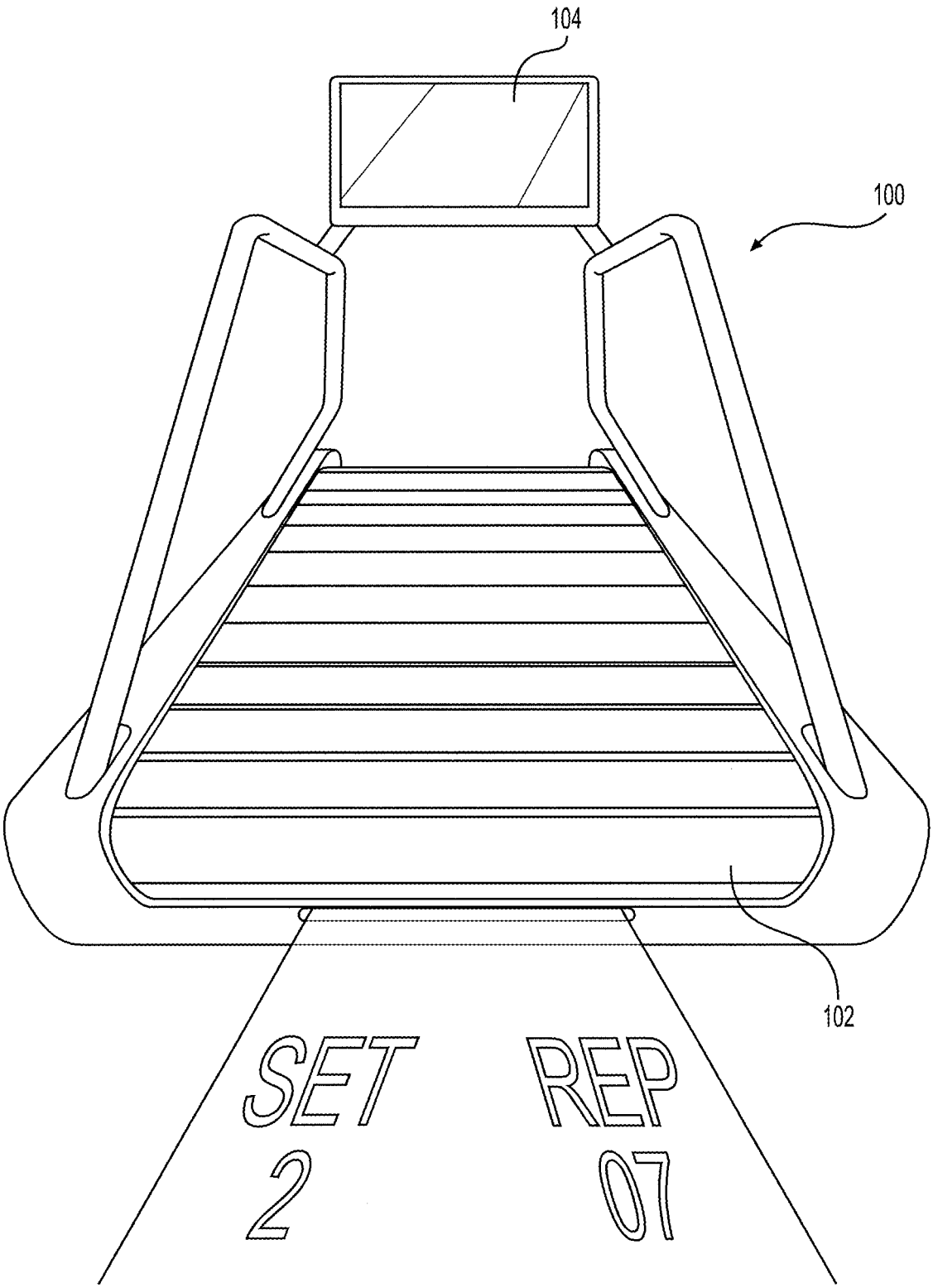
FIG. 6 is a rear view of yet another exemplary exercise machine as disclosed herein.
Figure 7:
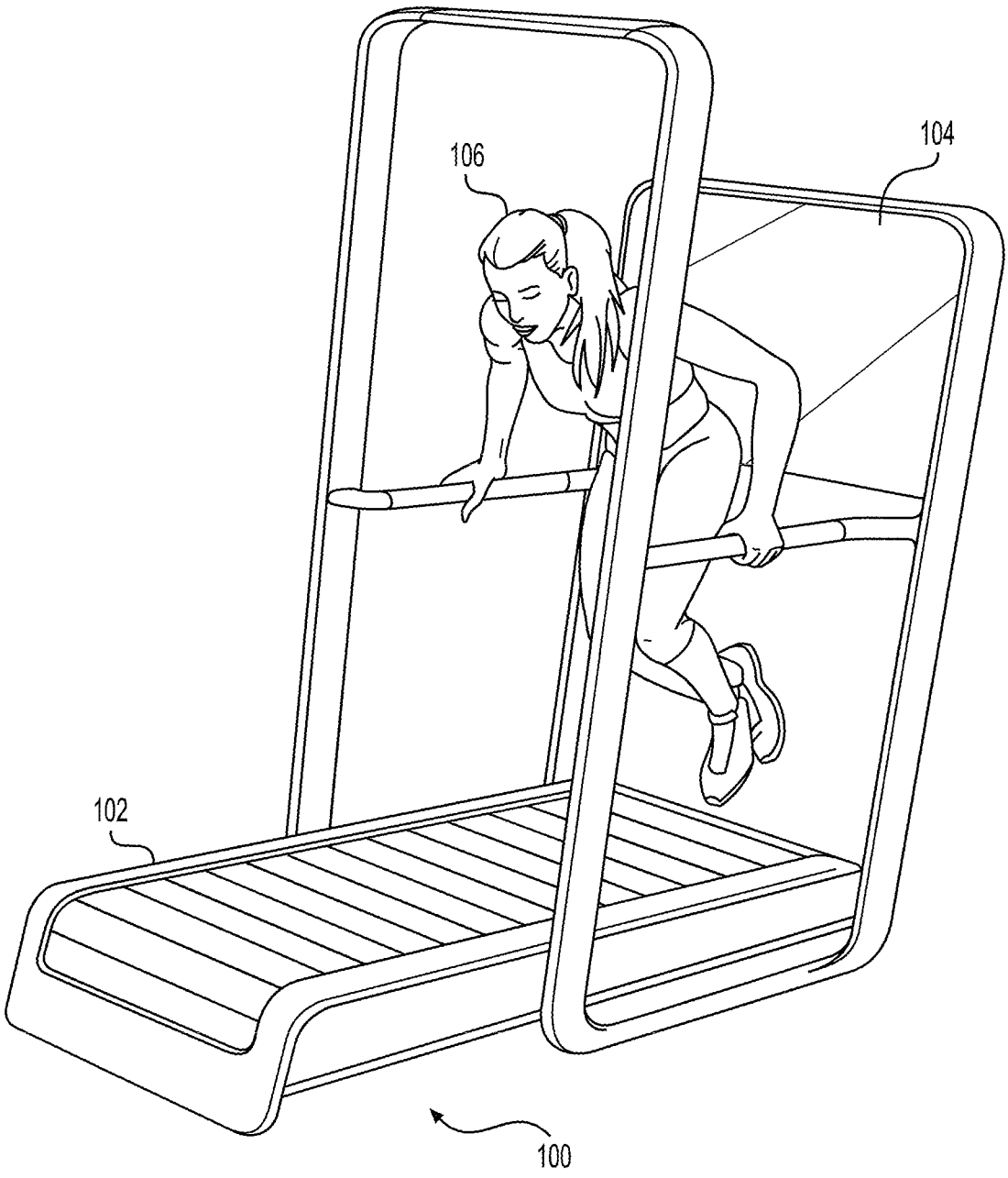
FIG. 7 is a rear perspective view of still another exemplary exercise machine as disclosed herein with a user shown.

In various exemplary embodiments, the exercise machine 102 may also be provided with one or more indicators to provide information to the user 106. Such indicators may include lights, projected displays, speakers for audio outputs, or other output devices capable of providing a signal to a user 106 to provide the user 106 with information such as timing for performing an exercise, time to start or stop exercise, or other informational indicators. For example, as illustrated in FIG. 6, such indicators (e.g., lights or projected displays) could display information regarding the number of sets and repetitions performed by the user 106 at a location where it can be seen by the user 106 during the performance of the relevant exercise.

Figure 36:
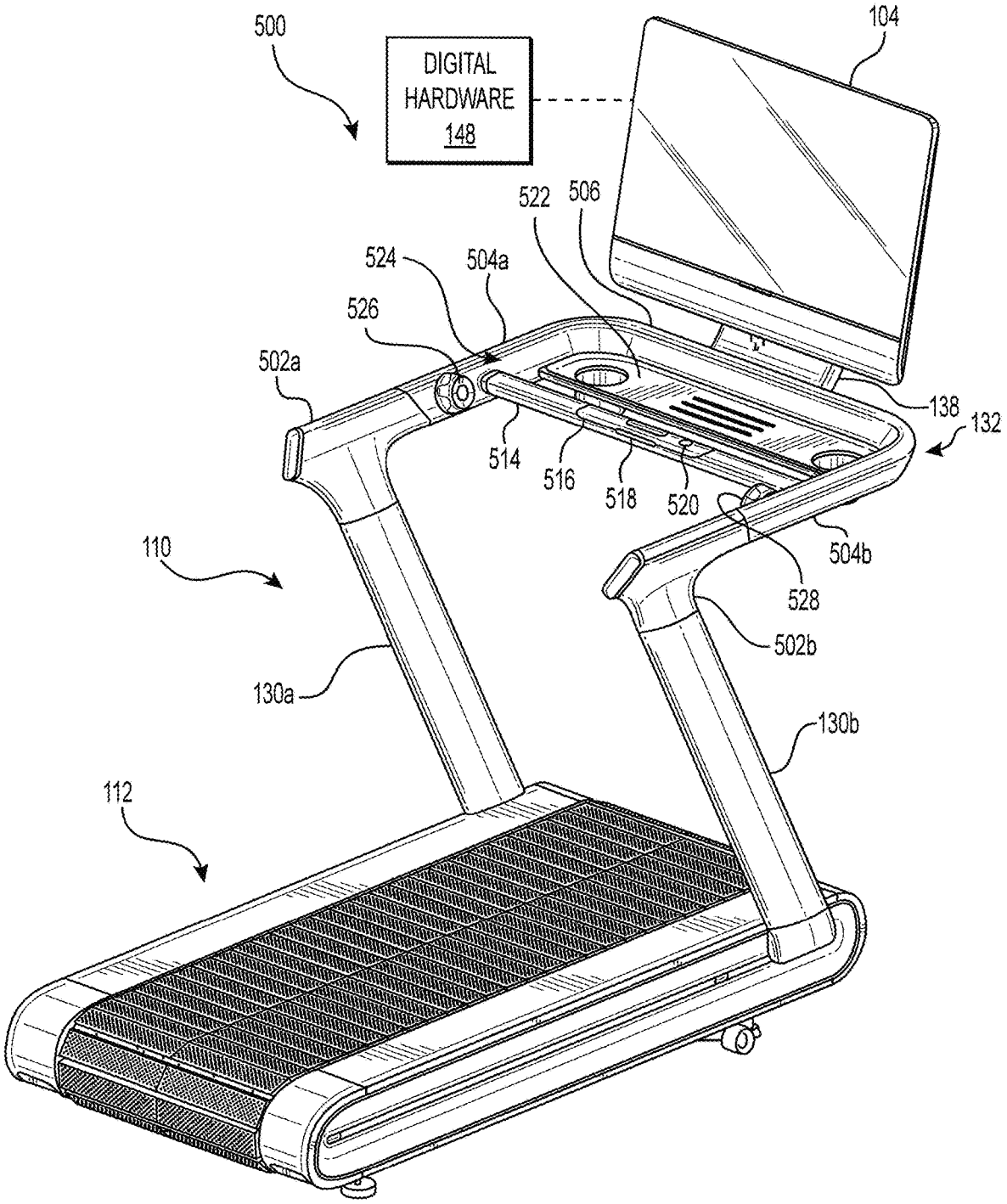
FIG. 36 provides an isometric view of an example exercise machine according to another embodiment of the present disclosure.
Figure 37:
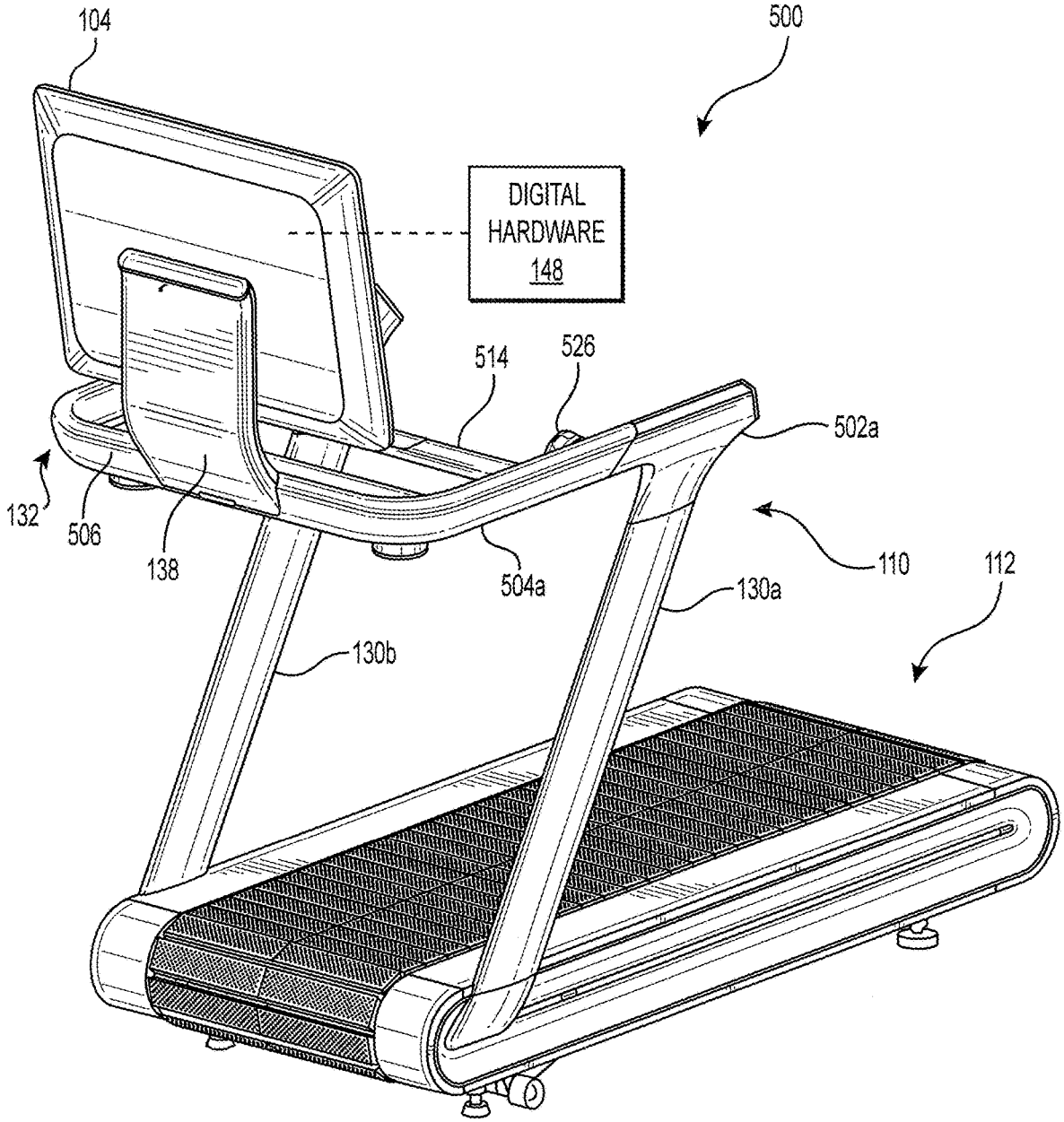
FIG. 37 provides another isometric view of the example exercise machine shown in FIG. 36.
Figure 38:
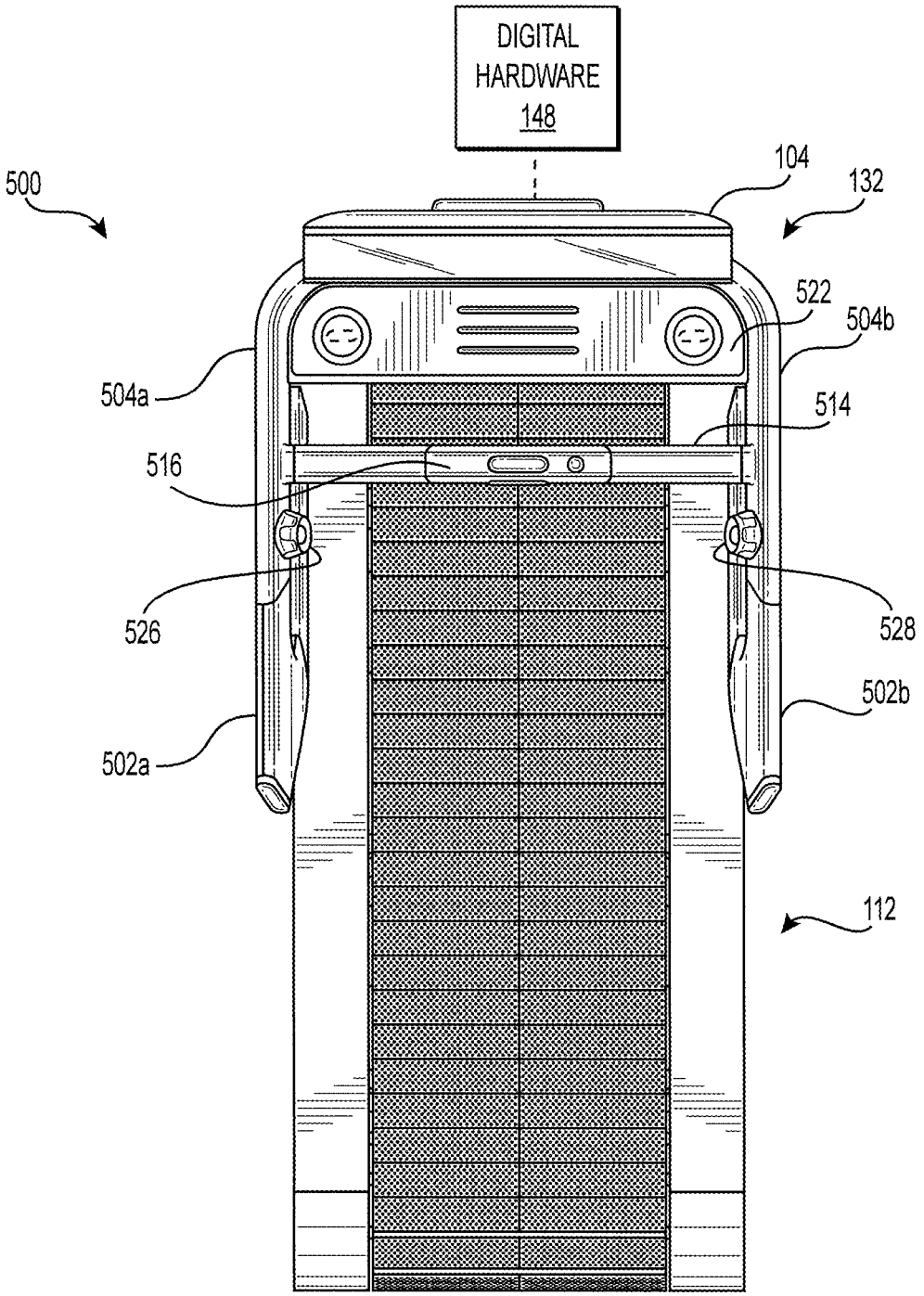
FIG. 38 provides a top view of the example exercise machine shown in FIG. 36.

FIGS. 36-38 illustrate an example exercise machine 500 (e.g., a "treadmill" 500) according to another embodiment of the present disclosure. Various components of the example exercise machine 500 may be substantially similar to and/or the same as corresponding components of the exercise machines 102 described herein, and in some instances, like item numerals will be used below to describe like parts. For example, as shown in FIGS. 36-38 an exercise machine 500 may include a display 104, a deck 112, a crossbar 132, a bracket 138 connecting the display 104 to the crossbar 132, a controller and/or other digital hardware 148, and/or other components, and such components may be similar to and/or the same as the corresponding components of the exercise machine 102 described above having like item numerals. Additionally, similar to the upper assembly 110 described above, an upper assembly 110 of the exercise machine 500 may include a first post 130*a* connected to and/or extending from the deck 112, and a second post 130*b* connected to and/or extending from the deck 112 opposite the first post 130*a*.

The upper assembly 110 of the exercise machine 500 may also include an endcap 502*a* connected to or formed integrally with the post 130*a*, and an endcap 502*b* connected to or formed integrally with the post 130*b*. In such examples the endcaps 502*a*, 502*b* may be configured to connect arms 504*a*, 504*b* of the upper assembly 110 to corresponding posts 130*a*, 130*b*. For example, the endcap 502*a* may connect the arm 504*a* to the post 130*a* such that the arm 504*a* is supported, at least in part, by the post 130*a*, and the endcap 502*b* may connect the arm 504*b* to the post 130*b* such that the arm 504*b* is supported, at least in part, by the post 130*b*. It is understood that in some examples, the endcap 502*a* may be connected to or formed integrally with the arm 504*a*, and the endcap 502*b* may be connected to or formed integrally with the arm 504*b*. In some examples, the endcaps 502*a*, 502*b* may be substantially similar to and/or the same as the brackets 134 described above with respect to FIG. 26. In such examples, the endcaps 502*a*, 502*b* may include one or more additional components (e.g., caps) substantially similar to and/or the same as the endcaps 136 described above.

Further, in any of the examples described herein the upper assembly 110 may include one or more crossbars extending from the arm 504*a* to the arm 504*b*. For example, the crossbar 132 described above may comprise a crossbar 506 (e.g., a first crossbar 506) extending from the arm 504*a* to the arm 504*b*, and a crossbar 514 (e.g., a second crossbar 514) opposite the crossbar 506 and extending from the arm 504*a* to the arm 504*b*. In such examples, one or both of the crossbars 506, 514, one or both of the arms 504*a*, 504*b*, one or both of the endcaps 502*a*, 502*b*, and/or other components of the exercise machine 500 may comprise handles, armrests, and/or other components configured to at least partly support the user 106 of the exercise machine 500 as the user 106 walks, runs, and/or otherwise participates in an exercise class using the exercise machine 500.

The posts 130*a*, 130*b*, endcaps 502*a*, 502*b*, arms 504*a*, 504*b*, crossbars 506, 514, and/or other components of the exercise machine 500 may be made from steel, aluminum, cast iron, and/or any other metal, polymer, alloy, or other material, and such materials may be similar to and/or the same as the materials described above with respect to one or more components of the deck 112. Further, in some embodiments one or more such components may be connected via one or more bolts, screws, clips, brackets, solder joints, and/or other means. In other embodiments, on the other hand, one or more such components may be integrally formed and/or may otherwise have a one-piece construction. For example, at least the arm 504*a*, arm 504*b*, and crossbar 506 may have a one-piece construction. In such examples, the crossbar 514 may be welded, soldered, forged, cast, and/or otherwise connected to the arm 504*a* and the arm 504*b*. In further examples, at least the arm 504*a*, arm 504*b*, crossbar 506, and crossbar 514 may be integrally formed and/or may otherwise have a one-piece construction. In further embodiments, the endcap 502*a* may be forged, cast, and/or otherwise integrally formed with either the post 130*a* or the arm 504*a*. Likewise, in further embodiments the endcap 502*b* may be forged, cast, and/or otherwise integrally formed with either the post 130*b* or the arm 504*b*.

As shown in FIGS. 36-38, the exercise machine 500 may also include one or more controls associated with the upper assembly 110, and one or more such controls may be connected to the arm 504*a*, arm 504*b*, crossbar 506, and/or crossbar 514. For example, the exercise machine 500 may include a control 516 connected to the crossbar 514, the crossbar 506, the arm 504*a*, or the arm 504*b*. Such a control 516 may include, for example, one or more magnetic connectors 518 configured to receive an emergency stop switch, clip, cord, belt, and/or other device worn by the user 106 as the user 106 is walking, and/or running on the exercise machine 500. For example, the user 106 may use an emergency stop device (not shown) that may be clipped onto the user's clothing, held by the user 106, wrapped about the user's wrist, and/or otherwise worn by the user 106 while the user 106 is walking or running on the exercise machine 500. Such an emergency stop device may include a cord of a given length, and a magnetic clip or other component disposed at the end of the cord. The magnetic clip at the end of the cord may be disposed on and/or at least partly within the magnetic connector 518 of the control 516 during use of the exercise machine 500. In such examples, the exercise machine 500 may be configured such that the belt 120 of the deck 112 may only rotate while the magnetic clip at the end of the cord is disposed on and/or at least partly within the magnetic connector 518. Additionally, removal of the magnetic clip from the magnetic connector 518 may cause the belt 120 to stop. In such examples, the magnetic connector 518, together with such a magnetic clip worn by the user 106 may comprise an emergency stop device of the exercise machine 500. For example, causing the belt 120 to stop at least partly in response to removal of the magnetic clip from the magnetic connector 518 may prevent injury to the user 106 in situations in which the user 106 is located greater than a desired distance from the crossbar 514 (e.g., greater than a distance defined by the length of the cord worn by the user 106).

In any of the examples described herein, the control 516 may also include one or more input devices 520 configured to receive an input from the user 106 during use of the exercise machine 500. In such examples, one or more such input devices 520 may comprise a button, wheel, touch pad, lever, knob, capacitance sensor, switch, or other component configured to receive an input from the user 106, and such input devices 520 may be configured to control and/or may enable the user 106 to control a corresponding function of the exercise machine 500.

As show in FIGS. 36-38, in some examples the exercise machine 500 may also include one or more trays 522 configured to hold, for example, a water bottle, an MP3 player, a mobile device, a magazine, a towel, and/or other the items that the user 106 may utilize while exercising on the exercise machine 500. In some examples, the tray 522 may be fixedly connected to at least one of the crossbar 506, the arm 504*a*, the arm 504*b*, or the crossbar 514. In other examples, on the other hand, the tray 522 may be removably attached to one or more such components of the exercise machine 500. For example, the tray 522 may be at least partially disposed within a gap 524 separating the crossbar 506 from the crossbar 514. In such examples, at least one of the crossbar 506, the arm 504*a*, the arm 504*b*, or the crossbar 514 may include a ridge, ledge, shelf, lip, flange, extension, clip, and/or other structure configured to at least partly support the tray 522 when the tray 522 is disposed at least partly within the gap 524.

The exercise machine 500 may also include one or more rotary controls 526, 528 configured to control respective functions of the exercise machine 500 and/or one or more of the motors 114, 118 thereof, during use. Such rotary controls 526, 528 may be substantially similar to and/or the same as one or more of the rotary controls 144, 146 described above with respect to FIGS. 29, 31, and 32, and one or more of the rotary controls 526, 528 may be configured to control similar and/or the same functions of the exercise machine 500 and/or one or more of the motors 114, 118 described above with respect to the rotary controls 144, 146. As shown in at least FIG. 36, the arm 504*a* may include a rotary control 526 attached thereto, and the arm 504*b* may include a rotary control 528 attached thereto. In such examples, the rotary control 526 may be separate from the rotary control 528. Further, the rotary control 526 may be configured to control a first function of the exercise machine 500, and the rotary control 528 may be configured to control a second function of the exercise machine 500 different from the first function associated with rotary control 526. In some examples, the first function of the exercise machine 500 may comprise a first function and/or operation of one of the motors 114, 118. Similarly, the second function of the exercise machine 500 may comprise a second function and/or operation of the other of the motors 114, 118. In additional examples, one or both of the rotary controls 528 may be configured to control respective functions of the exercise machine 500 associated with the display 104, the digital hardware 148, and/or other components of the exercise machine different from the motors 114, 118. Additionally, in further examples one or both of the rotary controls 526, 528 may be disposed on the crossbar 514, the crossbar 506, and/or other portions of the exercise machine 500. Further, one or both of the rotary controls 526, 528 may be disposed on the arm 504*a*, the arm 504*b*, the post 130*a*, or the post 130*b*.

Figure 39:
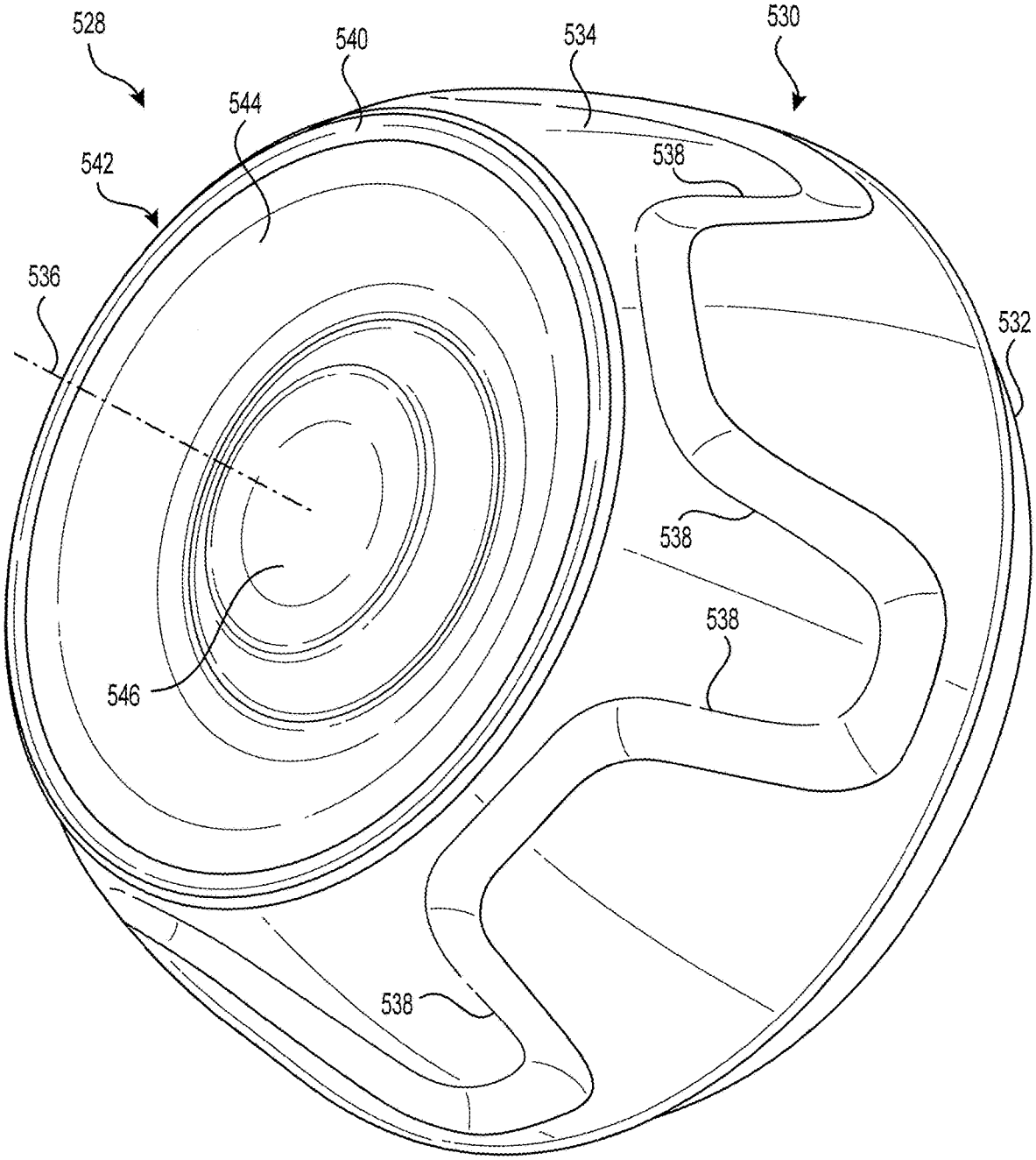
FIG. 39 provides an isometric view of an example rotary control associated with the exercise machine shown in FIG. 36.
Figure 40:
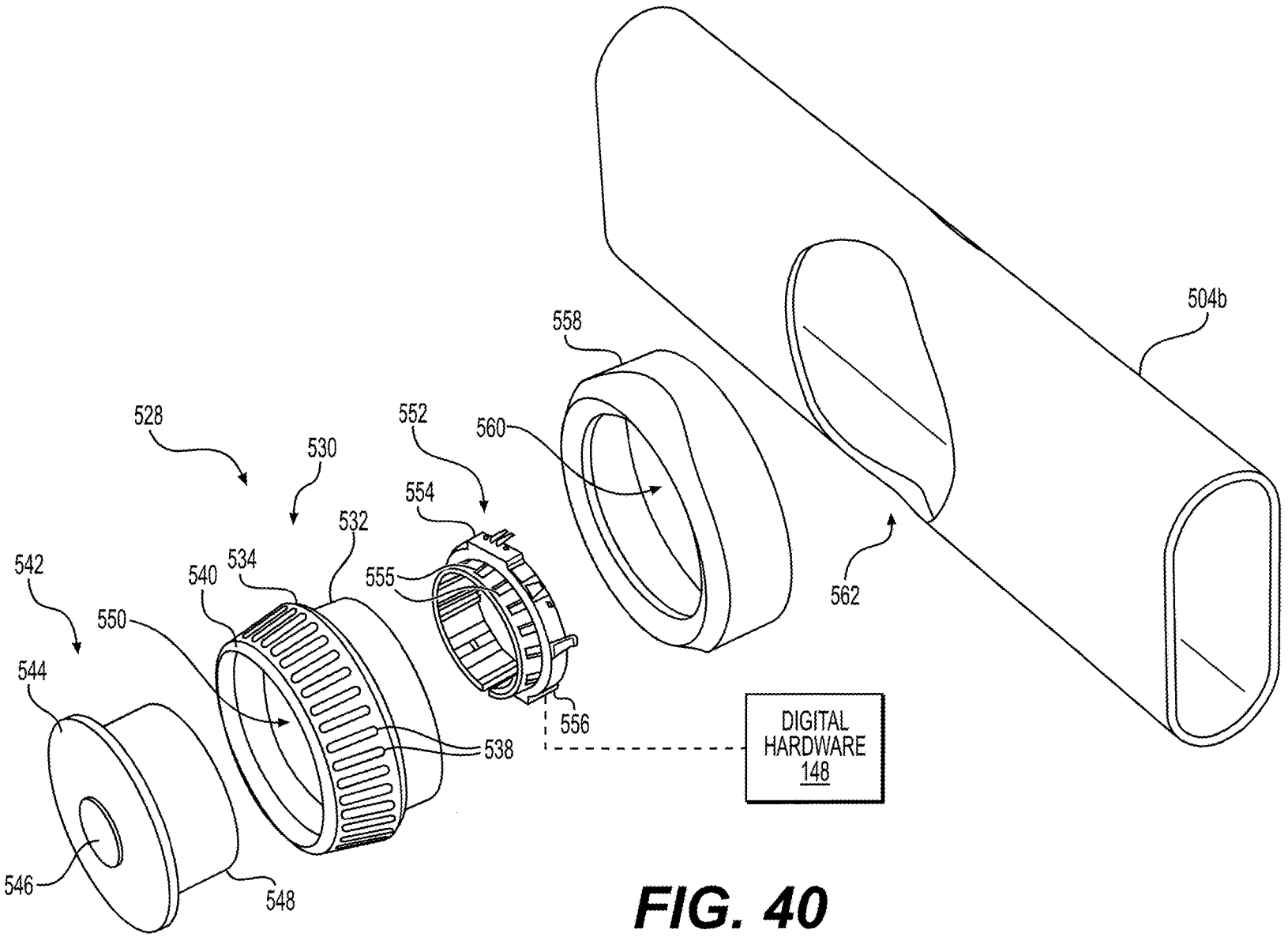
FIG. 40 provides an exploded view of the example rotary control shown in FIG. 39.

FIGS. 39 and 40 illustrate an example rotary control 528 in further detail. It is understood that in some examples the rotary control 528 may be substantially similar to and/or the same as the rotary control 526. Alternatively, in some examples, the rotary control 528 may be different from and/or may include one or more components different from respective components of the rotary control 526. For ease of description, the rotary control 528 will be described for the remainder of the present disclosure unless otherwise specified, and any description of the rotary control 528 shall also apply to the rotary control 526 unless otherwise noted.

As shown in FIGS. 39 and 40, the rotary control 528 may include an outer portion 530, and the outer portion 530 may include a base 532 and a top 534. In such examples, the outer portion 530 may be substantially similar to and/or the same as the outer portion 152 described above with respect to FIG. 31. The top 534 of the outer portion 530 may comprise a substantially cylindrical, substantially semi-circular, or substantially dome-shaped housing of the rotary control 528. Further, the base 532 may comprise a substantially cylindrical stem, housing, and/or other such structure extending from the top 534. The outer portion 530 may comprise a substantially one-piece component of the rotary control 528 and, in such examples, the base 532 may be formed integrally with the top 534. Alternatively, the base 532 may be molded, soldered, heat-sealed, clipped, press fit, and/or otherwise connected to the top 534. In some examples, the rotary control 528 may include a central axis (e.g., a central longitudinal axis) 536 extending substantially centrally through the outer portion 530. In such examples, at least a portion of the rotary control 528 may be rotatable about the central axis 536. For example, the outer portion (e.g., the top 534 and/or the base 532) may be rotatable about the central axis 536 during use. It is understood that, in some examples, at least the outer portion 530 may be rotatable about the central axis 536 relative to the arm 504*b* to which the rotary control 528 is connected. Additionally, the outer portion 530 may include one or more ridges, dimples, indentations, grooves, protuberances, patterns, and/or other grips 538. For example, one or more such grips 538 may be disposed on and/or formed by the top 534 to assist the user 106 in rotating the outer portion 530 about the central axis 536. FIG. 39 illustrates a first example configuration of such grips 538, while FIG. 40 illustrates a second example configuration of such grips 538. It is understood that the grips 538 are not limited to the configurations illustrated in either FIG. 39 or FIG. 40, and in further examples, the grips 538 may have any other shape, size, orientation, or other configuration useful in enhancing the ability of the user 106 to rotate the outer portion 530 during use of the exercise machine 500.

In some examples, the rotary control 528 may also include one or more components configured to provide tactile, audible, visual, and/or other feedback to the user 106 as the user rotates at least a portion of the rotary control 528 relative to the arm 504*b* to which the rotary control 528 is connected. In any example embodiment of the present disclosure, two or more such components of the rotary control 528 may provide feedback to the user 106 substantially simultaneously during use of the exercise machine 500. In such examples, the feedback substantially simultaneously received from two or more such components of the rotary control 528 may be indicative of the same operating characteristic of the rotary control 528 (e.g., a degree to which the outer portion 530 has been rotated by the user 106).

For example, the rotary control 528 may include a first component configured to provide visible feedback to the user 106 as the user 106 rotates the outer portion 530 and/or other portions of the rotary control 528 about the central axis 536. In such examples, such a first component may comprise an indicator 540 disposed on, connected to, and/or otherwise associated with the top 534. In other embodiments, on the other hand, the indicator 540 may be located radially inward of the top 534. The indicator number 540 may comprise one or more light emitting diodes (LEDs) and/or other light sources disposed, for example, about or proximate a perimeter of the top 534. In such examples, the indicator 540 may be configured such that rotation of the rotary control 528 results in commensurate temporary illumination of at least part of the indicator 540. For example, the indicator 540 may be configured such that rotation of the top 534 about the central axis 536 may cause commensurate temporary illumination of at least part of the indicator 540, and the extent to which the indicator 540 is illuminated may indicate the degree to which the outer portion 530 has been rotated by the user 106. In such examples, the rotary control 528 may have a zero or start position. In such an embodiment, rotation of the outer portion 530 about the central axis 536 from the start position clockwise or counterclockwise, for example, approximately 90 radial degrees may cause illumination of approximately one quarter of the indicator 540. Similarly, rotation of the outer portion 530 about the central axis 536 from the start position clockwise or counterclockwise, for example, approximately 180 radial degrees may cause illumination of approximately one half of the indicator 540. In further examples, rotation of the outer portion 530 about the central axis 536 any desired number of radial degrees may cause illumination of a corresponding portion of the indicator 540. Such illumination may correlate to an increase or decrease in an incline angle of the deck 112. Alternatively, such illumination may correlate to an increase or decrease in a speed of the continuous track 122 and/or other component of the belt 120. In any such examples, such illumination (e.g., the amount of visual feedback) may indicate to the user 106 the extent to which the top 534 and/or other components of the outer portion 530 have been rotated. In some examples, such illumination may include pulsing, blinking, changes in color, substantially constant illumination, and/or other illumination modalities.

Further, in some examples the rotary control 528 may include one or more additional components configured to provide tactile feedback to the user 106 as the user 106 rotates the top 534 and/or other components of the outer portion 530 about the central axis 536. As shown in at least FIG. 40, such an additional component may comprise a detent 555 configured to at least partly restrict rotation of the outer portion 530 about the central axis 536. For example, one or more detents 555 may provide partial resistance to the top 534, base 532, and/or other components of the outer portion 530 as the outer portion 530 is rotated about the central axis 536. In such examples, the base 532 and/or other components of the outer portion 530 may be configured to contact one or more such detents 555 as the outer portion 530 is rotated about the central axis 536. For example, the rotary control 528 may include a carrier 552 that includes one or more such detents 555. In such examples, the carrier 552 may include a substantially rigid frame 554, and the one or more detents 555 described above may be disposed on and/or formed by the frame 554. In such examples, the base 532 and/or the top 534 may be rotatably connected to the frame 554.

As noted above, one or more of the detents 555 may be positioned, sized, and/or otherwise configured to coincide with a desired incremental change in a corresponding function of the exercise machine 500. For example, the frame 554 may be configured such that each detent 555 thereof may correlate to a 0.5% increase or decrease in an incline angle of the deck 112. Alternatively, the frame 554 may be configured such that each detent 555 thereof may correlate to a 0.1 mph increase or decrease in a speed of the continuous track 122 and/or other component of the belt 120. In still further examples, percentages, speeds, and/or other increments greater than or less than those noted above may be chosen.

Further, in any of the examples described herein, control software and/or the digital hardware 148 described above may be configured such that rotation of the outer portion 530 about the central axis 536 may cause any desired outcome associated with the exercise machine 500. For example, while in some embodiments rotation of the outer portion 530 in a forward direction (e.g., counterclockwise) may cause the motor 114 to increase an incline of (e.g., raise) the deck 112 relative to a support surface on which the exercise machine 500 is disposed, in further examples, control software and/or digital hardware 148 of the exercise machine 500 may be programmed and/or otherwise configured such that rotation of the outer portion 530 in a rearward (e.g., clockwise) direction may cause the motor 114 to increase the incline of the deck 112 relative to the support surface. Further, while in some embodiments rotation of the outer portion 530 in a forward direction (e.g., counterclockwise) may cause the motor 118 to increase a speed of rotation of the belt 120, in further examples, control software and/or digital hardware 148 of the exercise machine 500 may be programmed and/or otherwise configured such that rotation of the outer portion 530 in a rearward (e.g., clockwise) direction may cause the motor 118 to increase the speed of rotation of the belt 120.

Moreover, in example embodiments control software and/or digital hardware 148 of the exercise machine 500 may be programmed and/or otherwise configured such that rotation of the outer portion 530 may control one or more functions of the display 104 or other components of the machine 500 different from the motors 114, 118. For example, control software and/or digital hardware 148 of the exercise machine 500 may be programmed and/or otherwise configured such that rotation of the outer portion 530 in either a forward or rearward direction may cause the display 104 to display a button, icon, control, text, or other content. In further examples, rotation of the outer portion 530 in either a forward or rearward direction to a zero position of the rotary control 528 may cause the display 104, control software, and/or digital hardware 148 of the exercise machine 500 to pause an exercise class that is currently playing or being displayed on the display 104. In additional examples, rotation of the outer portion 530 may cause a beep, chirp, and/or other audible tone to be emitted from one or more speakers of the exercise machine 500. In some examples, each time the outer portion 530 interfaces with a detent 555 of the frame 554, the control software and/or digital hardware 148 of the exercise machine 500 may cause the one or more speakers to emit an audible tone. Such an audible tone may comprise further indicia (e.g., audible indicia) indicative of the rotation of the rotary control 528.

In still further examples, the speed at which the rotary control 528 is rotated by the user 106 may also dictate the extent, degree, speed, or magnitude of the change made to the operation/function of the exercise machine 500. For example, control software and/or digital hardware 148 of the exercise machine 500 may be programmed and/or otherwise configured such that rotation of the outer portion 530 in either a forward or rearward direction at a relatively slow speed may cause a correspondingly minimal or incremental change in the rotational speed of the belt 120 (e.g., a 0.1 mph increase or decrease in a speed of the continuous track 122 and/or other component of the belt 120). In such examples, control software and/or digital hardware 148 of the exercise machine 500 may also be programmed and/or otherwise configured such that rotation of the outer portion 530 in either a forward or rearward direction at a relatively fast speed may cause a correspondingly significant, rapid, and/or aggressive change in the rotational speed of the belt 120 (e.g., a 1.0 mph increase or decrease in the speed of the continuous track 122 and/or other component of the belt 120).

As shown in FIGS. 39 and 40, the rotary control 528 may also include an inner portion 542. In some examples, the inner portion 542 may be fixedly connected to the outer portion 530, and in such examples, the inner portion 542 may be rotatable with the outer portion 530 about the central axis 536 of the rotary control 528. In other examples, the inner portion 542 may be separate from the outer portion 530 such that at least, for example, the top 534 may be rotatable relative to the inner portion 542 about the central axis 536. In such examples, the inner portion 542 may be fixed relative to the top 534 as the top 534 is rotated about the central axis 536. The inner portion 542 may include a substantially disc-shaped plate 544 disposed substantially centrally within the top 534. In such examples, the central axis 536 may extend substantially centrally through the plate 544. Additionally, the plate 544 may be disposed radially inward of, for example, the indicator 540 and/or the top 534. In some examples the indicator 540 may be disposed on and/or otherwise connected to the plate 544, and in such examples, the top 534 and/or other components of the outer portion 530 may be rotatable relative to the plate 544 and the indicator 540.

The rotary control 528 may further include one or more input devices 546. For example, the rotary control 528 may include an input device 546 disposed substantially centrally relative to the plate 544. In some examples, the input device 546 may be disposed on and/or otherwise connected to the plate 544. In such examples, the top 534 and/or other components of the outer portion 530 may be rotatable relative to the input device 546. The input device 546 may comprise one or more buttons, wheels, touch pads, levers, knobs, capacitance sensors, switches, or other components configured to receive inputs from the user 106, and in such examples, the inputs received via the input device 546 may be different and/or separate from rotational input received from the user 106 via the top 534. In such examples, the input device 546 may be configured to control one or more functions of the exercise machine 500 different and/or separate from functions of the exercise machine 500 controlled via rotation of the top 534. For example, in embodiments in which rotation of the top 534 and/or other components of the outer portion 530 of the rotary control 528 may enable the user 106 to control a speed of rotation of the belt 120, a position of the deck 112, and/or other functions of the exercise machine 500, inputs received via the input device 546 may control one or more additional functions of the exercise machine 500 different from the speed of rotation of the belt 120, the position of the deck 112, etc. For example, in such embodiments an input received via the input device 546 may cause the belt 120 to begin rotating, may cause the belt 120 to stop rotating, may enable selection of one or more exercise classes, may enable selection of one or more modes of operation of the exercise machine 500, and/or may enable control of various other functions of the exercise machine 500.

As illustrated in the exploded view of FIG. 40, the inner portion 542 may further include a base 548 extending from the plate 544. For example, the plate 544 may comprise a substantially planar, substantially disc-shaped component of the inner portion 542, and the base 548 may comprise a substantially cylindrical component of the inner portion 542 extending substantially perpendicularly from the plate 544. In such examples, the outer portion 530 may comprise a substantially cylindrical component of the rotary control 528, and the outer portion 530 may include a substantially central opening 550 extending at least partly therethrough. In such examples, the central axis 536 may pass substantially centrally through the opening 550, and at least part of the base 548 may be disposed within the opening 550. Accordingly, in such examples the top 534 and/or other components of the outer portion 530 may be rotatable about and/or relative to the base 548 of the inner portion 542.

As noted above, the rotary control 528 may include a carrier 552 that includes one or more detents 555. In such examples, the carrier 552 may comprise a substantially rigid frame 554, and the one or more detents 555 described above may be disposed on and/or formed by an annular outer or inner surface of the frame 554. In such examples, the outer portion 530 of the rotary control 528 may be rotatably connected to the carrier 552 such that at least part of the base 532 and/or at least part of the top 534 may interface with one or more such detents 555 as the outer portion 530 rotates relative to the carrier 552. The carrier 552 may also include a printed circuit board (PCB) 556 connected thereto. In such examples, the PCB 556 may include one or more sensors (e.g., Hall effect sensors, proximity sensors, optical sensors, etc.), switches, controllers, microprocessors, and/or other components configured to determine a position (e.g., a radial angle or position) of the outer portion 530 relative to the carrier 552, and to provide one or more signals including information indicting such a position to a controller or other digital hardware 148 of the exercise machine 500. Such components of the PCB 556 may also be operably connected to the input device 546 of the rotary control 528. In such examples, such components of the PCB 556 may also be configured to receive signals from the input device 546 indicative of one or more inputs received via the input device 546, and may be configured to provide one or more corresponding signals to the controller or other digital hardware 148.

For example, one or more components of the PCB 556 may be configured to sense, detect, and/or otherwise determine rotation of the outer portion 530 of the rotary control 528, and such rotation of the outer portion 530 relative to the carrier 552 may cause one or more such components of the PCB 556 to transmit a corresponding signal to the controller or other digital hardware 148. Upon receipt of such a signal (e.g., a first signal), the controller or other digital hardware 148 may cause a corresponding change in the speed of rotation of the belt 120, change in the position (e.g., incline or decline) of the deck 12, and/or other change in functions of the exercise machine 500. Any such functions may comprise, for example, functions of the exercise machine 500 controlled by, performed by, and/or otherwise associated with at least one of the motors 114, 118. Similarly, receipt of one or more signals from the input device 546 may cause one or more components of the PCB 556 to transmit a corresponding signal to the controller or other digital hardware 148. Upon receipt of such a signal (e.g., a second signal), the controller or other digital hardware 148 may cause the belt 120 to begin rotating, may cause the belt 120 to stop rotating, may cause selection of one or more exercise classes, may enable one or more modes of operation of the exercise machine 500, and/or may enable control of various other functions of the exercise machine 500. Similarly, any such functions may comprise, for example, functions of the exercise machine 500 controlled by, performed by, and/or otherwise associated with at least one of the motors 114, 118. As shown in FIG. 40, in some examples at least part of the rotary control 528 may be connected to a stationary mount 558. For example, the mount 558 may comprise a substantially rigid frame, housing, and/or other structure connected to the arm 504*b* and/or other component of the exercise machine 500. In such examples, the mount 558 may be welded, soldered, bolted, screwed, clipped, and/or otherwise connected to the arm 504*b* so as to provide a substantially rigid stationary support for the rotary control 528 during use of the exercise machine 500. In some examples, the arm 504*b* may include one or more openings 562, and in such examples at least part of the mount 558 may engage, may be disposed within, and/or may pass through the opening 562 as the mount 558 is connected to the arm 504*b*. Alternatively, in additional embodiments the opening 562 may be omitted, and in such embodiments, the mount 558 may be fixedly connected to an outer surface of the arm 504*b*. The mount 558 may include one or more openings 560 extending at least partly therethrough. In some examples, the rotary control 528 may be connected to the mount 558 such that the central axis 536 of the rotary control 528 may pass substantially centrally through the opening 560 of the mount 558.

In any of the examples described herein, one or more components of the rotary control 528 may be connected to the mount 558 (e.g., at least partly within the opening 560 of the mount 558) so as to remain fixed relative to the mount 558 during rotation of the top 534, base 532, and/or other components of the outer portion 530. For example, the carrier 552 may be connected to the mount 558 such that the carrier 552 may remain fixed relative to the outer portion 530 and the mount 558 as the outer portion 530 is rotated relative to the mount 558. Likewise, the inner portion 542 may be connected to the carrier 552 and/or the mount 558 such that the inner portion 542 may remain fixed relative to the outer portion 530, the carrier 552, and the mount 558 as the outer portion 530 is rotated relative to the mount 558. Alternatively, in still further examples the mount 558 may be omitted. In such examples, the inner portion 542 and/or the carrier 552 may be connected to the arm 504*b* such that the inner portion 542 and the carrier 552 may remain fixed relative to the outer portion 530 as the outer portion 530 is rotated relative to the arm 504*b*.

Figure 42:
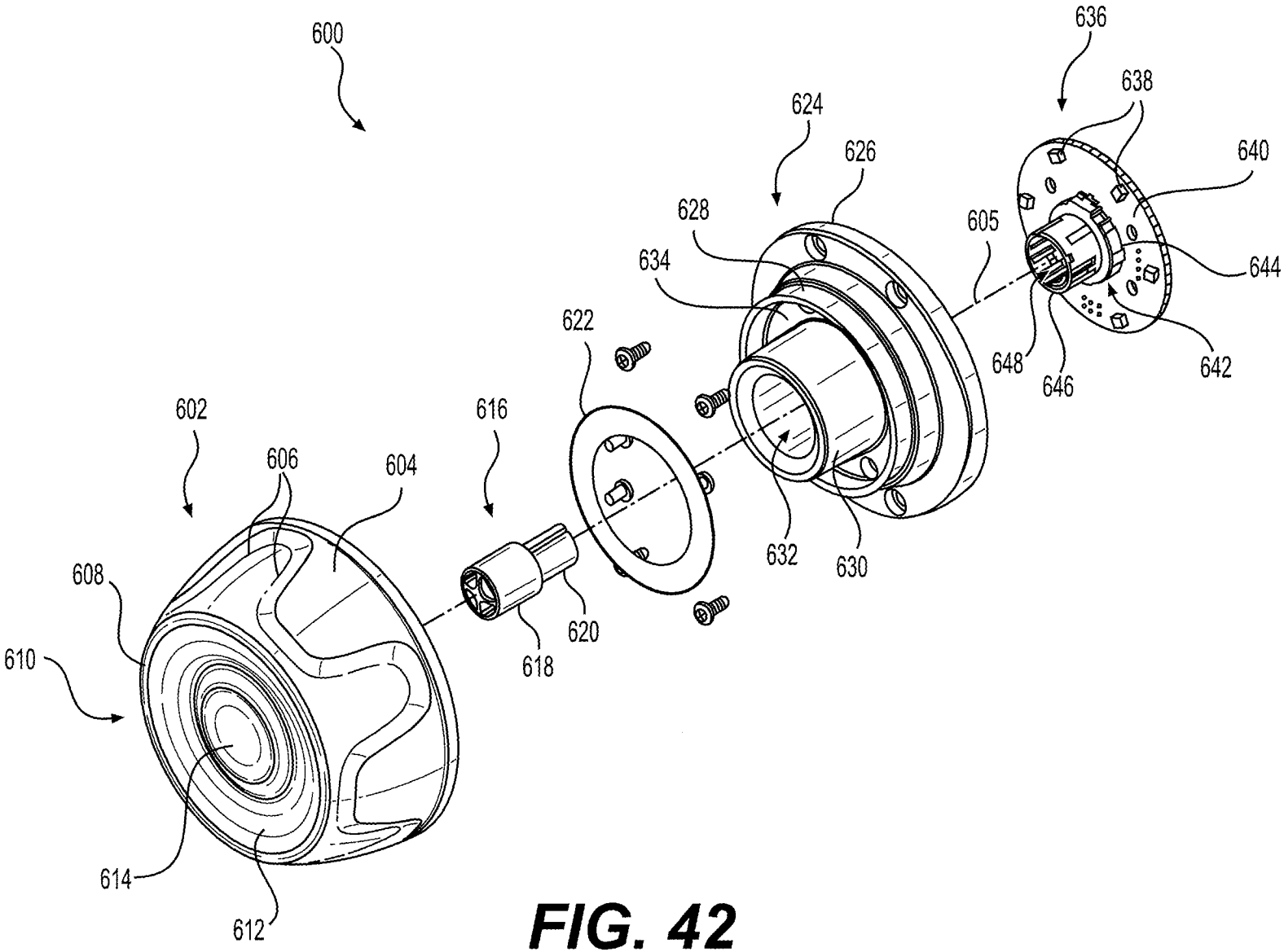
FIG. 42 provides an exploded view of another example rotary control of the present disclosure.

FIG. 42 illustrates another example rotary control 600 of the present disclosure. It is understood that in some examples the rotary control 600 may be substantially similar to and/or the same as the rotary control 528 described above. Alternatively, in some examples, the rotary control 600 may be different from and/or may include one or more components different from respective components of the rotary control 528. It is understood that the rotary control 600 may be used with and/or included on the exercise machine 500 with or in place of the rotary control 528, and any descriptions herein of the rotary control 528 shall also apply to the rotary control 600 unless otherwise noted. Moreover, any of the descriptions herein of the rotary control 600 shall also apply to the rotary control 528 unless otherwise noted. For example, one or more components of the rotary control 528 may be substantially similar to and/or the same as one or more corresponding components of the rotary control 528. Additionally, any of the descriptions herein of the rotary control 600 shall also apply to one or both of the rotary control 144, 146 unless otherwise noted.

For example, as shown in FIG. 42 the rotary control 600 may include an outer portion 602, and the outer portion 602 may include a top 604 having one or more grips 606. In such examples, the outer portion 602, top 604, and grips 606 of the rotary control 600 may be substantially similar to and/or the same as the corresponding outer portion 530, top 534, and grips 538 of the rotary control 528. For example, the top 604 of the outer portion 602 may comprise a substantially cylindrical, substantially semi-circular, or substantially dome-shaped housing of the rotary control 600. In some examples, the rotary control 600 may include a central axis (e.g., a central longitudinal axis) 605 extending substantially centrally through the outer portion 602. In such examples, at least a portion of the rotary control 600 may be rotatable about the central axis 605. For example, at least the top 604 and/or other components of the outer portion 602 may be rotatable about the central axis 605 during use. It is understood that, in some examples, at least the outer portion 602 may be rotatable about the central axis 605 relative to the arm 504*b* to which the rotary control 600 is connected, and in such examples, the central axis 605 may extend substantially perpendicular to an outer surface of the arm 504*b* (e.g., substantially perpendicular to a central longitudinal axis of the arm 504*b*, crossbar 514, and/or other component of the exercise machine 500). As shown in FIGS. 36-38, the rotary control 528 (e.g., the central axis 536 of the rotary control 528) may have a similar orientation relative to the arm 504*b* and/or other components of the exercise machine 500.

In some examples, the rotary control 600 may also include one or more components configured to provide tactile, audible, visual, and/or other feedback to the user 106 as the user rotates at least a portion of the rotary control 600 relative to the arm 504*b* to which the rotary control 600 is connected. In any example embodiment of the present disclosure, two or more such components of the rotary control 600 may provide feedback to the user 106 substantially simultaneously during use of the exercise machine 500. In such examples, the feedback substantially simultaneously received from two or more such components of the rotary control 600 may be indicative of the same operating characteristic of the rotary control 600 (e.g., a degree to which the outer portion 602 has been rotated by the user 106, a speed at which the outer portion 602 has been rotated, a direction of rotation, etc.).

For example, the rotary control 600 may include a first component configured to provide visible feedback to the user 106 as the user 106 rotates the outer portion 602 and/or other portions of the rotary control 600 about the central axis 605. In such examples, such a first component may comprise an indicator 608 disposed on, connected to, and/or otherwise associated with the top 604. In other embodiments, on the other hand, the indicator 602 may be located radially inward of the top 534. In some examples, the indicator number 608 may be substantially similar to and/or the same as the indicator 540 and may comprise one or more light emitting diodes (LEDs) and/or other light sources disposed, for example, about or proximate a perimeter of the top 604. In other examples, the indicator 608 may comprise a lens, a window, and/or any other optical component configured to permit the passage of visible light or other radiation from one or more LEDs disposed proximal to the indicator 608 (e.g., between the arm 504*b* and the indicator 608) to a location distal to the indicator 608 (e.g., a location associated with the deck 112, a location external to the outer portion 602, and/or any other location optically downstream of the indicator 608). For example, the rotary control 600 may include a printed circuit board (PCB) 636 substantially similar to and/or the same as the PCB 556 described above with respect to the rotary control 528. In such examples, the PCB 636 may include one or more LEDs 638 disposed on, connected to, and/or embedded at least partly within a top surface 640 thereof disposed opposite and facing the indicator 608. The PCB 636 may also include one or more sensors (e.g., Hall effect sensors, proximity sensors, optical sensors, etc.), switches, controllers, microprocessors, and/or other components configured to determine a position (e.g., a radial angle or position) of the outer portion 602 relative to the PCB 636 and/or other stationary components of the rotary control 600, and to provide one or more signals including information indicting such a position to a controller or other digital hardware 148 of the exercise machine 500. Such components of the PCB 556 may also be operably connected to the LEDs 638 and may be configured to control operation of the LEDs based at least partly on the position of the outer portion 602, the speed of rotation of the outer portion 602, and/or other information or parameters.

In any such examples, the indicator 608 may be configured such that rotation of the rotary control 600 results in commensurate temporary illumination of at least part of the indicator 608. For example, the indicator 608 may be configured such that rotation of the top 604 about the central axis 605 may cause commensurate temporary illumination of at least part of the indicator 608 in any manner substantially similar to and/or the same as that described above with respect to the indicator 540 of the rotary control 528. In example embodiments, the extent to which the indicator 608 is illuminated may indicate the degree to which and/or the speed at which the outer portion 602 has been rotated by the user 106. In some examples, such illumination of the indicator 608 may include pulsing, blinking, changes in color, substantially constant illumination, and/or other illumination modalities.

Further, in some examples the rotary control 600 may include one or more additional components configured to provide tactile feedback to the user 106 as the user 106 rotates the top 604 and/or other components of the outer portion 602 about the central axis 605. As shown in FIG. 42, such an additional component may comprise an encoder 642 configured to at least partly restrict rotation of the outer portion 602 about the central axis 605. For example, the encoder 642 may be disposed on, connected to, and/or embedded at least partly within the top surface 640, and the encoder 642 may include one or more detents substantially similar to and/or the same as the detents 555 described above with respect to the frame 554 and/or carrier 552. For example, the encoder 642 may include a base 644 fixedly connected to the PCB 636, and a stem 646 extending from the base 644. In such examples, the stem 646 may be rotatable relative to the base 644, and the base 644 or the stem 646 may include one or more detents configured to provide partial resistance to the stem 646 as the stem 646 is rotated relative to the base 644 and/or the top surface 640. In such examples, the outer portion 602 may be connected to the stem 646 such that the one or more detents of the stem 646 and/or the base 644 may provide partial resistance to the outer portion 602 as the user 106 rotates the outer portion 602 about the central axis 605. It is understood that, in such examples, the central axis 605 may pass substantially centrally through, for example, the stem 646 and/or the base 644. In any of the examples described herein, and in substantially the same manner as the detents 555 described above, the one or more detents of the encoder 642 may be positioned, sized, and/or otherwise configured to coincide with a desired incremental change in a corresponding function of the exercise machine 500. For example, in any of the examples described herein, components of the PCB 636, control software of the exercise machine 500, and/or the digital hardware 148 described above may be configured such that rotation of the outer portion 602 about the central axis 605 may cause any desired outcome associated with the exercise machine 500 generally, the display 104, the motors 114, 118, one or more speakers of the exercise machine 500, and/or other such components. Any of the functions (e.g., changing a position of the deck 112, changing a rotational speed of the belt 120, pausing the display of one or more exercise classes on the display 104, causing an audible tone to be emitted, etc.) described above with respect to the rotary control 528 may also be performed by and/or otherwise controlled with the rotary control 600 in a manner substantially similar to and/or the same as that described above with respect to the rotary control 528.

As shown in FIG. 42, the rotary control 600 may also include an inner portion 610. In some examples, the inner portion 610 may be fixedly connected to the outer portion 602, and in such examples, the inner portion 610 may be rotatable with the outer portion 602 about the central axis 605 of the rotary control 600. In other examples, the inner portion 610 may be separate from the outer portion 602 such that at least, for example, the top 604 may be rotatable relative to the inner portion 610 about the central axis 605. In such examples, the inner portion 610 may be fixed relative to the top 604 as the top 604 is rotated about the central axis 605. The inner portion 610 may include a substantially disc-shaped plate 612 disposed substantially centrally within the top 604. In such examples, the central axis 605 may extend substantially centrally through the plate 612. Additionally, the plate 612 may be disposed radially inward of, for example, the indicator 608 and/or the top 604. In some examples the indicator 608 may be disposed on and/or otherwise connected to the plate 612, and in such examples, the top 604 and/or other components of the outer portion 602 may be rotatable relative to the plate 612 and the indicator 608.

The rotary control 600 may further include one or more input devices 614 substantially similar to and/or the same as the input device 546 described above with respect to the rotary control 528. For example, the rotary control 600 may include an input device 614 disposed substantially centrally relative to the plate 612. In some examples, the input device 614 may be disposed on and/or otherwise connected to the plate 612. In such examples, the top 604 and/or other components of the outer portion 602 may be rotatable relative to the input device 614. Similar to the input device 546, the input device 614 may comprise one or more buttons, wheels, touch pads, levers, knobs, capacitance sensors, switches, or other components configured to receive inputs from the user 106, and in such examples, the inputs received via the input device 614 may be different and/or separate from rotational input received from the user 106 via the top 604. In such examples, the input device 614 may be configured to control one or more functions of the exercise machine 500 different and/or separate from functions of the exercise machine 500 controlled via rotation of the top 604. For example, in embodiments in which rotation of the top 604 and/or other components of the outer portion 602 of the rotary control 600 may enable the user 106 to control a speed of rotation of the belt 120, a position of the deck 112, and/or other functions of the exercise machine 500, inputs received via the input device 614 may control one or more additional functions of the exercise machine 500 different from the speed of rotation of the belt 120, the position of the deck 112, etc. For example, an input received via the input device 614 may cause the belt 120 to begin rotating, may cause the belt 120 to stop rotating, may enable selection of one or more exercise classes, may enable selection of one or more modes of operation of the exercise machine 500, and/or may enable control of various other functions of the exercise machine 500.

As illustrated in FIG. 42, the rotary control 600 may also include a spacer 616 having a distal portion 618 and a proximal portion 620 extending from the distal portion 618. In such examples, the distal portion 618 may be connected to, mate with, contact, and/or otherwise engage the input device 614. In some examples, the distal portion 618 may include one or more electrical contacts, sensors, and/or other control components configured to transmit signals from the input device 614 to, for example, one or more microprocessors, filters, amplifiers, or other control components of the PCB 636. Additionally or alternatively, the distal portion 618 may engage the input device 614 and the proximal portion 620 may extend at least partly into or through an opening 648 of the stem 646. In such examples, the proximal portion 620 may be connected to, mate with, contact, and/or otherwise engage one or more switches, sensors, electrical contacts, and/or other components of the PCB 636 configured to receive signals or other input from the input device 614. In some examples, such components of the PCB 636 may comprise a physical switch associated with the encoder 642 and/or with the PCB 636. In such examples, when the user 106 presses the input device 614, the input device 614 may move proximally toward the PCB 636 substantially along the central axis 605. Such movement may cause commensurate movement of the spacer 616 substantially along the central axis 605 toward the switch, and such movement may, in some examples, actuate the switch due to the engagement between the proximal portion 620 and the switch.

As noted above, the PCB 636 may include one or more LEDs 638 configured to emit visible light or other radiation. The rotary control 600 may also include one or more diffusion lenses, collimating lenses, diffraction lenses, prisms, and/or other optical components 622 disposed optically downstream of such LEDs 638. For example, the rotary control 600 may include an annular optical component 622 disposed optically between one or more of the LEDs 638 and the indicator 608. Such optical components 622 may assist in diffusing, focusing, and/or otherwise conditioning the radiation emitted by the LEDs 638, and may direct such radiation from the LEDs 638 to the indicator 608.

In some examples, the rotary control 600 may further include a substantially rigid frame 624, and one or more of the components described above with respect to the rotary control 600 may be connected to the frame 624. Additionally, the frame 624 may be directly coupled, mounted to, and/or otherwise connected to the arm 504*b*, crossbar 514, and/or other component of the exercise machine 500. For example, the frame 624 may include a substantially disc-shaped base 626 having one or more thru holes or other components configured to facilitate connecting the frame 624 to the arm 504*b*. In such examples, the PCB 636 may be connected to the base 626 and may remain stationary relative to the base 626 as, for example, the stem 646 or other components of the encoder 642 are caused to rotate about the central axis 605. In such examples, the frame 624 may include an opening 632 extending substantially centrally therethrough, and the stem 646, the base 644, and/or other portions of the encoder 646 or the PCB 636 may be connected to the outer portion 602 and/or components thereof via the opening 632. In such examples, at least part of the spacer 616 may be disposed within the opening 632 to facilitate a connection between the input device 614, and one or more switches or other components of the encoder 642 and/or of the PCB 636.

The frame 624 may also include one or more additional components configured to support corresponding components of the rotary control 600 and/or to at least partly guide the rotation of one or more such components relative to the frame 624. For example, the frame 624 may include one or more substantially annular rings 628, 630 configured to at least partly support the outer portion 602. In some examples, one or both of the rings 628, 630 may include substantially cylindrical bearing surfaces and/or camming surfaces. Such surfaces may comprise, for example, outer surfaces or inner surfaces of the rings 628, 630 configured to contact, connect with and/or otherwise engage one or more corresponding surfaces (e.g., follower surfaces) of the outer portion 602. In such examples, the outer portion 602 may be rotatably connected to the frame 624 and/or to the encoder 642, and one or more substantially cylindrical bearing surfaces and/or camming surfaces of the rings 628, 630 may at least partly guide rotation of the outer portion 602 about the central axis 605.

Moreover, the frame 624 may include one or more shelves 634 extending substantially perpendicular to one or both of the rings 628, 630. Such a shelf 634 may comprise a substantially annular, substantially planar surface of the frame 624 and, in some examples, the shelf 634 may extend opposite and/or substantially parallel to a corresponding surface of the base 626. In some examples, at least part of a shelf 634 of the frame 624 may extend radially from the ring 628 to the ring 630. Additionally, in some embodiments the optical component 622 may be supported by, connected to, and/or at least partly disposed on the shelf 634. In such examples, the shelf 634 may include one or more openings permitting radiation emitted by one or more LEDs 638 of the PCB 636 to pass substantially unimpeded from the one or more LEDs 638 to the optical component 622. In some examples, the shelf 634 may include a plurality of such openings, and each opening of the shelf 634 may be substantially aligned with a corresponding LED 638 of the PCB 636 to facilitate permitting radiation emitted by the corresponding LED 638 to pass to and/or impinge upon the optical component 622.

Figure 41:
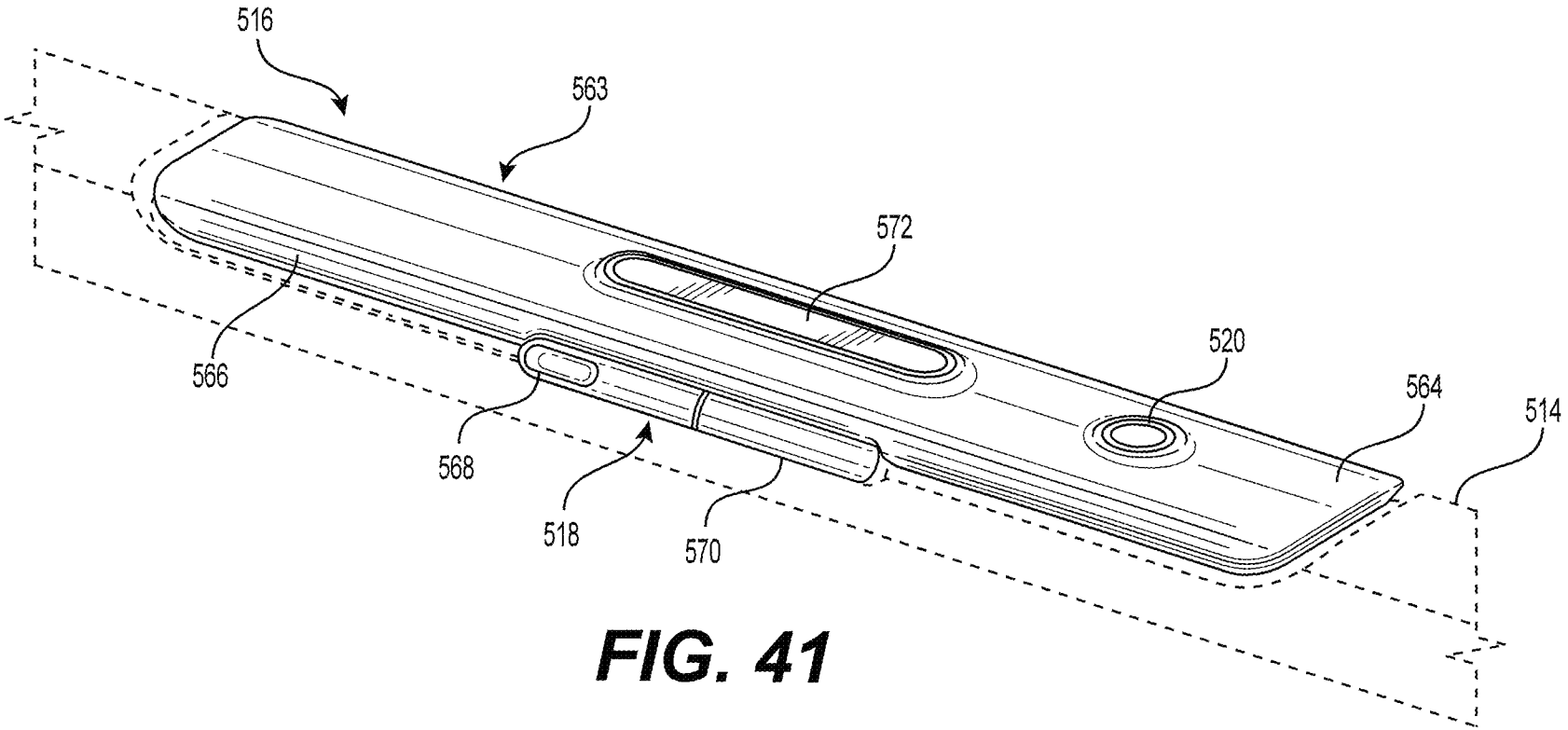
FIG. 41 provides an isometric view of another control associated with the exercise machine shown in FIG. 36.

As shown in FIG. 41, the control 516 may include a substantially rigid frame 563 connected to the crossbar 514 of the exercise machine 500. In such examples, the frame 563 may include a top surface 564 and a front service 566, and the frame 563 may contain, carry, and/or otherwise at least partly support one or more components of the control 516. For example, the magnetic connector 518 described above may be connected to the frame 563, and such a magnetic connector 518 may include a recess 568 configured to receive at least part of an emergency stop device carried by, attached to, and/or worn by the user 106. For example, as noted above, such an emergency stop device may include a cord of a given length, and a magnetic clip or other component disposed at the end of the cord. The magnetic clip at the end of the cord may be disposed on and/or at least partly within the recess 568 during use of the exercise machine 500. In such examples, the recess 568 may include one or more magnets having an opposite polarity from the magnetic clip disposed at the end of the cord such that the clip may be at least temporarily retained at least partly within the recess 568 by magnetic forces. The exercise machine 500 may be configured such that the belt 120 of the deck 112 may only rotate while the magnetic clip at the end of the cord is disposed on, and/or at least partly within the recess 568. Additionally, removal of the magnetic clip from the recess 568 may cause the belt 120 to stop. In such examples, the magnetic connector 518 may include one or more sensors or other components configured to determine the presence of the magnetic clip at least partly within the recess 568 and/or the removal of the magnetic clip from the recess 568. Such sensors of the magnetic connector 518 may be operably connected to the controller and/or other digital hardware 148 of the exercise machine 500 in order to facilitate such operations.

In some examples, the control 516 may also include one or more additional sensors 570 disposed on either the front surface 566 or the top surface 564. In such examples, such additional sensors 570 may include, among other things, one or more proximity sensors, biosensors, and/or other sensors configured to determine the presence of, location of, and/or performance parameters of the user 106. In some examples, one or more such sensors 570 may be similar to and/or substantially the same as one or more of the sensors 147 discussed above with respect to at least FIG. 29. For example, such sensors 570 may be configured to measure, sense, detect, and/or otherwise determine user heart-rate, respiration, hydration, calorie burn, or any other physical performance metrics, or to receive such data from sensors provided by the user 106. Such sensors 570 may be operably connected to the controller, memory, and/or other digital hardware 148 of the exercise machine 500.

Further, in any of the examples described herein the control 516 may include one or more input devices 572 in addition to the input device 520 discussed above. Similar to the input device 520, the input device 572 may be configured to receive an input from the user 106 during use of the exercise machine 500. In such examples, one or more such input devices 572 may comprise a button, wheel, touch pad, lever, knob, capacitance sensor, switch, or other component configured to receive an input from the user 106, and similar to the input device 520, the input device 572 may be configured to control and/or may enable the user 106 to control a corresponding function of the exercise machine 500. In such examples, the input device 520 may be configured to provide control of a first function of the exercise machine 500, and the input device 572 may be configured to provide control of a second function of the exercise machine 500 different from the first function associated with the input device 520.

Display and User Interface

The one or more displays 104 may be driven by a user input device such as a touchscreen, mouse, voice control, or other suitable input device. In some examples, the display 104 or at least a portion thereof, may comprise a touchscreen configured to receive touch input from the user 104. The one or more displays 104 may be any size, but optimally are large enough and oriented to allow the display of a range of information including one or more video streams, a range of performance metrics corresponding to the user 106, a range of additional performance metrics associated with one or more additional users exercising on exercise machines remote from the exercise machine 102, and a range of different controls. In various exemplary embodiments, such as the embodiment illustrated in FIG. 4, the display 104 may include some or all of its area that can reflect the image of the user 106 to provide user feedback regarding their form and performance of various activities.

In various exemplary embodiments the user can use the display 104 or one or more user interfaces 200 displayed on the display 104 to selectively present a range of different information including live and/or archived video, performance data, and other user and system information. As will be described below with respect to at least FIGS. 12-24, such user interfaces 200 can provide a wide range of control and informational windows that can be accessed and removed individually and/or as a group by a click, touch, voice command, or gesture. In various exemplary embodiments, such windows may provide information about the user's own performance and/or the performance of other participants in the same class both past and present.

Example user interfaces 200 presented via the display 104 may be used to access member information, login and logout of the system 100, access live content such as live exercise classes and archived classes or other content. User information may be displayed in a variety of formats and may include historical and current performance and account information, social networking links and information, achievements, etc. The user interfaces described herein 200 can also be used to access the system 100 to update profile or member information, manage account settings such as information sharing, and control device settings.

An example user interface 200 may also be presented on the one or more displays 104 to allow users to manage their experience, including selecting information to be displayed and arranging how such information is displayed on the display 104. Such a user interface 200 may present multiple types of information overlaid such that different types of information can be selected or deselected easily by the user 106. For example, performance metrics and/or other information may be displayed over video content using translucent or partially transparent elements so the video behind the information elements can be seen together with (i.e., simultaneously with) the performance metrics and/or other information itself. Further, example user interfaces 200 may present a variety of screens to the user 106 which the user 106 can move among quickly using the provided user input device, including by touching if a touchscreen is used.

In any of the examples described herein, the processor and/or other components of the digital hardware 148 may control the display 104 and/or otherwise cause the display 104 to display the various user interfaces 200 of the present disclosure. For example, the processor or other components of the digital hardware 148 may cause the display 104 to display a user interface 200 comprising a home screen that provides basic information about the system 100 and/or the exercise machine 102, as well as available options. Such a home screen may provide direct links to information such as scheduled classes, archived classes, a leaderboard, instructors, and/or profile and account information. The home screen may also provide direct links to content such as a link to join a particular class. The user can navigate among the different portions of the home screen by selecting such links using the applicable input device such as by touching the touchscreen at the indicated location, or by swiping to bring on a new screen. An example user interface 200 providing such a home screen may also provide other information relevant to the user such as social network information, and navigation buttons that allow the user to move quickly among the different screens in the user interface.

Figure 12:
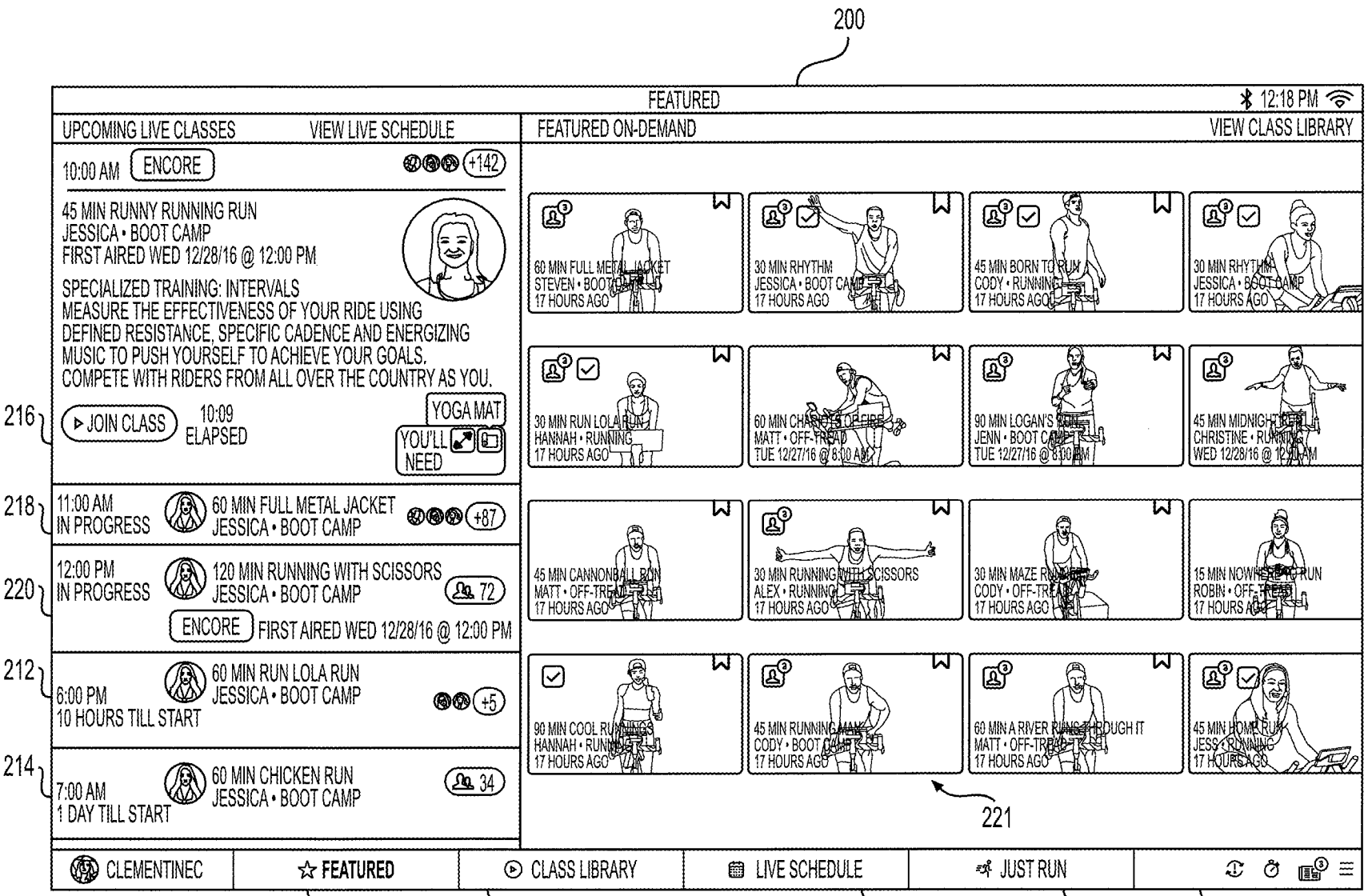
FIG. 12 illustrates an example user interface of the present disclosure including information related to featured exercise classes.
Figure 13:
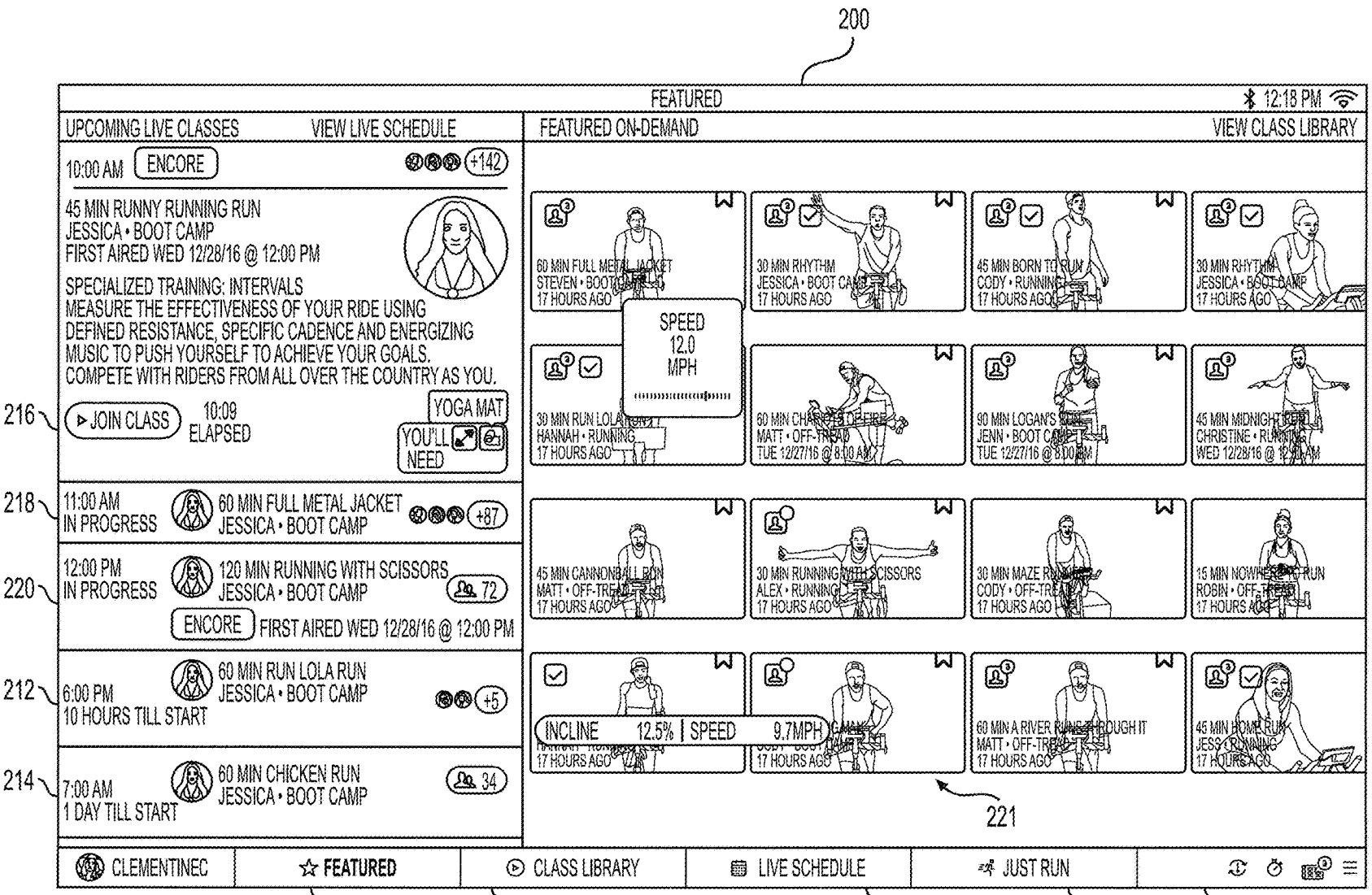
FIG. 13 illustrates another example user interface of the present disclosure including information related to featured exercise classes.
Figure 14:
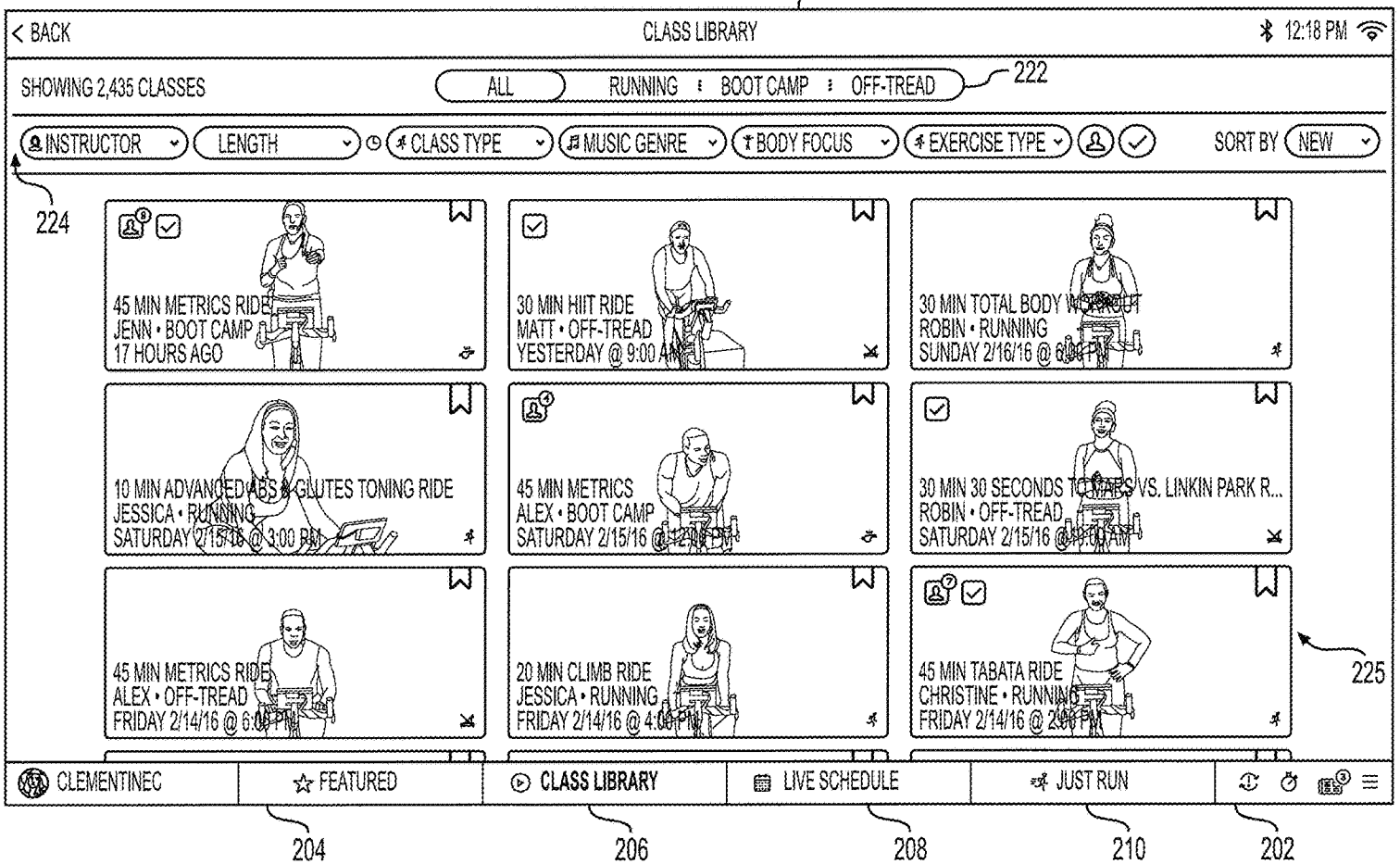
FIG. 14 illustrates a further example user interface of the present disclosure including information related to a class library.

In various exemplary embodiments, the user 106 can use one or more of the user interfaces 200 to browse and select among both live and archived content. For example, as shown in FIGS. 12-14, example user interfaces 200 may include one or more toolbars 202 enabling the user 106 to access listings and/or other information regarding available exercise classes. Such example toolbars 200 may include respective tabs or other controls enabling the user 106 to browse such content. For example, the toolbar 200 may include a first tab 204 enabling the user to access featured live and archived exercise classes, a second tab 206 enabling the user to access a library of archived exercise classes, a third tab 208 enabling the user to access a schedule of live classes, a fourth tab 210 enabling the user to access a variety of quick start or "just run" content, and/or other additional or different tabs.

As shown in FIGS. 12 and 13, if the user 106 selects the first tab 204 associated with featured classes, the user interface 200 may present a schedule of upcoming live or archived classes that have achieved a high ranking or other preferential (e.g., "featured") status. The user interface 200 may include one or more drop-down menus or other display features, and such features may also allow users to find such featured classes by type, instructor, or by any other appropriate category. The user interfaces 200 associated with the featured classes tab 204 may allow the user 106 to select future classes (as illustrated by thumbnails or icons 212, 214) or to start a class that is underway or about to begin (as illustrated by thumbnails or icons 216, 218, 220). Further, the user interfaces 200 associated with the featured classes tab 204 may allow the user 106 to select an archived or on-demand class that has already taken place (as illustrated by thumbnails or icons 221). The class schedule and information regarding "featured" content or any other content may be presented via such user interfaces 200 in any suitable format, including a calendar, list, or any other appropriate layout. For example, selecting the third tab 208 associated with the live schedule of exercise classes may yield a user interface 200 presenting an upcoming schedule of live classes set forth on a calendar.

Figure 15:
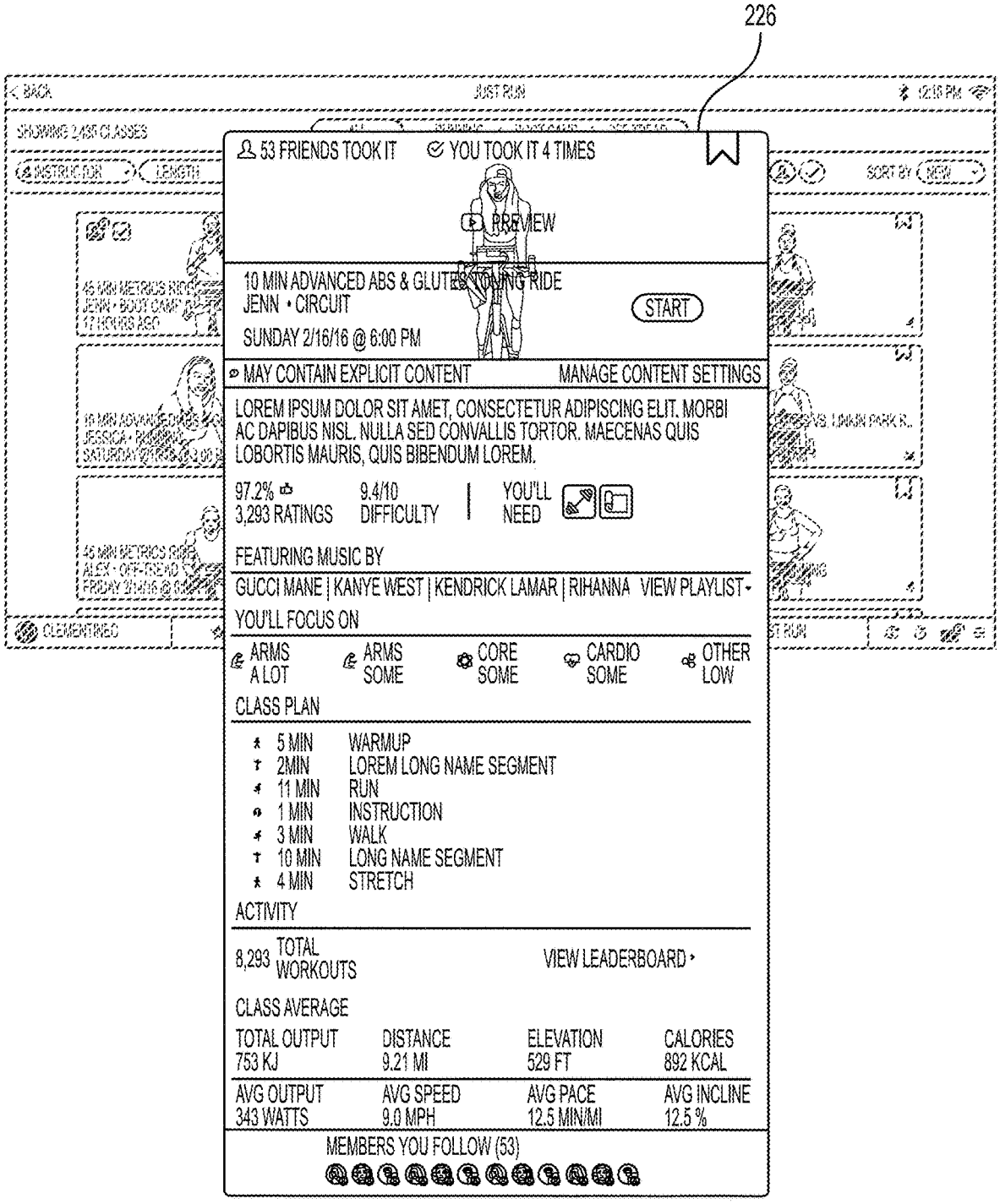
FIG. 15 illustrates another example user interface of the present disclosure including information related to a selected exercise class.

As illustrated by the example user interface 200 shown in FIG. 14, if the user 106 selects the second tab 206 associated with the class library, the system 100 may provide a user interface 200 showing information related to available archived classes, and such information may be sorted in a number of different ways. As illustrated by the menu icon 222, the user interface 200 may filter the classes included in the class library such that only icons or thumbnails 225 corresponding to classes associated with running, boot camp, and off-tread are provided to the user 106. Additionally, such user interfaces 200 may include one or more drop down menus 224 enabling the user 106 to further filter the classes included in the class library. For example, such drop down menus 224 may enable the user 106 to select classes based on instructor, length, class type, music genre, body focus, exercise type, etc. Additionally, as shown in FIG. 14, the icons or thumbnails 225 may be displayed in any suitable format, and may include information including the instructor of the class, the class length, the date on which the class was originally held, the type of class, and/or other related information. Further, as shown in FIG. 15, selecting one of the thumbnails 225 may surface additional information to the user 106 via an additional window 226 of the user interface 200. Such additional information may include, for example, a rating of the class, how many times the user has taken that class in the past, the portions of the body that are focused on during the class, additional equipment (e.g., weights) that may be needed during the class, as well as other performance or class-related information.

Figure 16:
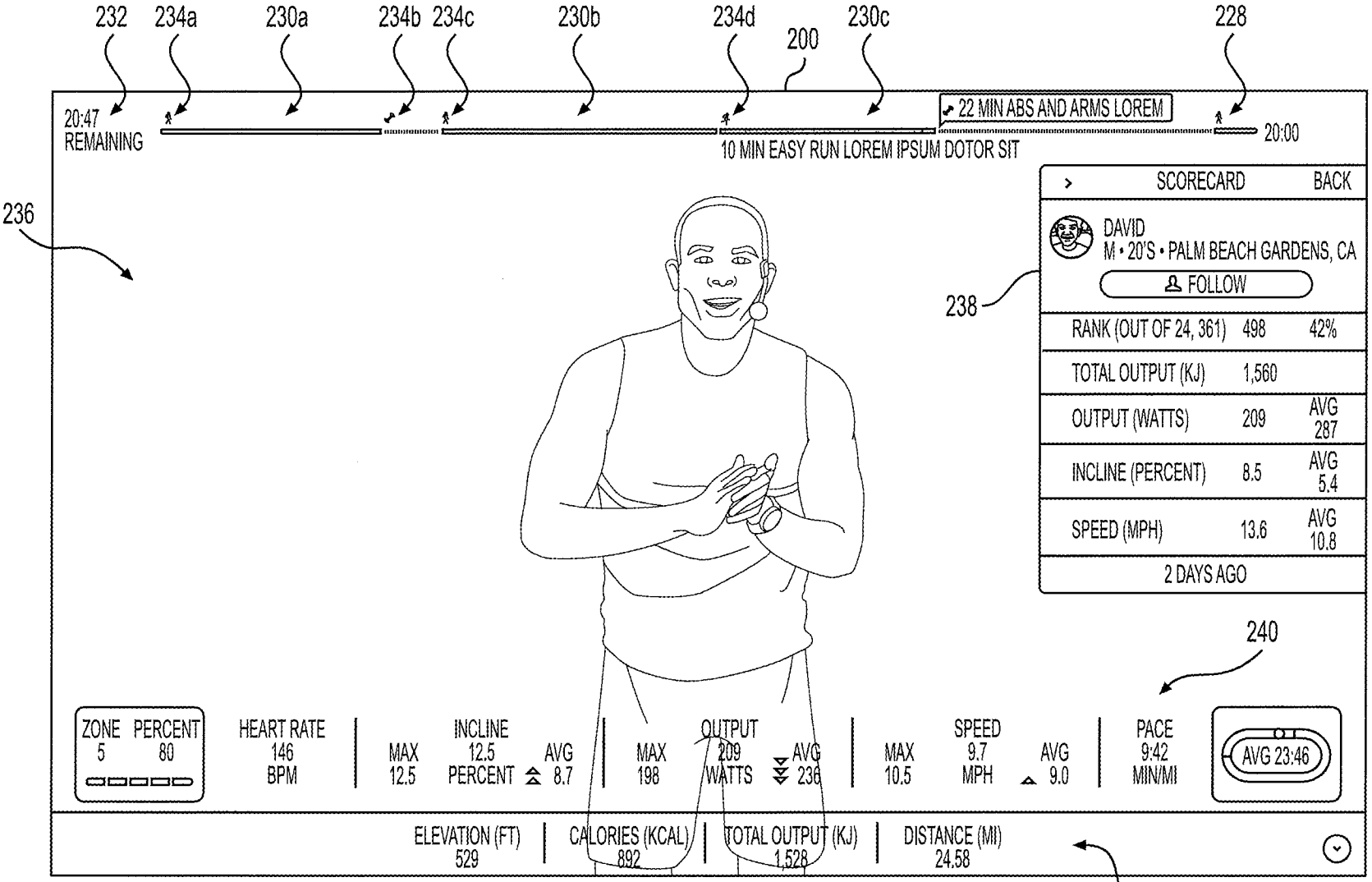
FIG. 16 illustrates still another example user interface of the present disclosure showing an exercise class and a scorecard.
Figure 17:
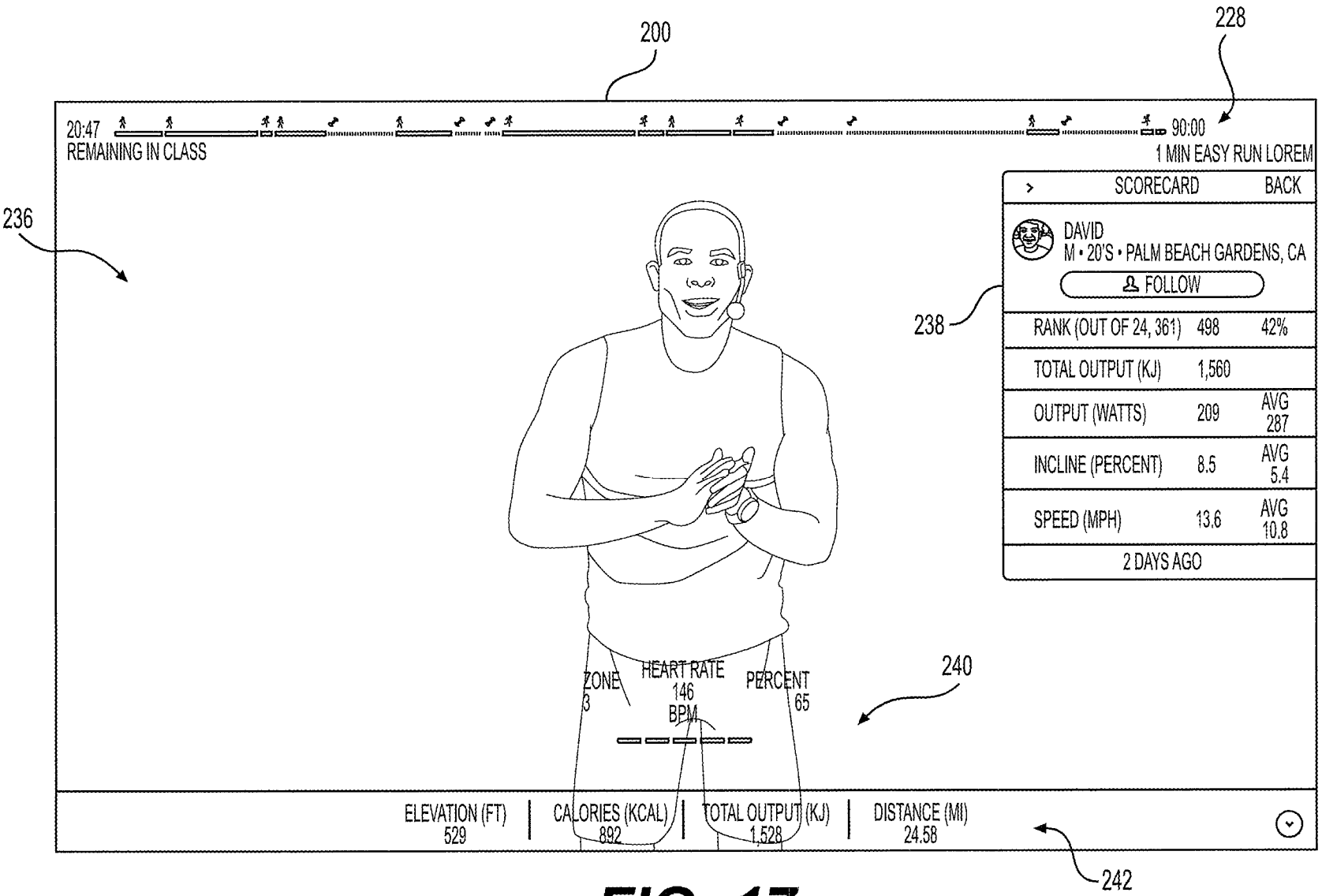
FIG. 17 illustrates yet another example user interface of the present disclosure showing an exercise class and a scorecard.
Figure 18:
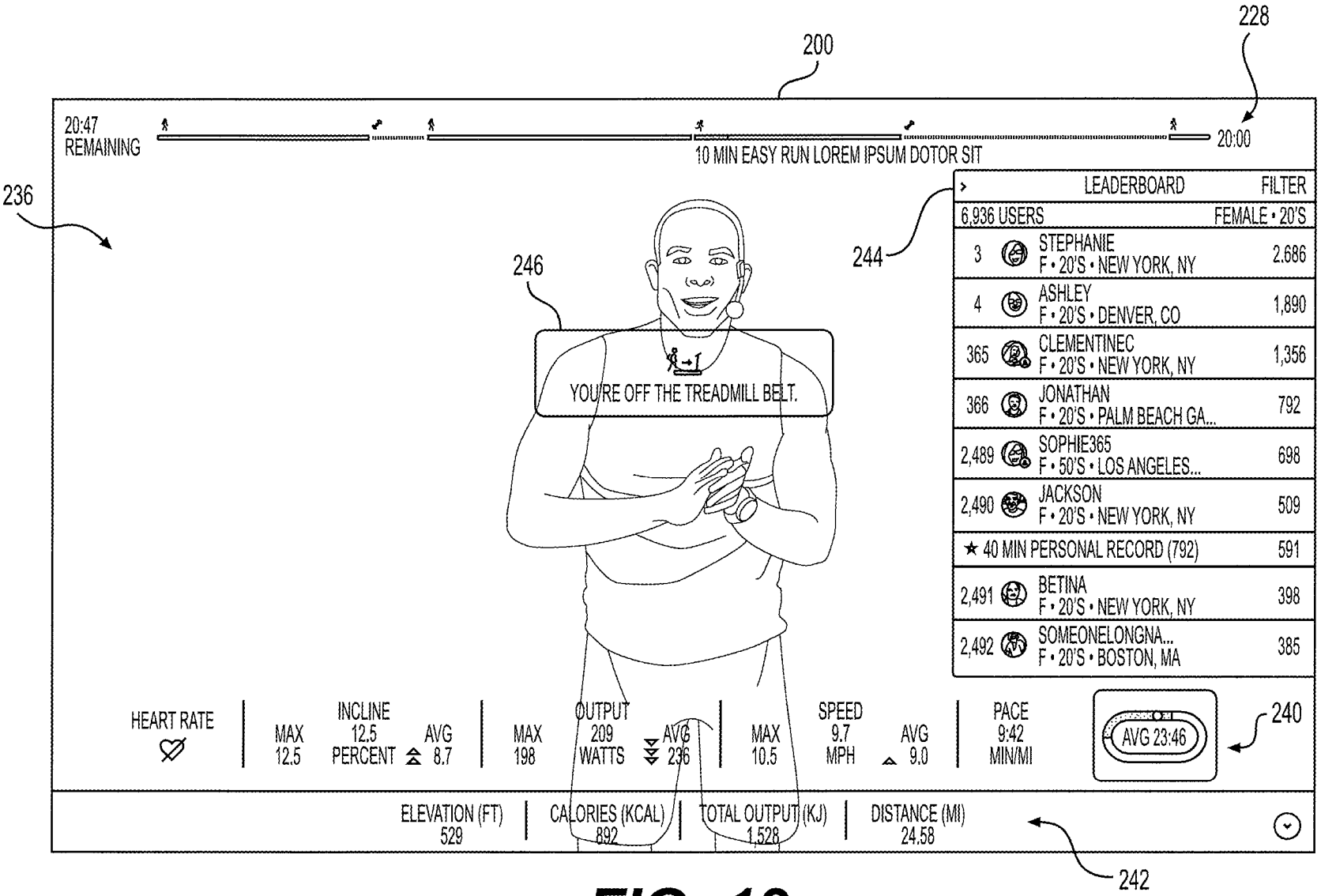
FIG. 18 illustrates a further example user interface of the present disclosure showing an exercise class and a leaderboard.

FIGS. 16-18 illustrate example user interfaces 200 that may be provided to the user 106 during a selected exercise class. When an exercise class is being played on the one or more displays 104 through the user interface 200, in various exemplary embodiments the primary video feed may be shown as the background video full-screen or in a sub-window on the display 104. Information elements may be provided on different parts of the display screen to indicate any performance metrics, including total time, elapsed time, time left, distance, speed, mile pace of the user 106, incline, elevation, resistance, power, total work, energy expended (e.g., output), cadence, heart rate, respiration, hydration, calorie burn, and/or any custom performance scores that may be developed. The displayed information may also include the trend or relationship between different performance metrics. For example, the display can indicate a particular metric in a color that indicates current performance compared to average performance for a class or over time, such as red to indicate that current performance is below average or green to indicate above average performance. Trends or relative performance can also be shown using color and graphics, such as a red down arrow to show that current performance is below average.

In various exemplary embodiments, the display 104 may also display information that supports or supplements the information provided by the instructor. Examples include one or more segmented timelines 228 that are illustrated together with at least part of the selected exercise class in the user interface 200. As shown in FIGS. 16-18, an example segmented timeline 228 may include one or more segments 230*a*, 230*b*, 230*c* . . . 230*n* (collectively, "segments 230") corresponding to respective portions or parts of the selected exercise class. The size, length, width, height, relative position, color, opacity, and/or other configurations of such segments 230 may be representative of, for example, the length of the corresponding portions or parts of the selected exercise class. The segmented timeline 228 may also provide an indication 232 of elapsed time and/or remaining time for the present workout segment and/or for the exercise class generally. The segmented timeline 228 may also include one or more visual indica 234*a*, 234*b*, 234*c* . . . 234*n* (collectively, "indicia 234") indicating an activity and/or equipment required during a respective portion or part of the selected exercise class. For example, the indicia 234*a* may indicate that the segment 230*a* comprises a walking segment, indicia 234*d* may indicate that the segment 230*c* comprises a running segment, and the indicia 234*b* may indicate that weights are required for at least part of the segment 230*a*. In any of the examples described herein, such timelines 228 may also include one or more lists or windows identifying and/or describing upcoming workout segments or features, instructional information such as graphics or videos demonstrating how to properly perform exercises, or other information relevant to the exercise class in progress.

As shown in FIGS. 16-18, the user interface 200 may include a primary window 236 configured to show the live or archived exercise class or other content that the user 106 selected. In various exemplary embodiments, the user interface 200 may further include one or more performance metric windows 238 (e.g., the "scorecard" illustrated in FIGS. 16 and 17) overlaid on and/or otherwise displayed together with the primary window 236. Such performance metric windows 238 may show a ranking, total output, current output, incline, belt speed, mile pace, and/or other specific performance metrics for the user's current class, past classes, or other performance information. Such performance metric windows 238 may be presented anywhere on the display 104, and may be user selectable such that they can be displayed or removed by a screen touch or gesture.

The user interface 200 may also allow the user 106 to toggle between display of maximum, average, and total results for different performance metrics. Additionally, the user interface 200 may allow the user 106 to hide or display information elements, including performance metrics, video streams, user information, etc. all at once or individually. Performance metrics and/or other performance information can also be displayed in various display bars 240, 242 that can be hidden or displayed as a group or individually. The user interface 200 may provide for complete controls for audio volume, inputs, and outputs as well as display output characteristics.

As shown in FIG. 18, a leaderboard 244 may also be displayed to allow the user 106 to see their performance in comparison to others taking the same exercise class. In various exemplary embodiments, a leaderboard 244 may comprise a separate window overlaid on and/or otherwise displayed together with the primary window 236. An example leaderboard 244 may be configured to display the relative performance of all participants, and/or of one or more subgroups of participants. For example, the user 106 may be able to select a leaderboard 244 that shows the performance of participants in a particular age group, male participants, female participants, male participants in a particular age group, participants in a particular geographic area, etc. As indicated by the example filter shown in FIG. 18, the leaderboard 244 has been configured to show the performance of a group of female participants in their 20's. Users 106 may have the ability to individually curate and/or otherwise configure a leaderboard 244, or have the system 100 curate a leaderboard 244 by selecting an appropriate group of participants relative to the user 106. Users 106 may be able to curate their own leaderboards 244 for specific previously recorded classes to create a leaderboard 244 that provides the maximum personal performance incentive to the user 106.

Users 106 may be provided with the ability to deselect the leaderboard 244 entirely and remove it from the user interface 200. In various exemplary embodiments, the exercise machine 102 may incorporate various social networking aspects such as allowing the user 106 to follow other participants, or to create groups or circles of participants. User lists and information may be accessed, sorted, filtered, and used in a wide range of different ways. For example, other users can be sorted, grouped and/or classified based on any characteristic including personal information such as age, gender, weight, or based on performance such as current power output, speed, or a custom score.

The leaderboard 244 may be fully interactive, allowing the user 106 to scroll up and down through the participant rankings, and to select a participant to access their detailed performance data, create a connection such as choosing to follow that participant, or establish direct communication such as through an audio and/or video connection. The leaderboard 244 may also display the user's personal best performance in the same or a comparable class, to allow the user 106 to compare their current performance to their previous personal best. In some examples, such performance information may also be displayed in one or more of the display bars 240, 242. The leaderboard 244 may also highlight certain participants, such as those that the user 106 follows, or provide other visual cues to indicate a connection or provide other information about a particular entry on the leaderboard 244.

In various exemplary embodiments, the leaderboard 244 will also allow the user 106 to view their position and performance information at all times while scrolling through the leaderboard 244. For example, if the user 106 scrolls up toward the top of the leaderboard 244 such as by dragging their fingers upward on the display 104, when the user 106 reaches the bottom of the leaderboard 244, it will lock in position and the rest of the leaderboard 244 will scroll underneath it. Similarly, if the user 106 scrolls down toward the bottom of the leaderboard 244, when the user's window reaches the top of the leaderboard 244, it will lock in position and the rest of the leaderboard 244 will continue to scroll underneath it.

In various exemplary embodiments, the system 100 may calculate and/or display one or more custom scores to describe one or more aspects of the users' performance. One example of such a custom score would be a decimal number calculated for a particular class or user session. Such a score could also be calculated using performance data from some or all classes or sessions over a particular period of time. In any of the examples described herein, such a custom score may be calculated and/or otherwise determined by the system 100 and/or by one or more processors of the exercise machine 102 based at least partly on an amount of time elapsed during an exercise class, a total output or total energy expended by the user 106 during such a class, and/or a number of exercise classes that the user 106 participated in within a given time period.

In various exemplary embodiments, performance information about other users may also be presented on the leaderboard 244 or in any other format, including formats that can be sorted by relevant performance parameters. Users may elect whether or not to make their performance available to all users, select users, and/or instructors, or to maintain it as private so that no one else can view it.

In various exemplary embodiments the user interface 200 may also present one or more video streams from a range of different sources. For example, one video stream may be the live or archived class content shown in the primary window 236, while one or more additional video streams may be displayed in other windows on the display 104. The various video streams may include live or recorded streaming instructor video or any other video content, including one or more live video chat streams. Such video content may include instructional information such as informational or demonstration content regarding how to perform a particular exercise. It may also include visual cues for the user 106 to follow in performing their exercise, such as timing indicators, counts, etc.

In further examples, one or more of the in-class user interfaces 200 illustrated in FIGS. 16-18 may be configured to provide one or more notifications 246 to the user 106 during the exercise class. For example, one or more of the sensors 147 may be configured to sense, detect, and/or otherwise determine a load applied to at least one of the belt 120, the deck 112, one or both of the motors 114, 118, and/or other components of the exercise machine 102. Such sensors 147 may send one or more signals to the processor or other digital hardware 148 of the exercise machine 102 indicative of such a load and/or of a change in such a load. At least partly in response to such signals, the processor or other digital hardware 148 of the exercise machine 102 may cause the notification 246 to be displayed on the display 104 together with at least part of the exercise class selected by the user 106. Such signals may indicate, for example, that the user 106 has stepped off of the belt 120 during a run segment of the exercise class. Accordingly, such notifications 246 may indicate that the user 106 has stepped off of the belt 120 and/or the deck 112. Such notifications 246 may also request a response from the user 106. For example, such notifications 246 may request the that the user 106 confirm that he/she is not hurt and/or that the user 106 would like to continue exercising.

Figure 19:
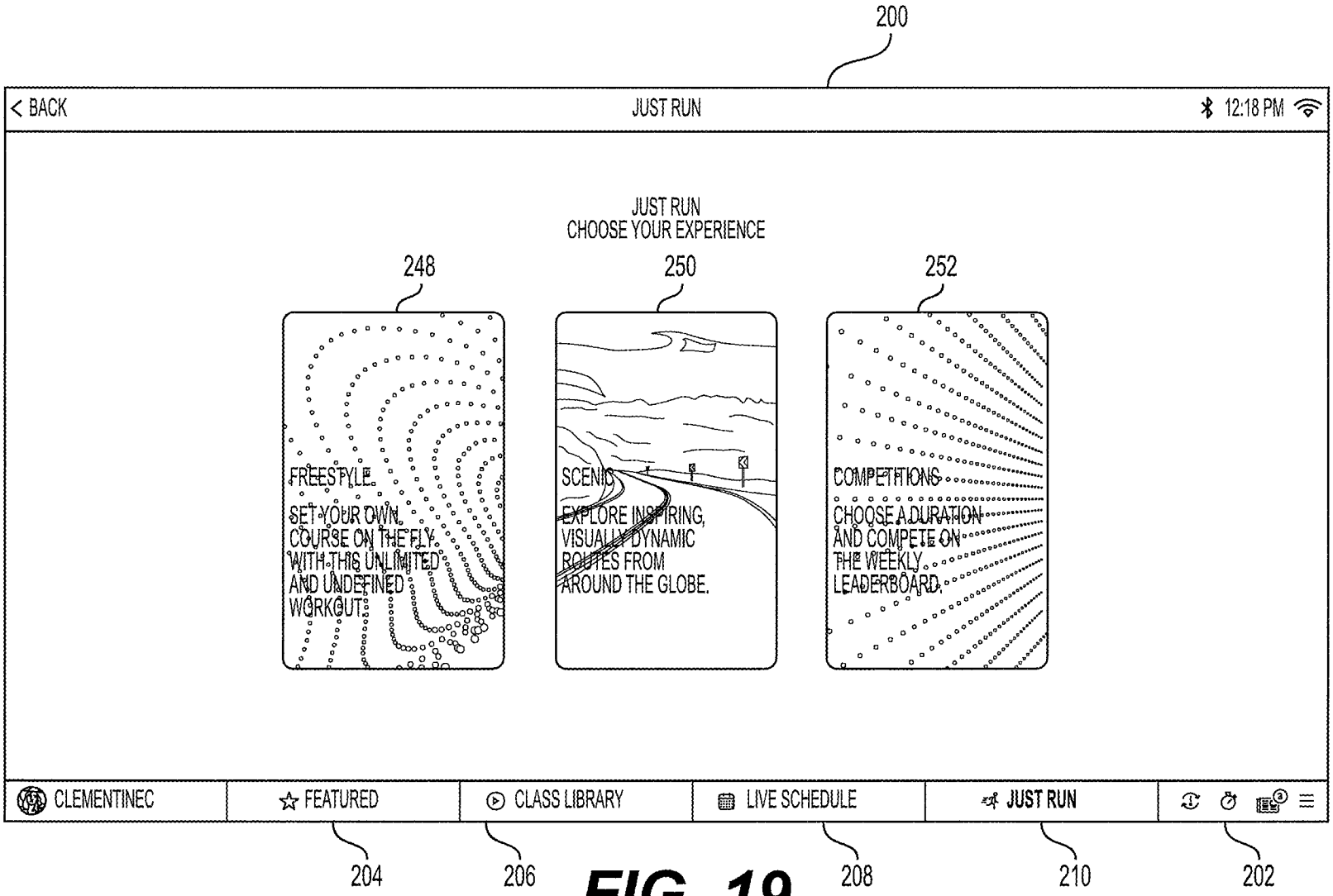
FIG. 19 illustrates another example user interface of the present disclosure including information related to a just run user experience.
Figure 20:
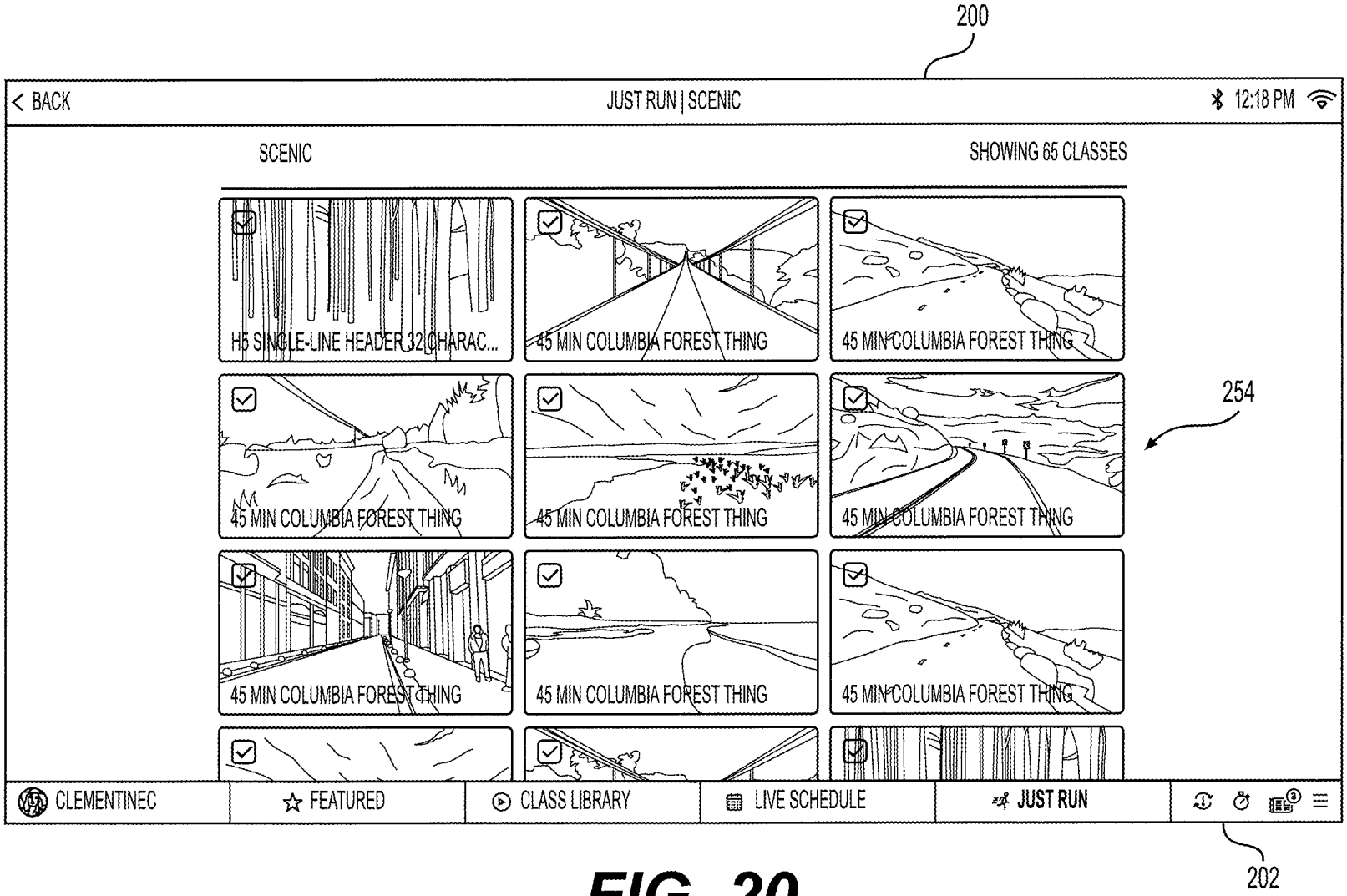
FIG. 20 illustrates still another example user interface of the present disclosure including information related to scenic running paths associated with the just run user experience.
Figure 21:
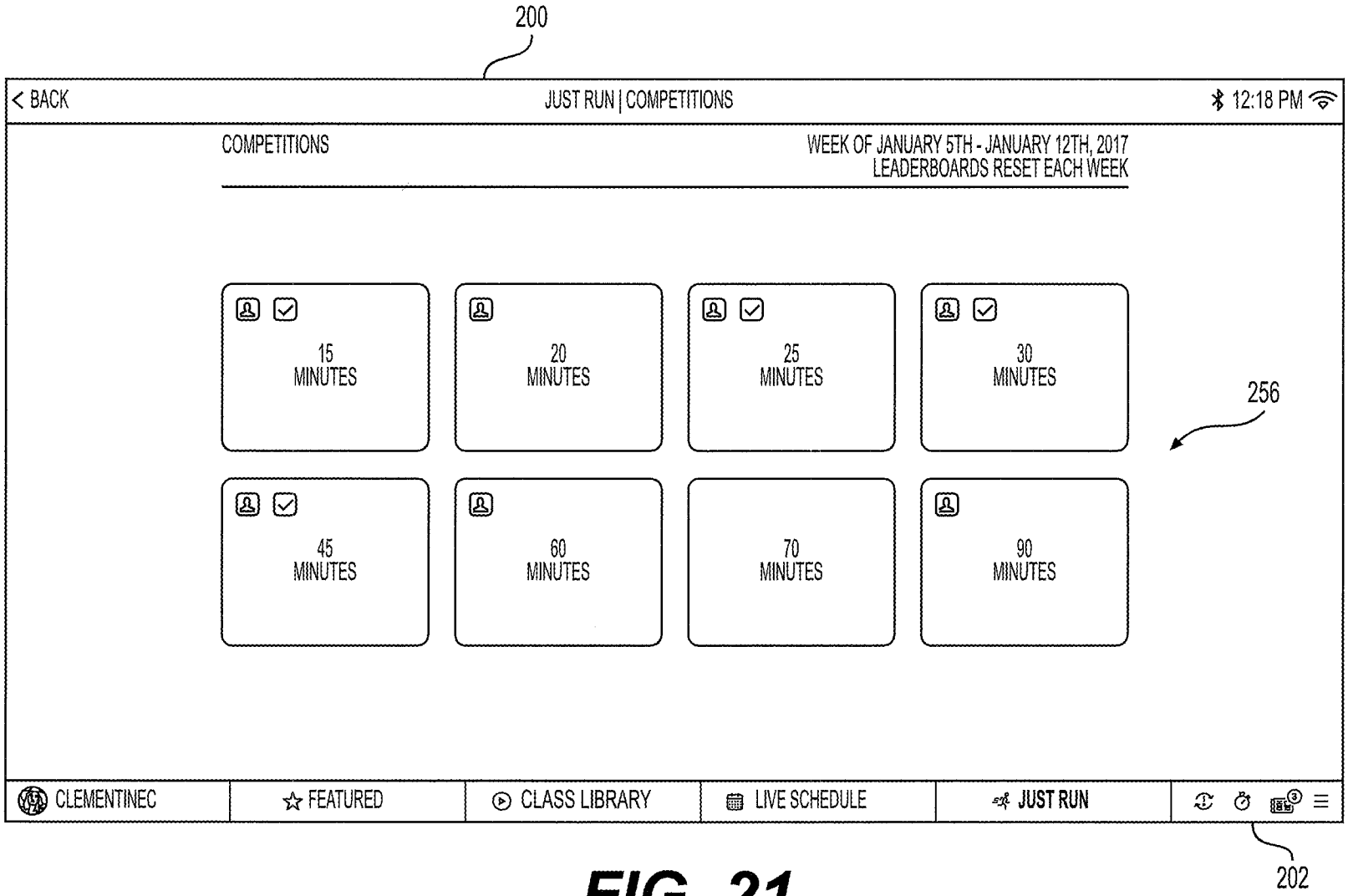
FIG. 21 illustrates yet another example user interface of the present disclosure including information related to competitions associated with the just run user experience.

As illustrated by the example user interfaces 200 shown in FIGS. 19-21, if the user 106 selects the fourth tab 210 associated with the "just run" functionality of the exercise machine 102, the system 100 may provide a user interface 200 showing information related to available quick-start running exercises/applications. For example, the user interface 200 may include one or more icons or thumbnails 248, 250, 252 allowing the user 106 to select a desired exercise regimen. The freestyle icon 248 may, for example, enable the user 106 to set his/her own incline, belt speed, running course, and/or other parameters, and may enable the user 106 to exercise in an undefined and unlimited way (e.g., without a specific exercise class being displayed on the display 104). The scenic icon 250, may be similar to the freestyle icon 248 in that it may enable the user 106 to exercise without a specific exercise class being displayed on the display 104. However, in response to receiving an input indicative of the selection of the scenic icon 250, the user interface 200 may present a plurality of additional icons or thumbnails 254 corresponding to respective scenic running trails stored in a memory of the exercise machine 102. Such icons or thumbnails 254 are illustrated in FIG. 20. Upon selecting one of the icons or thumbnails 254, the user interface 200 may display the selected running trail on the display 104 as the user 106 exercises on the treadmill 102. Further, the competitions icon 252 may enable the user 106 to perform a relatively high-intensity workout without a specific exercise class being displayed on the display 104. For example, in response to receiving an input indicative of the selection of the competitions icon 252, the user interface 200 may present a plurality of additional icons or thumbnails 256 corresponding to respective time-based challenges or competitions stored in a memory of the exercise machine 102. Such icons or thumbnails 256 are illustrated in FIG. 21. Upon selecting one of the icons or thumbnails 256, the user interface 200 may display belt speed, deck incline, output, elapsed time, mile pace, calories burn, and/or other performance parameters or other information on the display 104 associated with the selected competition.

Figure 22:
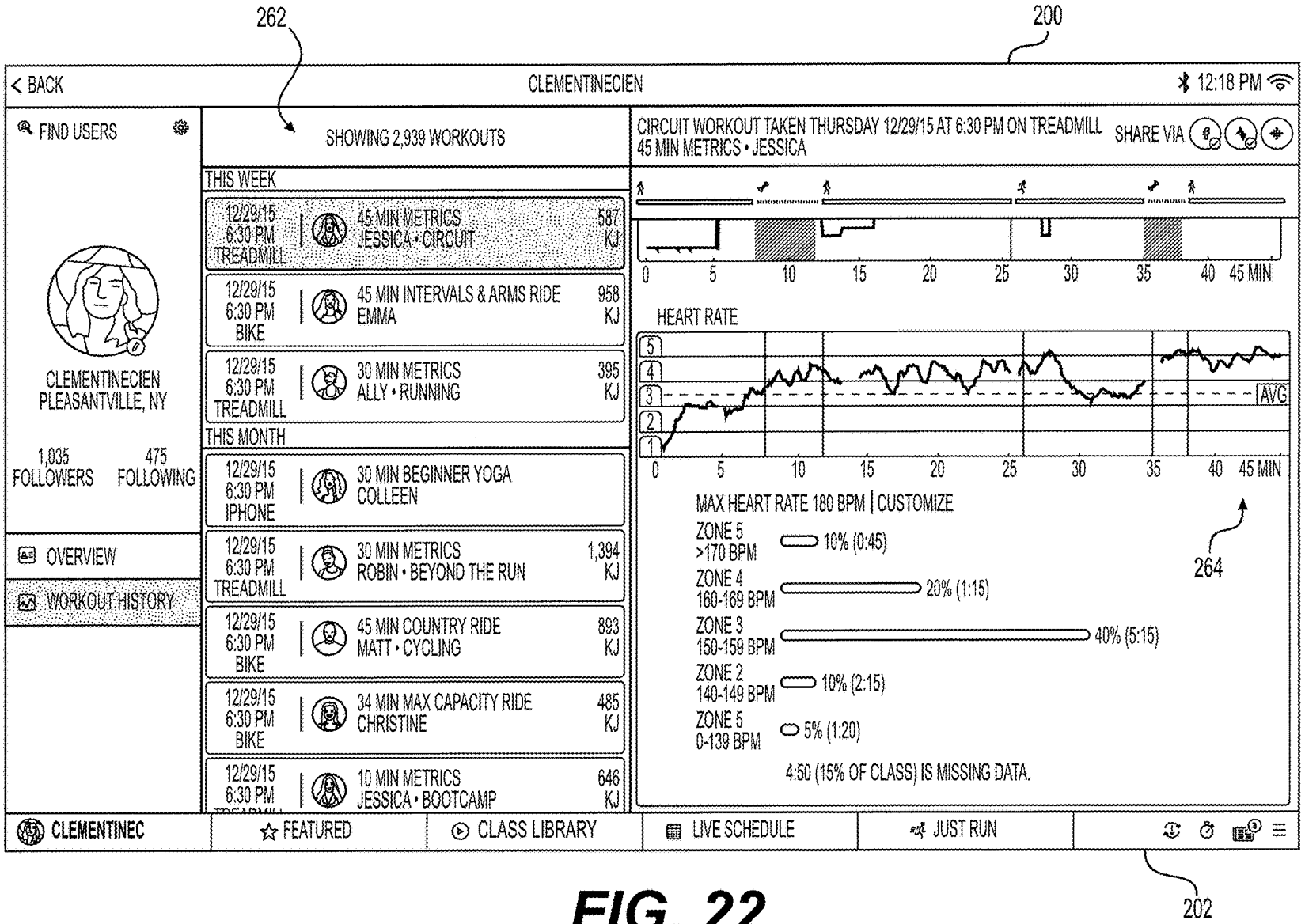
FIG. 22 illustrates a further example user interface of the present disclosure including performance information associated with a particular exercise class.
Figure 23:
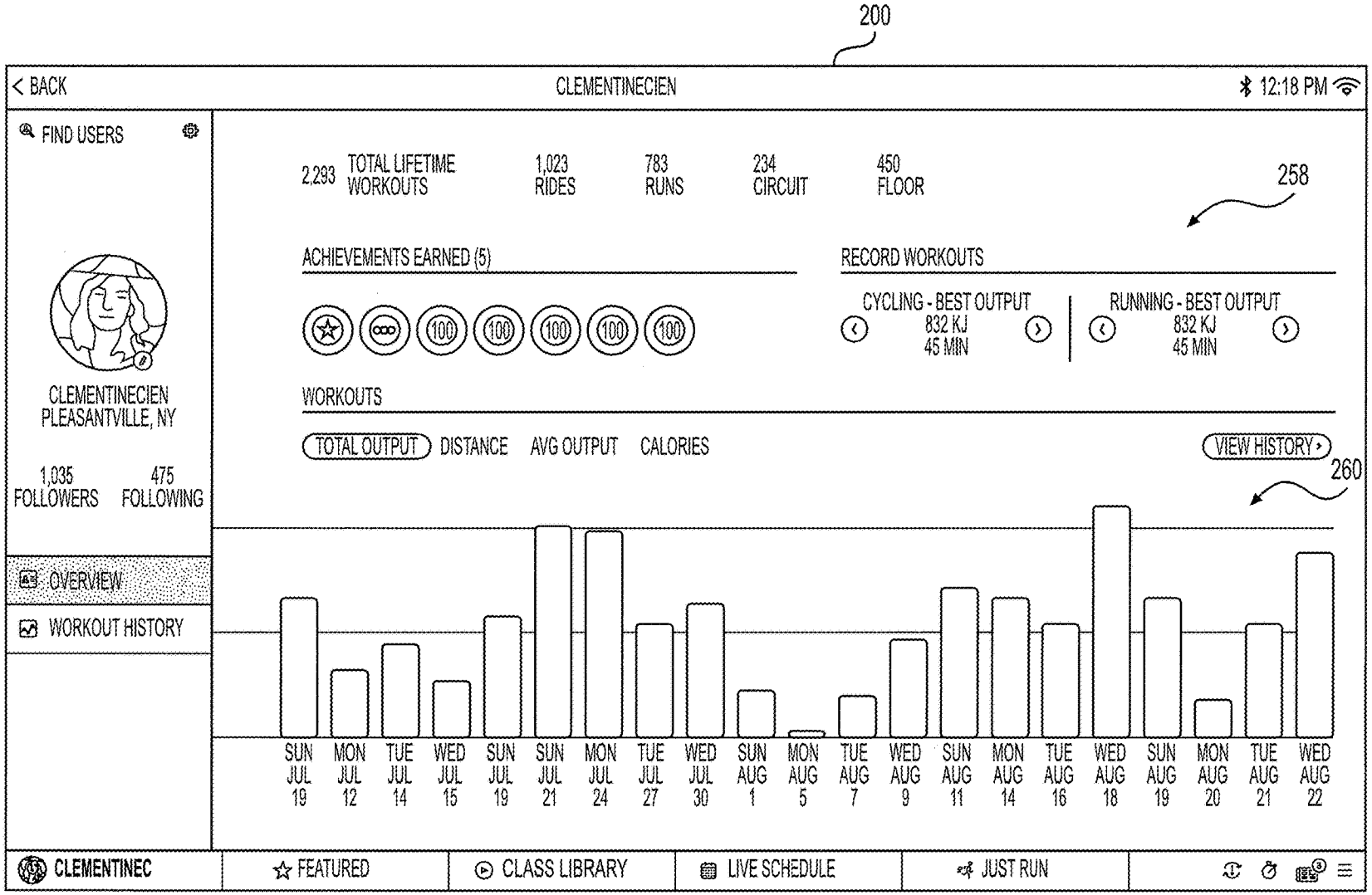
FIG. 23 illustrates another example user interface of the present disclosure including performance information associated with a particular exercise class.
Figure 24:
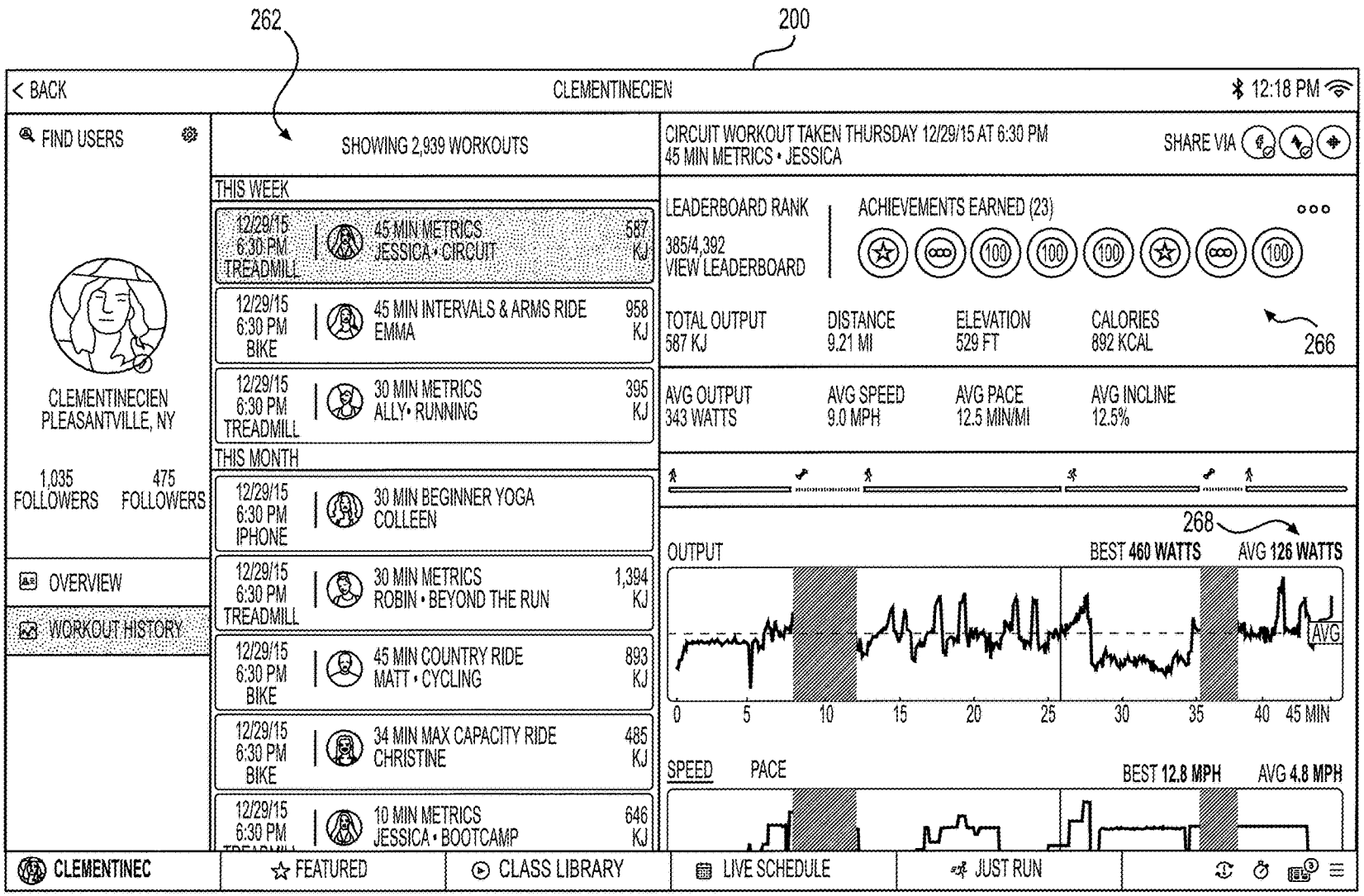
FIG. 24 illustrates still another example user interface of the present disclosure including performance information associated with a particular exercise class.
Figure 25:
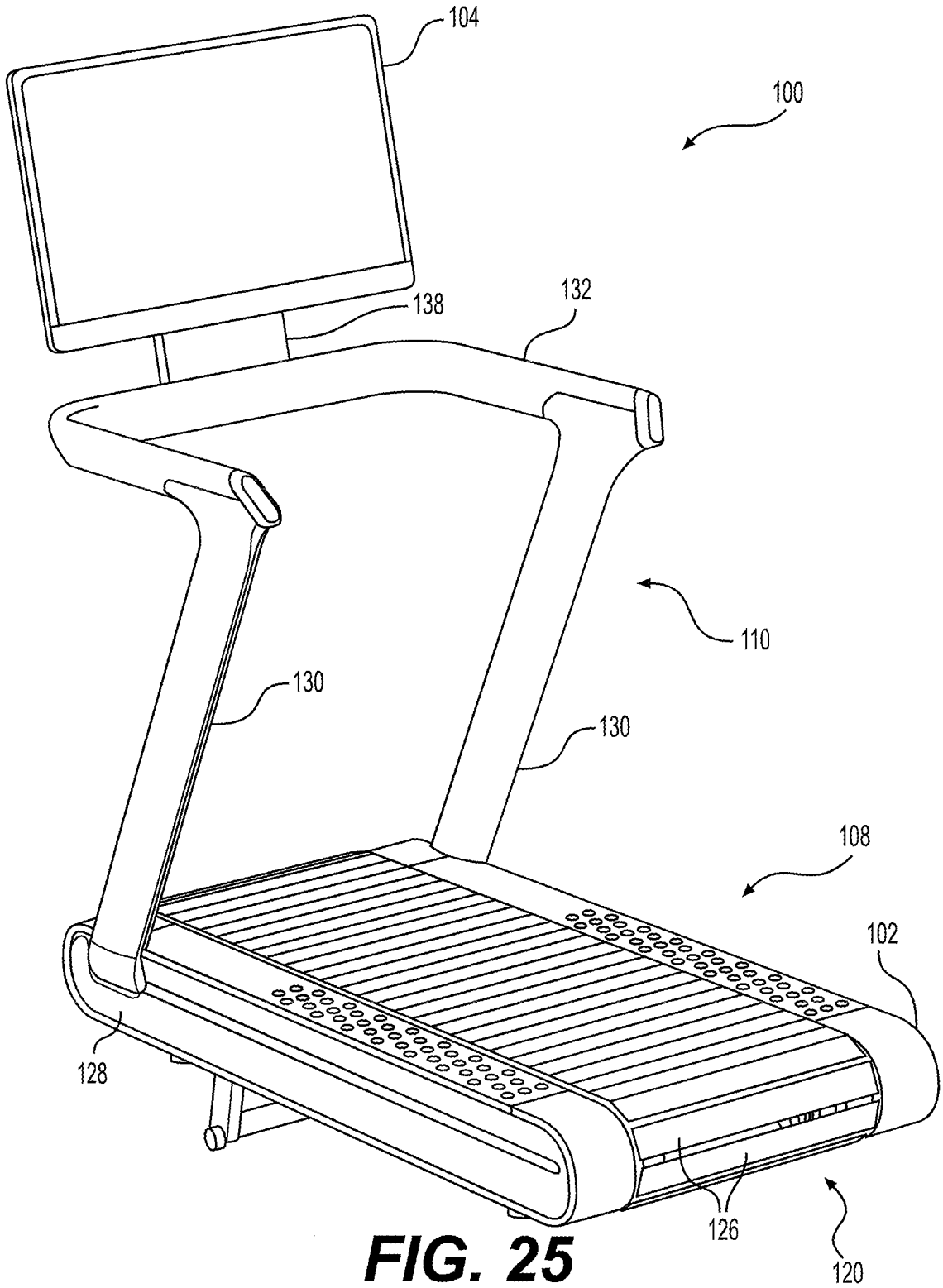
FIG. 25 illustrates an exercise machine according to still another example embodiment of the present disclosure.

FIGS. 22-24 illustrate example user interfaces 200 configured to provide performance information to the user 106 before, during, or after a selected exercise class. For example, the user interface 200 illustrated in FIG. 23 provides an overview of information associated with a particular user 106 (e.g., "clementinecein"). As indicated in the user interface 200 of FIG. 23, such information may include, among other things, the number of followers the user 106 has, the number of fellow participants that the user 106 is following, the total lifetime runs, rides, circuits, or other workouts that the user 106 has done, the various achievements or rewards the user 106 has accomplished, personal best output records of the user 106, a timeline of the user's recent workout activity, and/or other such general information associated with the user's workout activities. Such information may be displayed in one or more separate portions or windows 258, 260 of the user interface 200. In further examples, on the other hand, such information may be provided in the user interface 200 in alternative formats, windows, or locations.

The user interfaces 200 illustrated in FIGS. 22 and 24, on the other hand, provide performance metrics, performance information, and/or other more detailed information associated with the workout history of the particular user 106. For example, as indicated in the user interface 200 of FIG. 22, such information may include a listing of workouts or other exercise classes performed by the user 106 in the present week and/or in the present month. Such information may be displayed in a first window 262 of the user interface 200, and may further include a summary of the user's output during each exercise class, the date and time of the class, the instructor, and/or other information. The user interface 200 may also include one or more additional windows 264 and/or other formats useful in providing additional information regarding the workout history of the user 106. For example, such an additional window 264 may provide specific performance metrics (e.g., a heart rate trend line, a segmented timeline, an average heart rate, a total output, and/or other performance metrics) associated with a specific one of the previous workouts shown in the first window 262.

Similarly, as illustrated in FIG. 24, one or more additional user interfaces 200 providing information associated with the workout history of the particular user 106 may include the window 262 described above, as well as one or more additional windows 266, 268 providing the achievements, output trends, and/or other workout information. For example, the window 266 may display the total output, distance run, elevation ascended, calories burned, average output and/or energy expended, average speed, average mile pace, and/or other information associated with a specific one of the previous workouts shown in the first window 262. The window 266 may also display the leaderboard rank of the user 106 corresponding to the specific one of the previous workouts, as well as various achievements earned for performing the one of the previous workouts. The window 268, on the other hand, may provide speed, output, and or other trend lines associated with the specific one of the previous workouts. As a result, the user interfaces 200 illustrated in FIGS. 22-24 may provide the user 106 with relatively detailed performance information that can be used by the user 106 to improve his/her overall health and/or abilities. Any of the information provided via the user interfaces 200 described herein may be stored in a memory or other component of the digital hardware 148 of the exercise machine 102 and/or may be stored remotely.

Figure 5:
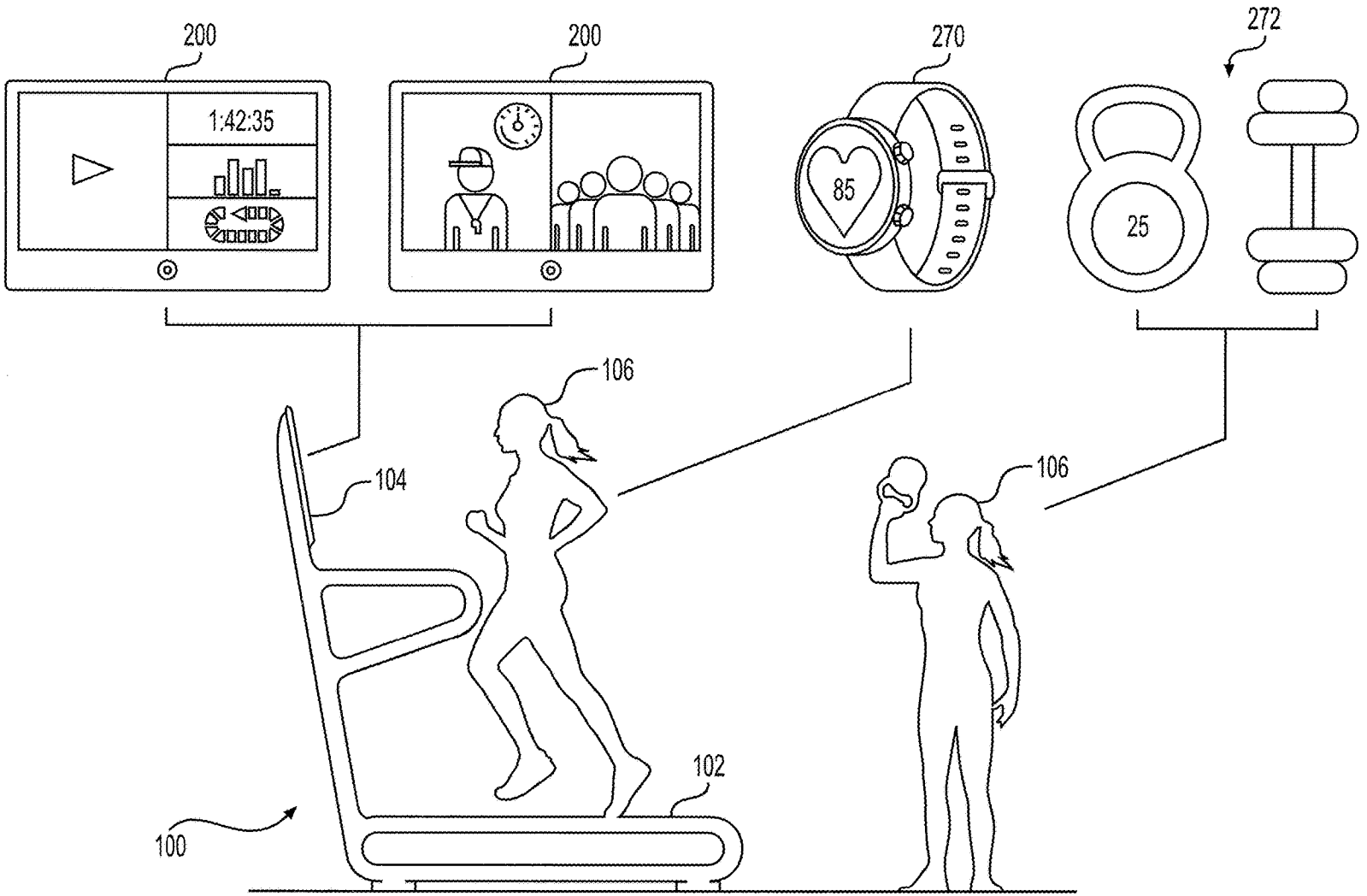
FIG. 5 is an illustration showing an exemplary exercise machine as disclosed herein including illustrations of exemplary information displayed on a display screen, a personal digital device, as well as weights and other accessory devices.

The performance-focused user interfaces 200 illustrated in FIGS. 22-24 may also be configured to provide information obtained from various additional sources. For example, data regarding user performance may be gathered from a variety of sources in addition to the various sensors 147 on the primary exercise machine 102. As illustrated in FIG. 5, other exercise machines 102 and devices used during an exercise class may each include one or more sensors to gather information regarding user performance. The user 106 may also use a variety of other clothing or devices attached to their body (e.g., a watch, a wrist band, a head band, a hat, shoes, etc.) including one or more additional sensors 270. The user 106 may also use other exercise equipment 272 such as weights, resistance bands, rollers, or any other suitable equipment, and such exercise equipment 272 may also include one or more such additional sensors 270. Data from all of these sources may be gathered by the local system 100 and analyzed to provide user performance feedback.

One challenge with certain types of data gathered from such sensors 270 is determining the proper context for interpreting the data so that accurate information regarding user performance can be derived. For example, a sensor 270 worn on the user's wrist may provide data indicating that the user's wrist performed a series of movements consistent with several different exercises, but it may be difficult or impossible to derive which exercise the user 106 was actually performing. Without context, data showing that the user's wrist moved up and down may indicate that the user 106 was running or they may simply have been moving their arm. As a result, performance data derived from such sensors 270 can be very inaccurate.

In various exemplary embodiments, data from a variety of sensors 270 on exercise equipment 272 such as free weights and on the users' body can be gathered, and the system 100 can use information regarding the instructor-led group fitness class to improve accuracy by providing context for the interpretation of sensor data gathered from all sources. If the class instructor has, for example, directed users 106 to do push-ups, the system 100 can assume that sensed movement consistent with a push-up is actually a push-up and interpret the sensor data accordingly. The context provided by the instructor-led group fitness class can substantially improve the resulting performance data.

Accordingly, the one or more user interfaces 200 described with respect to at least FIGS. 22-24 may also provide one or more additional windows that can be used to display any of the performance data and/or other information obtained from the sensors 270 and/or the exercise equipment 272. Such additional windows may also be configured to display a range of content including additional performance data, information about the class, instructor, other participants, etc., or secondary video streams. Such additional windows can allow the user 106 to see a range of information regarding other current or past participants to compare performance, and open or close voice or video chat streams or other communication channels. In various exemplary embodiments the user 106 can simultaneously access and/or view other content including movies, television channels, online channels, etc. via one or more such additional windows.

In various exemplary embodiments, the user interfaces 200 described herein may be run through a local program or application using a local operating system such as an Android or iOS application, or via a browser-based system. Any of the performance metrics or other information described herein with respect to the various user interfaces 200 may also be accessed remotely via any suitable network such as the internet. For example, users 106 may be able to access a website from a tablet, mobile phone, computer, and/or any other digital device, and such users 106 may be able to review historical information, communicate with other participants, schedule classes, access instructor information, and/or view any of the information described herein with respect to the various user interfaces 200 through such a website.

User-Generated Content

Figure 8:
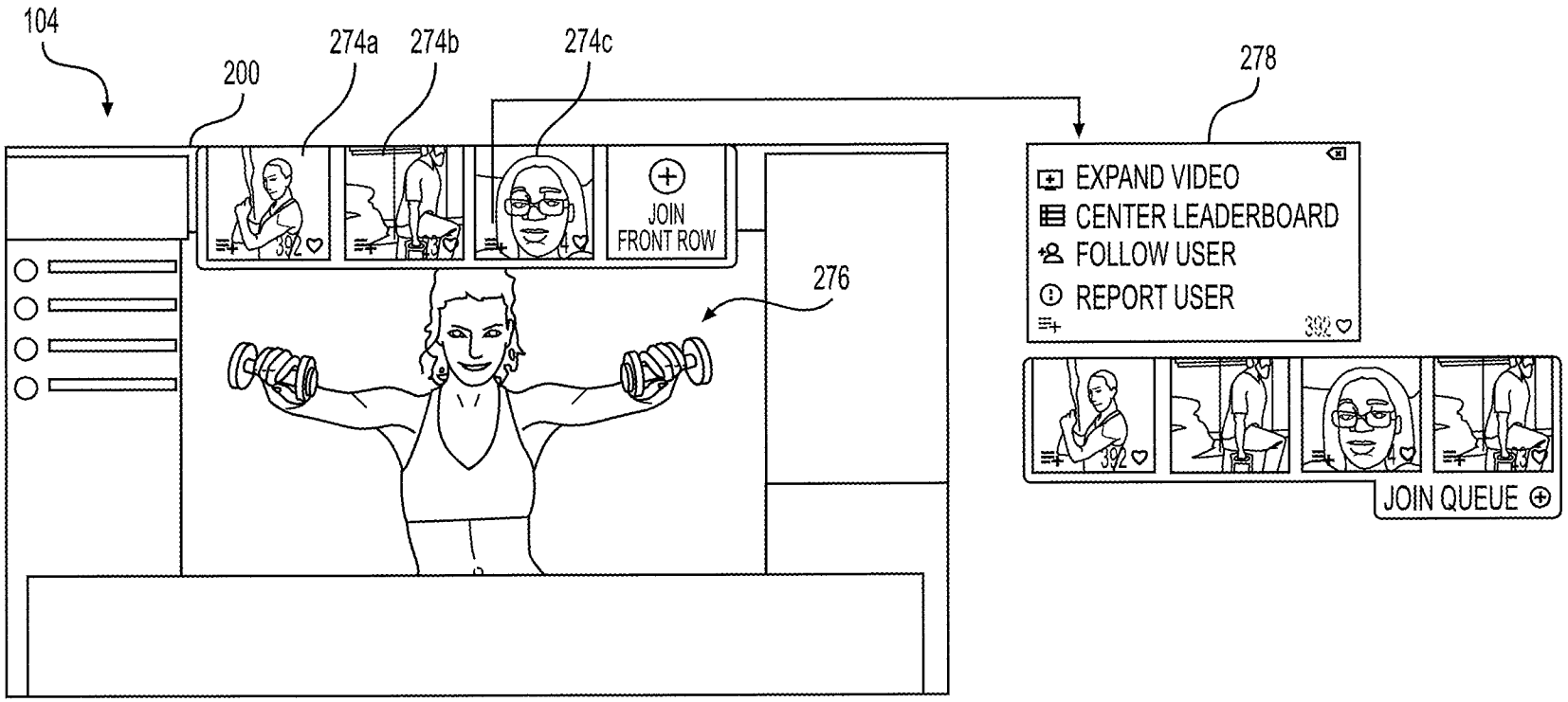
FIG. 8 is an illustration of an exemplary user interface of the present disclosure.

One feature of in-person group exercise classes is the ability to see other participants performing the exercises or other activities in response to the class leader's instructions. This ability to see others performing the same exercises or activities can provide motivation to maintain or improve performance, or help the user confirm that they are performing the proper exercise with proper form. In various exemplary embodiments of the present disclosure, video streams can be displayed on the one or more displays 104 of the respective exercise machines 102 showing other class participants performing the exercises as instructed by an instructor or other class leader. In various exemplary embodiments, such additional video streams may include user-generated content related to the live or previously recorded exercise class content. Referring to FIG. 8 for example, an exemplary embodiment is illustrated wherein video streams of other class participants are displayed in sub-windows 274*a*, 274*b*, 274*c* . . . 274*n* (collectively "sub-windows 274") across a top portion of a user interface 200 shown on the display 104. Such sub-windows 274 may be displayed on the display 104 while an instructor is displayed in a primary window 276 of the user interface 200. If the class is a live class, such content may be streamed live. If the class is an archived class, such content may be streamed live if the other class participant is taking the class at the same time, or may be archived content from when the other class participant previously took the class. One or more of such video streams may be displayed on the one or more displays 104 described herein. Additionally, by touching, selecting, and/or otherwise providing input via one of the sub-windows 274, the user interface 200 may provide an additional window 278 enabling the user 106 to expand a video associated with the selected sub-window, follow a user associated with the selected sub-window, and/or perform one or more additional actions associated with the selected sub-window.

In various exemplary embodiments, the user 106 may also be able to provide feedback regarding such user generated content. For example, the user 106 may be able to input positive or negative feedback such as indicating that they like or dislike the user-generated content by clicking on an icon provided via the additional window 278 indicating their opinion or otherwise inputting their opinion.

In various exemplary embodiments, the user 106 may also choose whether or not to display any such user-generated content. If user-generated content is displayed, which user-generated content is displayed to a particular user 106 can be determined several different ways. In various exemplary embodiments, the user-generated content may be chosen by the user 106 by selecting it from among the available user-generated content for a particular exercise class currently be displayed via the display 104. Such user-generated content may also be chosen by the class instructor or one or more content editors, it may be presented via a content queue ordered based on any suitable criteria, or it may be chosen by the system 100 based on one or more suitable criteria. For example, the user-generated content to be displayed could simply be a time-based queue of available user-generated content without regard to quality.

In various exemplary embodiments, the user-generated content to be displayed may be selected to provide the best quality user-generated content available for a particular selected exercise class at the time of viewing. At the time the class is aired live, the available user-generated content would be limited to live streamed content generated during the class itself. For archived classes, the available user-generated content could include all content generated by every user that has participated in the class at any time. The user-generated content to be displayed for an archived class may be based on accumulated ratings for that user-generated content over time, or on any other measure of popularity. Such a methodology would result in an improvement of the user-generated content displayed with any archived class over time, as the user-generated content receiving the best feedback would be selected for display while user-generated content that did not receive positive feedback would not be displayed.

Local System

As noted above, an example local system 100 may include an exercise machine 102, and a range of associated sensing, data storage, processing, and/or communications components (e.g., digital hardware 148). In example embodiments, such components may be disposed onboard the exercise machine 102 itself and/or located near the exercise machine 102. The processing, data storage, and/or communications components may be located within a housing of the display 104 to form a single integrated onboard computer and display screen, or they may be separately housed locally on or near the exercise machine 102. Such an example local system 100 may communicate with one or more remote servers through wired or wireless connections using any suitable network or protocol.

Additionally as noted above, an example exercise machine 102 may be equipped with various sensors 147 to measure, sense, detect, and/or otherwise determine information relating to user performance metrics. Such information may be stored in memory associated with the digital hardware 148 and/or in memory associated with the remote servers, and such information may be used by the processors and/or other components of the digital hardware 148 to determine one or more of the performance metrics described herein and/or to determine other performance information. The exercise machine 102 may also be equipped with or connected to various data input devices or other user interfaces such as the display 104, touchscreens, video cameras, and/or microphones.

The sensors 147 and other input devices can communicate with local and/or remote processing and storage devices via any suitable communications protocol and network, using any suitable connection including wired or wireless connections. In various exemplary embodiments, local communication may be managed using a variety of techniques. For example, local communication may be managed using wired transport with a serial protocol to communicate between sensors and the console. Local communication may also be managed using a wireless communication protocol such as the ANT or ANT+ protocol. ANT is a 2.4 GHz practical wireless networking protocol and embedded system solution specifically designed for wireless sensor networks (WSN) that require ultra-low power. Advantages include extremely compact architecture, network flexibility and scalability, ease of use and low system cost. Various combinations of wired and wireless local communication may also be used.

Access to any appropriate communications network such as the internet may be used to provide information to and receive information from other exercise machines 102 or other resources such as a backend system or platform. In various exemplary embodiments, the local system 100 can access and display information relating to other users either directly through a distributed platform or indirectly through a central platform regardless of their location. Such other users may be present at the same location or a nearby location, or they may be at a remote location.

Content Creation and Distribution

Content for delivery to users 106 including live and archived exercise classes, live and archived instructional content such as video content explaining how to properly perform an exercise, scenic or map-based content, videos, and/or animations that can be rendered in three-dimensions from any angle may be created and stored in various local or remote locations and shared across the networked exercise system. Such an example networked exercise system is illustrated in at least FIG. 9. This overview of such a networked exercise system is exemplary only and it will be readily understood that example embodiments of the present disclosure can be implemented through a variety of different system architectures using centralized or distributed content creation and distribution techniques.

In various exemplary embodiments, the networked exercise system 100 is managed through one or more networked backend servers and includes various databases for storage of user information, system information, performance information, archived content, etc. Users' local systems 100 are in communication with the networked backend servers via any appropriate network, including without limitation the internet. As an example of an alternative distribution approach, in various exemplary embodiments the backend servers could be eliminated and data could be communicated throughout the system in a distributed or peer-to-peer manner rather than via a central server network. In such a system, performance data may be broken up into small packets or "pieces" and distributed among user devices such that complete data sets are quickly distributed to all devices for display as required.

Figure 9:
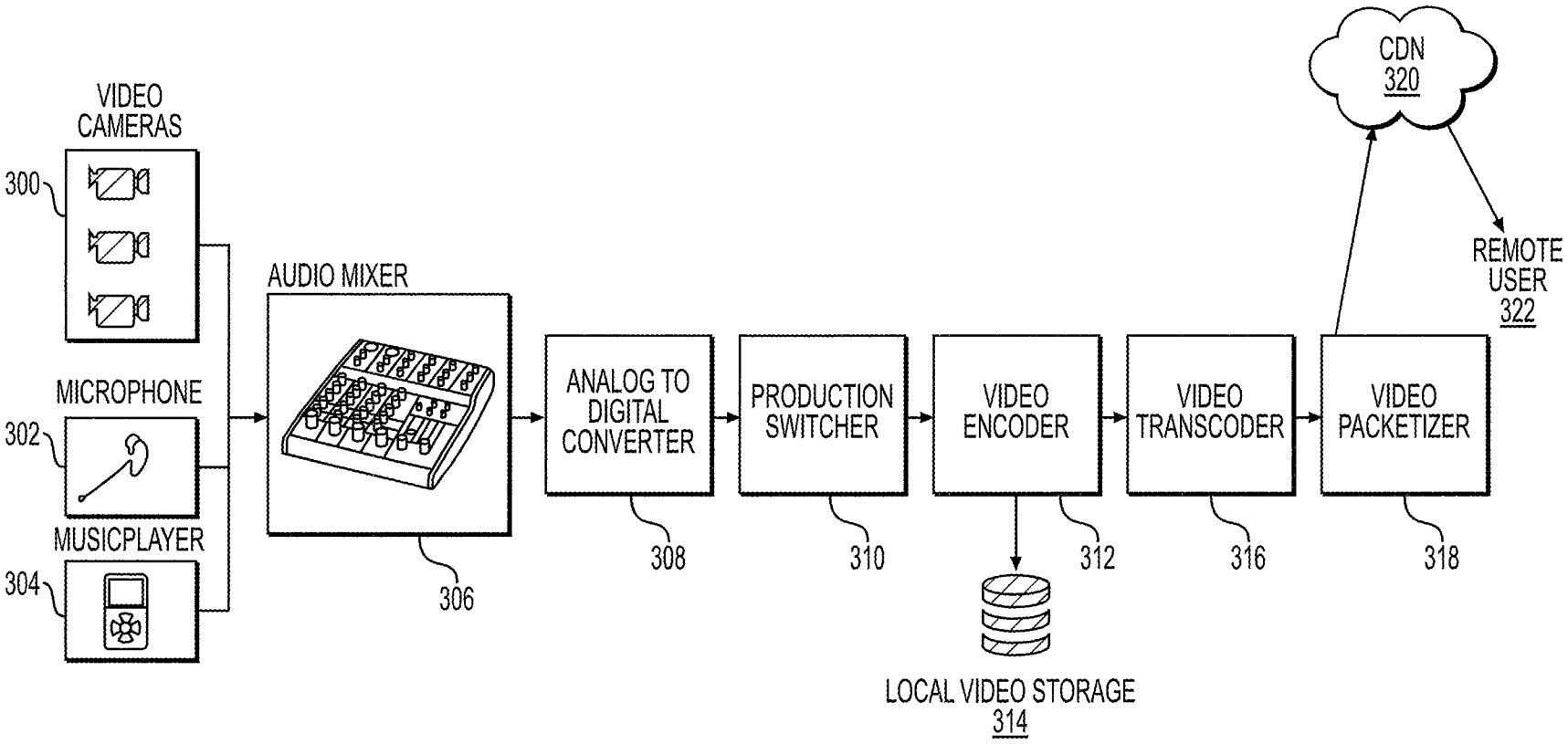
FIG. 9 is a schematic illustration showing exemplary components used for content creation and/or distribution.

Content for distribution through the network can be created in a variety of different ways. Content recording locations may include professional content recording studios or amateur and home-based locations. In various exemplary embodiments, recording studios may include space for live instructor-led exercise classes with live studio participation, or may be dedicated studios with no live, in-studio participation. As shown in FIG. 9, recording equipment including one or more video cameras 300, microphones 302, mp3 players or other music players 304, and/or other components and can be used to capture the instructor and/or participants during the class. Multiple cameras 300 can provide different views, and 3D cameras 300 can be used to create 3D content. In various exemplary embodiments, content may also be generated locally by users 106. For example, exercise machines 102 may be equipped with recording equipment including microphones 302 and cameras 300. Users 106 may generate live or recorded classes that can be transmitted, stored in the system, and distributed throughout the network.

With continued reference to FIG. 9, class content may be generated by providing outputs of the one or more video cameras 300, microphones 302, and/or music players 304 as inputs to an audio mixer 306. The audio mixer 306 may output content to an analog to digital converter 308, which may provide converted data to a production switcher 310. The production switcher 310 may send the production video to a video encoder 312, which may store the encoded video to a local storage device 314, and may also send it to a video transcoder 316. The video transcoder 316 may output transcoded data to a video packetizer 318, which may then send a packetized data stream out through a content distribution network 320 to remote system users 322. In various exemplary embodiments, instructors and/or users 106 may be provided with access to a content creation platform that they can use to help them create content. Such a platform may provide tools for selecting and editing music, managing volume controls, pushing out chat or other communications to users.

As described above, through the display 104 and/or other user interface on their exercise machine 102, users 106 may access lists, calendars, and schedules of live and recorded exercise classes available for delivery through the display 104. In various exemplary embodiments, once the user 106 selects a class, the local system 100 accesses and displays a primary data stream for the class. This primary data stream may include video, music, voice, text, or any other data, and may represent a live or previously recorded cycling class. The local system 100 may be equipped for hardware video accelerated encoding/decoding to manage high definition video quality at up to 1080 pixels based on existing technology. The local system 100 may automatically adjust bitrate/quality of the data stream for the class in order to bring participant the highest quality video according to user's bandwidth/hardware limitations.

In various exemplary embodiments, networked exercise systems and methods of the present disclosure may include multi-directional communication and data transfer capabilities that allow video, audio, voice, and data sharing among all users and/or instructors. This allows users to access and display multi-directional video and audio streams from the instructor and/or other users regardless of location, and to establish direct communications with other users to have private or conferenced video and/or audio communications during live or recorded classes. Such data streams can be established through the local system 100 for presentation via the one or more displays 104 via one or more of the user interfaces 200 described above. In various exemplary embodiments, users 106 can manage multiple data streams to select and control inputs and outputs. The local system 100 may allow the user 106 to control the volume of primary audio stream for the class as well as other audio channels for different users or even unrelated audio streams such as telephone calls or their own music selections. For example, this would allow a user 106 to turn down the instructor volume to facilitate a conversation with other users.

For live classes, in various exemplary embodiments the instructor may have the ability to communicate with the entire class simultaneously or to contact individual users, and solicit feedback from all users regardless of location in real-time. For example, instructors could ask users verbally, or text a pop-up message to users 106, seeking feedback on difficulty level, music choice, terrain, etc. Users 106 could then respond through components of the local system 100 by selecting an appropriate response, or providing verbal feedback. This allows instructors to use crowdsourcing to tailor a class to the needs of the participants, and to improve their classes by soliciting feedback or voting on particular class features or elements.

In various exemplary embodiments, instructors may also be able to set performance targets, and the system can measure and display to the user 106 and the instructor their performance relative to the target. For example, the instructor may set target metrics e.g. target power and speed, then display this next to users' readings with a color coding to indicate whether or not the user is meeting this target. The system may allow the instructor to remotely adjust exercise machine settings for individual users 106. In various exemplary embodiments, the exercise machine 102 may also automatically adjust based on information from the user 106, the instructor, or based on performance. For example, the exercise machine 102 may adjust the difficulty to maintain a particular performance parameter such as heart rate within a particular range or to meet a particular performance target.

In various exemplary embodiments, users 106 can control access to their own information, including sensor data, performance metrics, and personal information. Such data can be stored at the local system 100, transmitted for storage and management by a remote system and shared with other users, or stored remotely but not shared with other users. Users 106 may also elect to disclose their presence on the system to other users, or to participate in a class without making their presence known to other users.

In various exemplary embodiments, users 106 can access a list of all or selected current and/or past class participants. Such lists may include performance information for such users, such as total power, speed, steps, cadence, resistance, or a custom score that provides information about relative user performance. Such lists may also include controls to allow the user to open up live streams to the user such as live video chat streams.

System Features and User Resources

In various exemplary embodiments, the networked exercise system and methods may allow users 106 to create accounts and save and manage their performance data. As discussed above, the system may allow users 106 to browse schedules for upcoming live classes, signup for future live streaming classes, and setup reminders. Users 106 may also be able to invite others to participate in a live class, and setup text, email, voice, or other notifications and calendar entries. Users 106 may be able to access system, account, performance, and all other data via web-based or application based interfaces for desktop and/or mobile devices, in addition to the user interface for the local system 100 associated with their exercise machine 102.

In various exemplary embodiments, the system can provide for simultaneous participation by multiple users in a recorded class, synchronized by the system and allowing access to all of the same communication and data sharing features that are available for a live class. With such a feature, the participants simultaneously participating in the same archived class can compete against each other, as well as against past performances or "ghost" participants for the same class.

Figure 10:
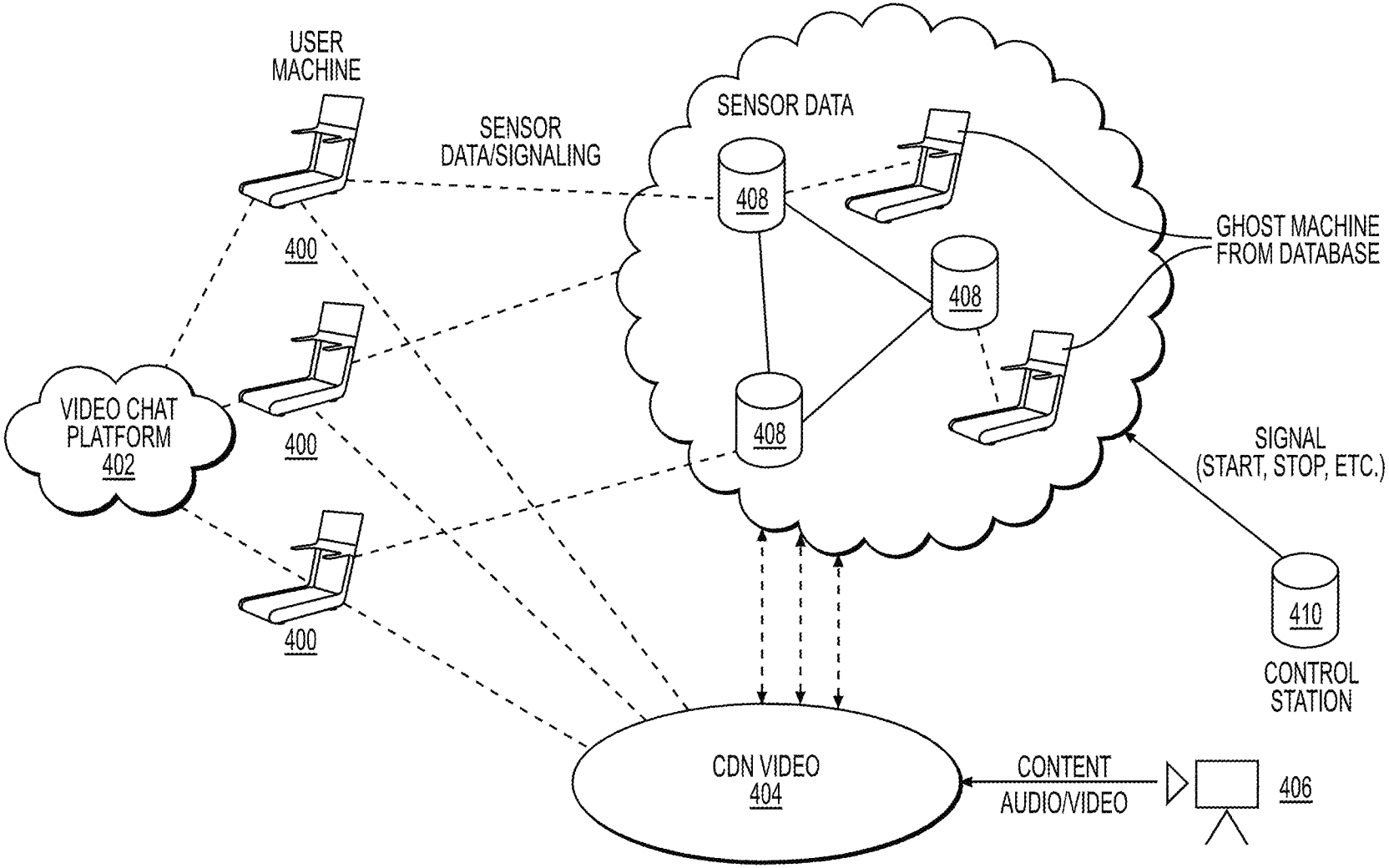
FIG. 10 is a schematic illustration of a basic network architecture according to an example embodiment of the present disclosure.
Figure 11:
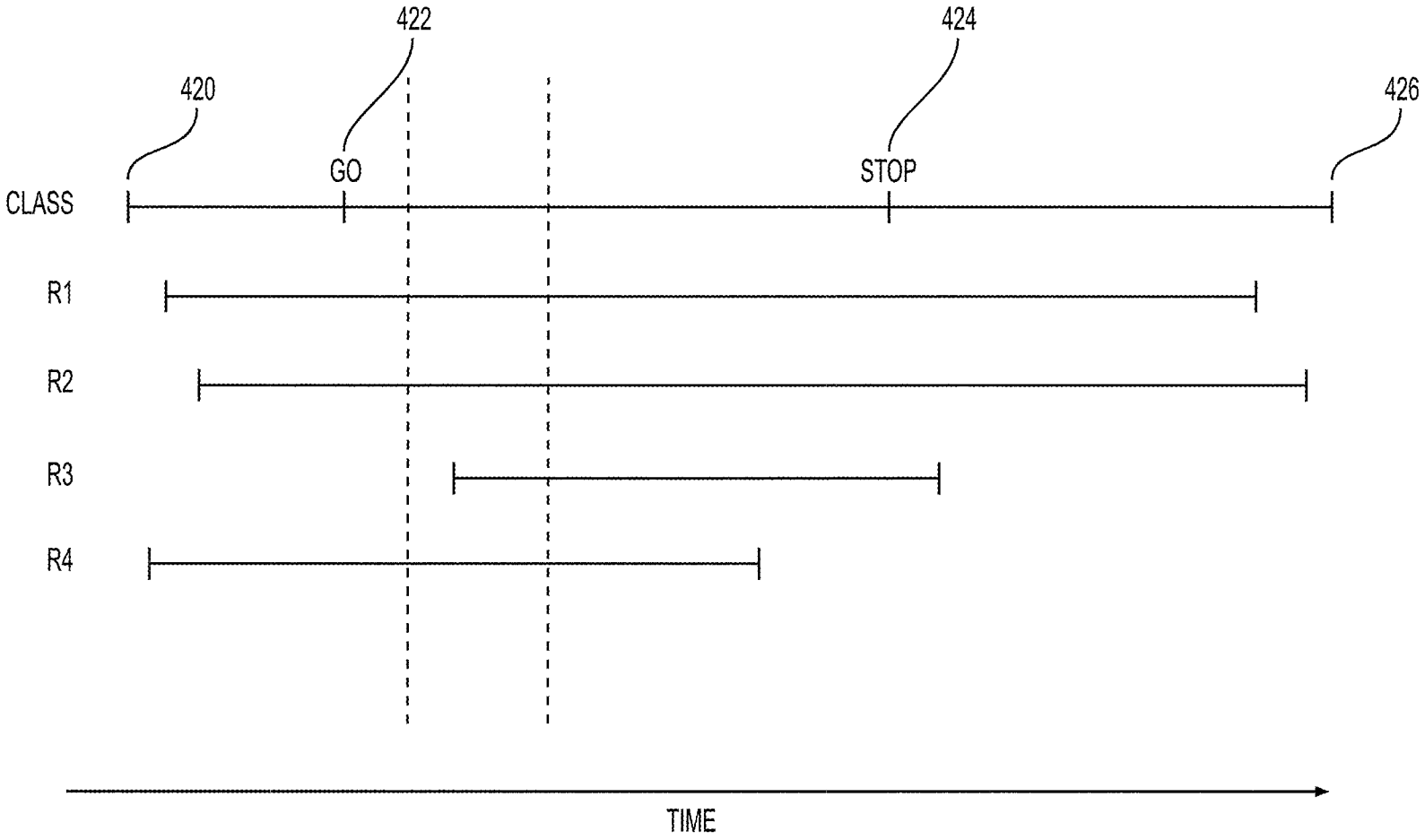
FIG. 11 illustrates a chart showing an example embodiment of a method for synchronizing data among different users participating in the same live or on-demand exercise class.

Referring to FIGS. 10 and 11, the system may be configured to feed synchronized live and/or archived video content and live and/or archived sensor data to users over the network. In various exemplary embodiments, the networked exercise system may be configured with a plurality of user exercise equipment 400 in communication with a video chat platform 402, a video content distribution network 404 that receives audio video content from one or more content sources 406. The user exercise equipment 400 may also be in communication with various other networks and servers. For example, the user exercise equipment 400 may exchange sensor and performance data and/or signaling with various databases 408, including historical or "ghost participant" data. A control station may provide signals via the network to control the collection, storage, and management of data across the system.

One challenge for the use of comparative data from live and/or historical sources is synchronization, since some users 106 may start exercising prior to the start of the actual class, while others may join after the class has started. In order to provide accurate data regarding class performance for the leaderboard, including archived performance data, each class may have a specific "go" or start signal that serves as the starting time point for the data comparison. Archived performance data may be calibrated to the same "go" signal as live participant data, allowing for comparative data to be presented through a leaderboard or other display through the end of the class. A "stop" signal at the end of the class marks the end time point for the performance comparison for both live and archived performance data. If a participant joins the class after the "go" signal, their data can be synched correctly starting at the time they join the class.

FIG. 11 shows various events relative to time, which is increasing from left to right on the scale at the bottom. The timeline for the class itself, whether live or archived, is shown at the top, with timelines for four different participants below it. The video being delivered for a live or archived class may begin before the actual class starts at the video start point 420. The GO signal point 422 indicates the start of the class or the class's comparison period, the STOP signal point 424 indicates the end of the class or the end of the class's comparison period, and the end video point 426 indicates the end of the video stream. For Participants 1, 2, and 4, who all start exercising before the GO signal point, the GO signal serves as their starting time point for class performance metrics. For Participant 3, the point in time when they actually start will serve as their starting time point for class performance metrics. For Participants 1, 2, and 3 who continued past the STOP signal point, their end point for class performance metrics will be the STOP signal point, while the end point for Participant 4 will be the time when they actually stopped exercising.

Using such a system, live and past performance data for the user or other participants can be provided during a class in a range of numerical and graphical formats for comparison and competition. Live and past performance data or target performance data for the user can also be displayed simultaneously to allow users to compare their performance to a benchmark in real time during or after a class. In various exemplary embodiments, the system may also allow users to establish handicapping systems to equalize the competition among different users or user groups allowing for broad based competitions.

In various exemplary embodiments, the system may combine information from multiple users 106 to produce a combined or collective result. For example, different user's performance information could be combined to produce a single performance measurement such as in a relay type race, where the times for different users are collected and combined into a single time or score for a team.

In various exemplary embodiments, the system may also combine the user's performance from two or more different exercise machines 102 to produce a single output or score. For example, performance information gathered from a bike and a treadmill used sequentially or as part of the same group exercise class may be combined together in a single output that reflects performance data from the plurality of exercise machines 102.

In various exemplary embodiments, a mobile application may allow users on non-networked exercise machines to access the system via a mobile digital device such as a tablet computer or mobile phone and access content, live streams, and other system features. The mobile device could access the system via any appropriate network using a dedicated application or browser.

In various exemplary embodiments, one or more secondary displays may be used by the system to display class content. Using a device such as CHROMECAST or a similar integrated device to enable it to display content provided by the system through the user interface, a secondary display screen may be used to display class content or other content provided by the system. The user interface could automatically detect the availability of such an enabled device and allow the user to select the display screen for particular content.

Various types of rewards and honors can be created for different achievements to create incentives for improving performance or reaching other goals. In various exemplary embodiments, the instructor or users can create mini-competitions for participation by all users or just a selected subset of users such as a group of friends. Competitions such as sprints, hill climbs, maximum power output, etc. can be preset or created in real-time through the user interface. Winners can be rewarded with prizes such as badges, trophies, or biking specific honors such as a green or yellow jersey. Competitions can be created within a class or session, or across multiple classes or sessions.

CLAUSES

The example clauses A-T noted below set forth example embodiments of the present disclosure. Any of the clauses below, or individual features thereof, may be combined in any way. Further, the descriptions included in any of the example clauses below may be combined with one or more features described above or illustrated in FIGS. 1-40. The clauses noted below are not intended to narrow the scope of the present disclosure in any way, and merely constitute examples of the various embodiments described herein.

A: In an example embodiment of the present disclosure, a treadmill includes a deck having a continuous track, and a plurality of slats fixedly connected to the track. The treadmill also includes a first post extending from the deck, a second post extending from the deck opposite the first post, and a first arm supported by the first post and including a first rotary control. The treadmill further includes a second arm opposite the first arm and supported by the second post. The second arm includes a second rotary control separate from the first rotary control. The first rotary control is configured to control a first function of the treadmill and the second rotary control is configured to control a second function of the treadmill different from the first function.

B: The treadmill of clause A, further comprising a first crossbar extending from the first arm to the second arm, and a second crossbar opposite the first crossbar extending from the first arm to the second arm, the second crossbar including a third control configured to stop rotation of the track.

C: The treadmill of clause A or B, wherein the first function comprises a rotational speed of the track, and the second function comprises an incline of the deck relative to a support surface on which the treadmill is disposed.

D: The treadmill of clause A, B, or C, wherein the first rotary control comprises an outer portion rotatable about a central axis of the first rotary control and relative to the first arm.

E: The treadmill of clause D, wherein the first rotary control further comprises an input device separate from the outer portion, the input device configured to control a third function of the treadmill different from the first and second functions.

F: The treadmill of clause D or E, wherein the outer portion is configured to contact at least one detent during rotation of the outer portion about the central axis, the at least one detent being configured to at least partly restrict rotation of the outer portion about the central axis.

G: The treadmill of clause A, B, C, D, E, or F, wherein the first rotary control comprises an indicator, and wherein rotation of an outer portion of the first rotary control results in commensurate temporary illumination of at least part of the indicator.

H: The treadmill of clause A, B, C, D, E, F, or G, wherein the first rotary control comprises: a first component configured to provide tactile feedback to a user of the treadmill as the user rotates the first rotary control relative to the first arm, and a second component different from the first component configured to provide visible feedback to the user as the user rotates the first rotary control relative to the first arm.

I: The treadmill of clause A, B, C, D, E, F, G, or H, wherein the first rotary control comprises a carrier, an outer portion rotatably connected to the carrier, and a printed circuit board connected to the carrier, and wherein rotation of the outer portion relative to the carrier causes a component of the printed circuit board to transmit a corresponding first signal to a controller of the treadmill.

J: The treadmill of clause I, wherein the first rotary control further comprises an inner portion including an input device, the input device is configured to receive an input, and receipt of the input causes the component of the printed circuit board to transmit a corresponding second signal to the controller.

K: In another example embodiment of the present disclosure, a treadmill includes a controller, a first motor operably connected to the controller, a second motor separate from the first motor and operably connected to the controller, a first rotary control operably connected to the controller, and a second rotary control separate from the first rotary control and operably connected to the controller. In such an embodiment, the first rotary control is configured to control a first function of the treadmill associated with the first motor. Additionally, the second rotary control is configured to control a second function of the treadmill associated with the second motor different from the first function.

L: The treadmill of clause K, wherein the first function comprises a rotational speed of a continuous track of the treadmill, and the second function comprises an incline of a deck of the treadmill relative to a support surface on which the treadmill is disposed.

M: The treadmill of clause K or L, wherein the first rotary control comprises a first outer portion rotatable about a central axis of the first rotary control, and the second rotary control comprises a second outer portion rotatable about a central axis of the second rotary control.

N: The treadmill of clause K, L, or M, wherein at least one of the first rotary control or the second rotary control comprises an input device operably connected to the controller and configured to control a third function of the treadmill different from the first and second functions.

O: The treadmill of clause K, L, M, or N, wherein at least one of the first rotary control or the second rotary control comprises an indicator, and wherein rotation of the at least one of the first rotary control or the second rotary control results in commensurate temporary illumination of at least part of the indicator.

P: The treadmill of clause K, L, M, N, or 0, further comprising a third control separate from the first rotary control and the second rotary control, the third control being operably connected to the controller and configured to stop rotation of a continuous track of the treadmill.

Q: In an example embodiment of the present disclosure, a method of manufacturing a treadmill includes providing an upper assembly including a first arm, a second arm opposite the first arm, a first crossbar extending from the first arm to the second arm, and a second crossbar opposite the first crossbar and extending from the first arm to the second arm. The method also includes connecting a first rotary control to the first arm, the first rotary control including an outer portion rotatable relative to the first arm, and an inner portion including an input device. The method further includes connecting a second rotary control to the second arm, the second rotary control including an outer portion rotatable relative to the second arm. The method also includes operably connecting the first and second rotary controls to a controller of the treadmill. The first rotary control is configured to control a first function of the treadmill via the controller, and the second rotary control is configured to control a second function of the treadmill via the controller different from the first function.

R: The method of clause Q, further comprising connecting a third control to the first crossbar, wherein the third control is operably connected to the controller of the treadmill, is configured to control a third function of the treadmill via the controller, and the third function is different from the first function and the second function.

S: The method of clause Q or R, wherein the outer portion of the first control is rotatable, relative to the inner portion of the first control, about a central axis of the first control, the first control further includes an indicator configured such that rotation of the outer portion of the first control results in commensurate temporary illumination of at least part of the indicator, and the input device is configured to control a third function of the treadmill different from the first function and the second function.

T: The method of clause S, wherein the first control further includes at least one detent configured to provide tactile feedback to a user of the treadmill as the user rotates the outer portion of the first control relative to the central axis.

CONCLUSION

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the spirit and scope of the present invention, which is set forth in the following claims.

What is claimed is:

1. A treadmill comprising:

a first rotary control comprising:

an outer portion having a substantially cylindrical component with a central opening extending through the substantially cylindrical component, the outer portion rotatable about an axis to receive a first input from a user to control a first function of the treadmill;

a unitary inner portion comprising:

a disc-shaped plate;

an input device disposed on the plate and configured to receive a second input from the user different from the first input; and a substantially cylindrical base extending from the plate, wherein the base is disposed within the central opening of the outer portion; and a fixed annular carrier including a plurality of detents, each detent in the plurality of detents located on the carrier in a direction of the rotation of the outer portion around the axis and configured to interface with the outer portion to correlate an incremental change in the first function of the treadmill; and a second rotary control separate from the first rotary control and configured to control a second function of the treadmill different from the first function.

2. The treadmill of claim 1, further comprising:

a first motor, wherein the first function controlled by the first rotary control is associated with the first motor; and a second motor, wherein the second function controlled by the second rotary control is associated with the second motor.

3. The treadmill of claim 2, wherein:

the first function is one of a rotational speed of a continuous track of the treadmill or an inclination angle of the treadmill and each detent in the plurality of detents is configured to correlate to the incremental change in the rotational speed of the continuous track or a degree of the inclination angle; and the second function is the other of the rotational speed of the continuous track of the treadmill or the inclination angle of the treadmill.

4. The treadmill of claim 1, wherein the plurality of detents are configured to at least partially restrict rotation of the outer portion about the axis.

5. The treadmill of claim 1, wherein the first rotary control further comprises:

an indicator configured such that rotation of the outer portion results in a commensurate illumination of at least part of the indicator, the commensurate illumination being indicative of an extent of rotation of the outer portion about the axis; and the plate disposed centrally relative to the outer portion and radially inward of the indicator.

6. The treadmill of claim 1, wherein:

the outer portion is rotatable relative to the inner portion;

the second input further controls the first function of the treadmill; and the input device comprises a button.

7. The treadmill of claim 1, further comprising:

a first arm including the first rotary control; and a second arm including the second rotary control, wherein the second rotary control comprises:

a second outer portion rotatable about a second axis to receive a third input from the user to control the second function of the treadmill, and a second inner portion comprising a second input device configured to receive a fourth input from the user different from the third input to control the second function of the treadmill.

8. The treadmill of claim 1, further comprising a crossbar, wherein at least one of the first rotary control or the second rotary control is disposed on the crossbar.

9. A method of using the treadmill of claim 1, the method comprising:

rotating the outer portion of the first rotary control to control the first function of the treadmill;

operating the input device of the first rotary control; and operating the second rotary control to control the second function of the treadmill.

10. A method comprising:

connecting a first rotary control to a treadmill, the first rotary control comprising:

an outer portion having a substantially cylindrical component with a central opening extending through the substantially cylindrical component, the outer portion rotatable about an axis to receive a first input from a user to control a first function of the treadmill;

a unitary inner portion comprising:

a disc-shaped plate;

an input device disposed on the plate and configured to receive a second input from the user different from the first input; and a substantially cylindrical base connected to and extending from the plate, wherein the cylindrical base is disposed within the central opening of the outer portion; and a fixed annular carrier including a plurality of detents and a frame, each detent in the plurality of detents disposed on a surface of the frame and configured to interface with the outer portion to correlate an incremental change in the first function controlled by the received first input; and connecting a second rotary control to the treadmill separate from the first rotary control, the second rotary control configured to control a second function of the treadmill different from the first function.

11. The method of claim 10, further comprising:

connecting a first motor to the treadmill, wherein the first function controlled by the first rotary control is associated with the first motor; and connecting a second motor to the treadmill, wherein the second function controlled by the second rotary control is associated with the second motor.

12. The method of claim 11, wherein:

the first function is one of a rotational speed of a continuous track of the treadmill or an inclination angle of the treadmill; and the second function is the other of the rotational speed of the continuous track of the treadmill or the inclination angle of the treadmill.

13. The method of claim 10, wherein the plurality of detents are configured to at least partially restrict rotation of the outer portion about the axis.

14. The method of claim 10, wherein the first rotary control further comprises:

an indicator configured such that rotation of the outer portion results in a commensurate illumination of at least part of the indicator, the commensurate illumination being indicative of an extent of rotation of the outer portion about the axis; and the plate disposed centrally relative to the outer portion and radially inward of the indicator.

15. The method of claim 10, wherein:

the outer portion is rotatable relative to the inner portion;

the second input further controls the first function of the treadmill; and the input device comprises a button.

16. The method of claim 10, further comprising fixedly connecting a plurality of slats to a continuous track of the treadmill.

17. The method of claim 10, wherein:

the connecting the first rotary control to the treadmill comprises connecting the first rotary control to a first arm of the treadmill;

the connecting the second rotary control to the treadmill comprises connecting the second rotary control to a second arm of the treadmill; and the second rotary control comprises:

a second outer portion rotatable about a second axis to receive a third input from the user to control the second function of the treadmill, and a second inner portion comprising a second input device configured to receive a fourth input from the user different from the third input to control the second function of the treadmill.

18. The method of claim 10, wherein at least one of the connecting the first rotary control to the treadmill or the connecting the second rotary control to the treadmill comprises disposing the first or second rotary control to a crossbar of the treadmill.

19. A treadmill comprising:

a controller;

a speaker;

a first motor operably connected to the controller;

a second motor separate from the first motor and operably connected to the controller;

a first rotary control comprising:

an outer portion having a substantially cylindrical component with a central opening extending through the substantially cylindrical component, the outer portion rotatable about an axis to receive a first input from a user to control a first function of the treadmill associated with the first motor;

a unitary inner portion comprising:

a disc-shaped plate;

an input device disposed on the plate and configured to receive a second input from the user different from the first input; and a substantially cylindrical base extending from the plate, wherein the base is disposed within the central opening of the outer portion; and a fixed annular carrier connected to the base of the unitary inner portion and including a plurality of detents, the plurality of detents located on an outer surface of carrier and configured to interface with the outer portion during a rotation of the outer portion around the carrier to cause the speaker to emit an audible noise upon the plurality of detents interfacing with the outer portion; and a second rotary control separate from the first rotary control and configured to control a second function of the treadmill associated with the second motor, the second function different from the first function.

20. The treadmill of claim 19, wherein:

the first function is one of a rotational speed of a continuous track of the treadmill or an inclination angle of the treadmill; and the second function is the other of the rotational speed of the continuous track of the treadmill or the inclination angle of the treadmill.

* * * * *